US006687666B2

(12) United States Patent
Ehara et al.

(10) Patent No.: US 6,687,666 B2
(45) Date of Patent: Feb. 3, 2004

(54) VOICE ENCODING DEVICE, VOICE DECODING DEVICE, RECORDING MEDIUM FOR RECORDING PROGRAM FOR REALIZING VOICE ENCODING/DECODING AND MOBILE COMMUNICATION DEVICE

(75) Inventors: Hiroyuki Ehara, Yokohama (JP); Toshiyuki Morii, Kawasaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/729,229

(22) Filed: Dec. 5, 2000

(65) Prior Publication Data

US 2001/0001142 A1 May 10, 2001

Related U.S. Application Data

(62) Division of application No. 09/051,137, filed as application No. PCT/JP97/02703 on Aug. 4, 1997, now Pat. No. 6,226, 604.

(30) Foreign Application Priority Data

Aug. 2, 1996 (JP) ..... 8-204439
Feb. 20, 1997 (JP) ..... 9-36726

(51) Int. Cl.[7] ..... G10L 19/04
(52) U.S. Cl. ..... 704/207; 704/220; 704/221
(58) Field of Search ..... 704/207, 221, 704/222, 223, 225, 219, 220, 230

(56) References Cited

U.S. PATENT DOCUMENTS 4,821,324 A * 4/1989 Ozawa et al. ..... 704/216
4,924,517 A * 5/1990 Wake ..... 704/218
4,975,958 A * 12/1990 Hanada et al. ..... 704/223
5,097,508 A 3/1992 Valenzuela Steude et al.
5,127,053 A 6/1992 Koch
5,142,584 A * 8/1992 Ozawa ..... 704/223
5,208,862 A * 5/1993 Ozawa ..... 704/216
5,261,027 A 11/1993 Taniguchi et al.
5,295,224 A * 3/1994 Makamura et al. ..... 704/223
5,651,092 A 7/1997 Ishii et al.
5,664,055 A * 9/1997 Kroon ..... 704/208
5,699,485 A * 12/1997 Shoham ..... 704/223
5,774,840 A * 6/1998 Taumi et al. ..... 704/223
5,819,213 A 10/1998 Oshikiri et al.
5,864,797 A 1/1999 Fujimoto
5,875,423 A 2/1999 Matsuoka
5,884,253 A * 3/1999 Kleijn ..... 704/223
5,974,377 A 10/1999 Navarro et al.
6,003,001 A 12/1999 Maeda
RE36,721 E * 5/2000 Akamine et al. ..... 704/220

FOREIGN PATENT DOCUMENTS

| | | |
|---|---|---|
| JP | 4-75100 | 3/1992 |
| JP | 5-19795 | 1/1993 |
| JP | 5-113800 | 5/1993 |
| JP | 7-92999 | 4/1995 |
| JP | 8-185198 | 7/1996 |
| JP | 2-232700 | 12/1996 |

* cited by examiner

*Primary Examiner*—Richemond Dorvil
*Assistant Examiner*—Martin Lerner
(74) *Attorney, Agent, or Firm*—McDermott, Will & Emery

(57) ABSTRACT

A CELP type voice encoding device and a CELP type encoding device. Both the CELP type encoding device and the CELP type encoding device have a noise code book that can be searched in two modes in accordance with linear predictive analysis results, a pitch gain and a pitch cycle, all of which are obtained as analysis results of an input voice. Also the number of pulses forming a noise code vector is switched between a first case where a variation in pitch cycle is small througtout continuous sub-frames and in a second case where the variation is not small througtout continuous sub-frames.

8 Claims, 34 Drawing Sheets

FIG. 16 (a)

PULSE NUMBER

| | PULSE POSITION 1 | PULSE POSITION 2 | PULSE POSITION 3 | PULSE POSITION 4 |
|---|---|---|---|---|
| 0(2 BITS) | 0,20,40,60 | 1,21,41,61 | 2,22,42,62 | 3,23,43,63 |
| 1(2 BITS) | 3,23,43,63 | 4,24,44,64 | 5,25,45,65 | 6,26,46,66 |
| 2(3 BITS) | 6,26,46,66,<br>9,29,49,69 | 7,27,47,67,<br>10,30,50,70 | 8,28,48,68,<br>11,31,51,71 | 9,29,49,69,<br>12,32,52,72 |
| 3(3 BITS) | 12,32,52,72,<br>16,36,56,76 | 13,33,53,73,<br>17,37,57,77 | 14,34,54,74,<br>18,38,58,78 | 15,35,55,75,<br>19,39,59,79 |

TOTAL 10BITS+2BITS(TYPES OF PULSE POSITIONS[4TYPES]=12BITS

FIG. 16 (b)

| PULSE NUMBER | PULSE POSITION |
|---|---|
| 0(3 BITS) | 0,10,20,30,40,50,60,70 |
| 1(3 BITS) | 2,12,22,32,42,52,62,72 |
| 2(3 BITS) | 5,15,25,35,45,55,65,75 |
| 3(3 BITS) | 7,17,27,37,47,57,67,77 |

TOTAL 12BITS

VOICE ENCODING DEVICE, VOICE DECODING DEVICE, RECORDING MEDIUM FOR RECORDING PROGRAM FOR REALIZING VOICE ENCODING/DECODING AND MOBILE COMMUNICATION DEVICE

This application is a Divisional of application Ser. No. 09/051,137 filed Apr. 1, 1998 now U.S. Pat. No. 6,226,604, issued May 1, 2001 which is a 371 of International Application Serial No. PCT/JP97/02703 filed Aug. 4, 1997.

TECHNICAL FIELD

The present invention relates to a CELP (Code Excited Linear Prediction) type voice encoding device and a CELP type voice decoding device in a mobile communication system and the like which encodes and transmits a voice signal, and a mobile communication device.

BACKGROUND ART

The CELP type voice encoding device divides a voice into certain frame lengths, linearly predicts the voice in each frame and encodes a prediction residue (activating signal) resulting from the linear prediction for each frame by using an adaptive code vector and a noise code vector constituted of known waveforms. For the adaptive code vector and the noise code vector, as shown in FIG. 34, the adaptive code vector and the noise code vector which are stored in an adaptive code book 1 and a noise code book 2, respectively, are used as they are in some case. As shown in FIG. 35, in another case used are the adaptive code vector from the adaptive code book 1 and the noise code vector from the noise code book 2 which is synchronized with a pitch cycle L of the adaptive code book 1. FIG. 35 shows a constitution of a noise sound source vector generating portion in the CELP type voice encoding device which is disclosed in publications of Patent Application Laid-open No. Hei 5-19795 and Hei 5-19796. In FIG. 35, the adaptive code vector is selected from the adaptive code book 1, while the pitch cycle L is emitted. The noise code vector selected from the noise code book 2 is made periodic by a periodic unit 3 using the pitch cycle L. To make periodic the noise code vector, the vector is cut by the pitch cycle from its top and repeatedly connected plural times until a sub-frame length is reached.

However, in the aforementioned conventional CELP type voice encoding device in which the noise code vector is pitch-cycled, after an adaptive code vector component is removed, a residual pitch cycle component is removed by making periodic the noise code vector in the pitch cycle. Therefore, phase information which exists in one pitch waveform, that is, the information representing where a pitch pulse peak exists is not positively used. Therefore, enhancement of voice quality has been restricted.

The present invention has been developed to solve the conventional problem, and an object thereof is to provide a voice encoding device which can further enhance a voice quality.

DISCLOSURE OF THE INVENTION

To attain the aforementioned object, in the invention, by emphasizing an amplitude of a noise code vector which corresponds to a pitch peak position of an adaptive code vector, phase information existing in one pitch waveform is used to enhance a sound quality.

Also in the invention, by using the noise code vector which is restricted only in the vicinity of the pitch peak of the adaptive code vector, even when a small number of bits are allocated to the noise code vector, a deterioration in sound quality is minimized.

Further in the invention, by using the pitch peak position and a pitch cycle of the adaptive code vector to restrict a pulse position search range, even when there are a small number of bits indicative of pulse positions, the search range is narrowed while minimizing the deterioration in sound quality.

Also in the invention, when the pitch peak position and pitch cycle of the adaptive code vector are used to restrict the pulse position search range, especially by finely setting a pulse position searching precision in one or two pitch waveform, sound quality is enhanced in a voiced portion of a voice with a short pitch cycle.

Also in the invention, by varying the number of pulse sound source pulses with a pitch cycle value, sound quality is enhanced.

Also in the invention, by determining a pulse amplitude in the vicinity of the pitch peak position of the adaptive code vector and the other portions before searching the pulse sound source, sound quality is enhanced.

Also in the invention, since a pitch gain is quantized in multiple stages and a first stage of information quantization is performed immediately after an adaptive code book is searched, the first-stage quantized information of the pitch gain can be used as mode information for switching a noise code book. Encoding efficiency is thus enhanced.

Also in the invention, by using quantized pitch cycle information or quantized pitch gain information in the immediately previous sub-frame or the present sub-frame, a control is performed to switch search positions of the pulse sound source. Therefore, voice quality is enhanced.

Also in the invention, a phase continuity between sub-frames is determined backward. Only to the sub-frame whose phase is determined to be continuous, a phase adaptation process is applied. Thereby, without increasing the quantity of information to be transmitted, the phase adaptation process is switched. Thus, voice quality is enhanced. Additionally, when the phase adaptation process is not performed, by using a fixed code book, an error in transmission line can be effectively prevented from being propagated.

Also in the invention, it is determined by a degree of centralization of signal power to the vicinity of the pitch peak position in the adaptive code vector whether or not the phase adaptation process is to be applied. Thereby, without increasing the quantity of information to be transmitted, the phase adaptation process is switched. Voice quality is thus enhanced. Additionally, when the phase adaptation process is not performed, by using the fixed code book, a transmission line error can be effectively prevented from being propagated.

Also according to the invention, in the CELP type voice encoding device in which sound source pulses are searched in positions relative to the pitch peak position, the pulse positions are indexed in order from the top of the sub-frame. Thereby, the influence of the transmission line error which occurs in some frame is prevented from being propagated to subsequent frames which have no transmission line error.

Also according to the invention, in the CELP type voice encoding device in which sound source pulses are searched in the positions relative to the pitch peak position, the pulse positions are indexed in order from the top of the sub-frame. Additionally, different pulses having the same index are numbered in order from the top of the sub-frame. Thereby, the influence of the transmission line error which occurs in some frame is prevented from being propagated to the subsequent frames which have no transmission line error.

Also according to the invention, in the CELP type voice encoding device in which sound source pulses are searched in the positions relative to the pitch peak position, all the pulse search positions are not represented by the relative positions. Only a part of the vicinity of the pitch peak is represented by the relative positions, while the remaining part is set in predetermined fixed positions. Thereby, the influence of the transmission line error which occurs in some frame is prevented from being propagated to the subsequent frames which have no transmission line error.

Also in the invention, when the pitch peak position is obtained, instead of searching all object signals for the pitch peak position, there is provided a means for searching signals in the cut pitch cycle length for the pitch peak position. Thereby, the top pitch peak position can be extracted more precisely.

Also according to the invention, in a portion in which the pitch cycle is continuous between the sub-frames, that is, a portion which is supposed to be a voiced stationary portion, the pitch peak position in the immediately previous sub-frame, the pitch cycle in the immediately previous sub-frame and the pitch cycle in the present sub-frame are used to predict the pitch peak position in the present sub-frame. Based on the predicted pitch peak position, an existence range of the pitch peak position in the present sub-frame is restricted. Thereby, the pitch peak position can be extracted in such a manner that the phase in the voiced stationary portion is prevented from being discontinuous.

Also according to the invention, a sub-frame length is about 10 ms or more, a relatively small quantity, i.e., about 15 bits per sub-frame of information is allocated to noise code book information and the pulse sound source is applied as the noise code book. In this case, there are provided at least one mode, respectively (two or more modes in total), of a mode in which the number of pulses is reduced to make sufficient each pulse position information and a mode in which each pulse position information is made coarse but the number of pulses is increased. In the constitution, the quality of a voiced rising portion of a voice signal is enhanced. Also, by increasing the number of pulses, voice quality is inhibited from being deteriorated because each pulse position information becomes coarse.

The invention provides a CELP type voice encoding device which is provided with a sound source generating portion for emphasizing an amplitude of a noise code vector corresponding to a pitch peak position of an adaptive code vector. By using phase information existing in one pitch waveform, sound quality can be enhanced.

The invention also provides that, the voice generating portion, by multiplying an amplitude emphasizing window synchronized with a pitch cycle of the adaptive code vector by the noise code vector, the amplitude of the noise code vector corresponding to the pitch peak position of the adaptive code vector is emphasized. By emphasizing the amplitude of a noise sound source vector in synchronization with the pitch cycle, sound quality can be enhanced.

The invention is also such that in the voice generating portion, a triangular window centering on the pitch peak position of the adaptive code vector is used as the amplitude emphasizing widow. An amplitude emphasizing window length can be easily controlled.

The invention further provides a CELP type voice encoding device which is provided with a sound source generating portion using a noise code vector which is restricted only to the vicinity of a pitch peak of an adaptive code vector. In the voice encoding device, by using the noise code vector which is restricted only to the vicinity of the pitch peak of the adaptive code vector, even when a small number of bits are allocated to the noise code vector, a deterioration in sound quality can be minimized. In a voiced portion in which a residual power is concentrated in the vicinity of the pitch pulse, sound quality can be enhanced.

The invention additionally provides a CELP type voice encoding device which uses a pulse sound source as a noise code book and which is provided with a sound source generating portion for determining a pulse position search range by a pitch cycle and a pitch peak position of an adaptive code vector. Even when a small number of bits are allocated to the pulse position, a deterioration in sound quality can be minimized.

The invention is also such that the sound source generating portion determines the pulse position search range in such a manner that the vicinity of the pitch peak position of the adaptive code vector becomes dense while the other portions become coarse. Since a portion which has a high probability of raising pulses is finely searched, voice enhancement can be intended.

The invention also provides a voice encoding device in which the pulse position search range is switched in accordance with the pitch cycle. Since based on the pitch cycle the pulse position search range is expanded/contracted, in the case of a short pitch cycle, one or two pitch waveform can be represented more finely. Voice quality can be enhanced.

The invention is further arranged so that, when plural pitch peaks exist in the adaptive code vector, the pulse position search range is restricted in such a manner that at least two pitch peak positions are included in the search range. An influence extended when a detected top pitch peak position is wrong can be reduced. Also, changes in configurations of waveforms in the vicinity of the top pitch peak and in the vicinity of the second pitch peak can be handled. Therefore, voice quality can be enhanced.

The invention also provides a CELP type voice encoding device which is provided with a sound source generating portion for switching a noise code book in accordance with voice analysis results. In the voice encoding device, the noise code book can be switched in accordance with features of input voice. Therefore, voice quality can be enhanced.

The invention provides a CELP type voice encoding device which is provided with a sound source generating portion for switching a noise code book by using a transmission parameter which is extracted before the noise code book is searched. In the voice encoding device, the noise code book is changed by using information which has been already determined to be transmitted. Therefore, without increasing the quantity of information, the noise code book can be switched.

The invention provides the voice encoding device as claimed in either one of claims 5 to 8 which is constituted to switch the number of pulses according to the analysis result of a voice signal. Since the number of pulses is switched in accordance with the features of the input voice, voice quality can be enhanced.

The invention is also constituted to switch the number of pulses by using information which is extracted before the noise code book is searched. Since the number of pulses is switched using the information which has been already determined to be transmitted, without increasing the quantity of transmitted information, the number of pulses can be switched.

The invention is provided with the sound source generating portion for switching the number of pulses in accordance with the pitch cycle. Since the number of pulses is switched using the pitch cycle, without increasing the transmitted information, the number of pulses can be switched. Also, the optimum number of pulses varies with the pitch cycle, voice quality can be enhanced.

The invention is switched in the case where a variation in pitch cycle is small between continuous sub-frames and in the case where the variation is not small. Since the number of pulses for use is switched in a rising portion and a stationary portion of a voice signal voiced portion, voice quality can be enhanced.

The invention a noise code vector generating portion using a pulse sound source as a noise sound source determines a pulse amplitude before searching a pulse position. Since the pulse sound source is allowed to have a variation in amplitude, voice quality can be enhanced. Also, since the amplitude is determined before the pulse is searched, the optimum pulse position can be determined for the amplitude.

The invention is additionally configurable so that, in the noise code vector generating portion which uses the pulse sound source as the noise sound source, the pulse amplitude is changed in the vicinity of the pitch peak of the adaptive code vector and in the other portions. Since the amplitude is changed in the vicinity of the pitch peak of a sound source signal and the other portions, the pitch structure configuration of the sound source signal can be efficiently represented. The enhancement of voice quality and the efficient quantization of pulse amplitude information can be intended.

The invention provides by statistics or learning, the number of pulses in the pulse sound source for use is determined based on the pitch cycle. Since the optimum number of pulses for each pitch cycle is determined statistically or in other learning methods, voice quality can be enhanced.

The invention provides a CELP type voice encoding device which is provided with a sound source generating portion for quantizing a pitch gain in multiple stages. In the first stage a value which is obtained immediately after an adaptive code book is searched is used as a quantized target, while in the second and subsequent stages a difference between the pitch gain which is determined through a closed loop searching after a sound source searching is completed and a value which is quantized in the first stage is used as the quantized target. In the voice encoding device, the sum of the adaptive code book and a fixed code book (noise code book) forms an operation sound source vector. In the CELP type voice encoding device, information which is obtained before the fixed code book (noise code book) is searched is quantized and transmitted. Therefore, without applying independent mode information, the switching of the fixed code book (noise code book) and the like can be performed. Voice information can be efficiently encoded.

The invention provides a voice encoding device which is constituted to switch the fixed code book by using the quantized value of the pitch gain which is obtained immediately after the adaptive code book is searched. The pitch gain which is obtained before the fixed code book is searched does not differ in value largely from the pitch gain which is obtained after the fixed code book is searched. By using this feature, without applying mode information the mode of the fixed code book can be switched. Voice quality can be enhanced.

The invention provides a voice encoding device which switches the fixed code book based on a change in pitch cycle between sub-frames. By using the continuity of the pitch cycle between the sub-frames and the like, it is determined whether or not a voiced/voiced stationary portion exists. By switching a sound source which is effective for the voiced/voiced stationary portion and a sound source which is effective for the other portions (unvoiced/rising portion and the like), voice quality can be enhanced.

The invention a voice encoding device which switches the fixed code book by using the pitch gain which is quantized in the immediately previous sub-frame. By using the continuity of the pitch gain between the sub-frames and the like, it is determined whether or not the voiced/voiced stationary portion exists. By switching the sound source which is effective for the voiced/voiced stationary portion and the sound source which is effective for the other portions (unvoiced/rising portion and the like), voice quality can be enhanced.

The invention provides a voice encoding device which switches the fixed code book based on the change in pitch cycle between the sub-frames and the quantized pitch gain. By using the pitch cycle and the pitch gain information as transmission parameters, it is determined whether or not the voiced/voiced stationary portion exists. By switching the sound source which is effective for the voiced/voiced stationary portion and the sound source which is effective for the other portions (unvoiced/rising portion and the like), voice quality can be enhanced.

The invention provides a voice encoding device which uses a pulse sound source code book as the fixed code book. Since the pulse sound source is used for the noise code book, the quantity of memory required for the noise code book and the quantity of arithmetic operation at the time of searching the noise code book can be reduced. Further, a representation property of rising in the voiced portion can be enhanced.

The invention provides a CELP type voice encoding device which performs a voice encoding process for each sub-frame having a predetermined time length. It is determined whether or not a phase in the present sub-frame and a phase in the immediately previous sub-frame are continuous. A sound source is switched in the case where it is determined that they are continuous and in the case where it is determined that they are not continuous. In the voice encoding device, a sound source constitution can be realized in which the voiced (stationary) portion and the other portions are cut and separated. Sound quality can be enhanced.

The invention provides a CELP type voice encoding device wherein a pitch peak position in the immediately previous sub-frame, a pitch cycle in the immediately previous sub-frame and a pitch cycle of the present sub-frame are used to predict a pitch peak position in the present sub-frame. By determining whether or not the pitch peak position in the present sub-frame obtained through the prediction is close to the pitch peak position which is obtained only from data in the present sub-frame, it is determined whether or not the phase in the immediately previous sub-frame and the phase in the present sub-frame are continuous. According to a determination result, a method of sound source encoding process is switched. Since the determination result is obtained by using the information which has been already transmitted or which is to be transmitted, the determination result does not need to be transmitted by using new transmission information.

The invention provides a voice encoding device which performs a phase adaptation process for the noise code book when it is determined that the phase in the immediately previous sub-frame and the phase in the present sub-frame are continuous and which does not perform the phase adaptation process for the noise code book when it is determined that the phase in the immediately previous sub-frame and the phase in the present sub-frame are not continuous. The phase adaptation process can be effectively performed. Also, since the continuity of the phase between the sub-frames is determined backward, switching information as to whether or not to apply the phase adaptation process does not need to be transmitted newly. Further, when the phase adaptation process is not applied, by using the fixed code book, the influence of a transmission line error can be effectively inhibited from being propagated.

The invention provides a CELP type voice encoding device which performs a voice encoding process for each sub-frame having a predetermined time length. On the basis of a concentration degree of signal power in the vicinity of a pitch peak position of an adaptive code vector in the present sub-frame, an encoding process method of a sound source signal is switched. In the voice encoding device, without requiring new transmission information for switching a sound source constitution (encoding process method of the sound source signal), the sound source constitution can be adapted and switched.

The invention provides a voice encoding device which performs a phase adaptation process for a noise code book when the percentage in the entire signal of one pitch cycle length of the signal power in the vicinity of the pitch peak of the adaptive code vector in the present sub-frame is equal to or larger than a predetermined value and which does not perform the phase adaptation process for the noise code book when the percentage is less than the predetermined value. In accordance with the pulse intensity of the adaptive code vector, the phase adaptation process can be adapted and controlled (switched). Voice quality can be enhanced. Also, new transmission information is unnecessary for controlling (switching) the phase adaptation process. Further, when the phase adaptation process is not performed, by using the fixed code book, the influence of the transmission line error can be effectively inhibited from being propagated.

The invention provides a voice encoding device wherein as the phase adaptation process, a pulse position searching is performed densely in the pitch peak vicinity and the pulse position search is performed coarsely in the portions other than the pitch peak vicinity. A pulse sound source is applied in a noise sound source. Since the pulse sound source is used as the noise code book, the quantity of memory required for the noise code book and the quantity of arithmetic operation at the time of searching the noise code book can be reduced. Further, the representation property of the rising in the voiced portion can be enhanced.

The invention provides a voice encoding device wherein indexes indicative of pulse positions are arranged in order from the top of the sub-frame. The indexes indicative of the pulse positions are arranged from the top of the sub-frame in such a manner that a pulse with a smaller index number is positioned closer to the top of the sub-frame. Therefore, a deviation of the pulse position which arises when the pitch peak position is wrong can be minimized. The influence of the transmission line error can be prevented from being propagated.

The invention provides a voice encoding device wherein in the case of the same index number, pulses are numbered in order from the top of the sub-frame. Further, each pulse search position is determined in such a manner that the vicinity of the pitch peak position becomes dense and the portions other than the pitch peak vicinity become coarse. In the case of the same index number, each pulse number is determined in such a manner that the pulse with a smaller pulse number is positioned closer to the top of the sub-frame. Therefore, in addition to the pulse indexing, the pulse numbering is defined. The deviation of the pulse position arising when the pitch peak position is wrong can further be reduced. The propagation of the influence of the transmission line error can further be reduced.

The invention provides a voice encoding device wherein a part of pulse search positions is determined by the pitch peak position, while other pulse search positions are predetermined fixed positions irrespective of the pitch peak position. Even when the pitch peak position is wrong, a probability that a sound source pulse position is wrong is reduced. Therefore, the influence of the transmission line error can be inhibited from being propagated.

The invention provides a voice encoding device which has a pitch peak position calculation means which, when obtaining the pitch peak position of a voice having a predetermined time length or the sound source signal, cuts out only a pitch cycle length from the relevant signal and determines the pitch peak position in the cut-out signal. To select the pitch peak from one pitch waveform, a point at which an amplitude value (absolute value) becomes maximum may be simply searched. Even when the sub-frame includes a waveform exceeding one pitch cycle, the pitch peak position can be obtained precisely.

The invention provides a voice encoding device which, when cutting out only the pitch cycle length from the relevant signal, first uses the entire relevant signal without cutting out one cycle length to determine the pitch peak position, uses the determined pitch peak position as a cutting-out start point to cut out one pitch cycle length and determines the pitch peak position in the cut-out signal. When the pitch peak position is determined by using the entire relevant signal, a resulting phenomenon in which a second peak in one pitch waveform is determined as the pitch peak position can be avoided. Specifically, an error in extraction of the pitch peak position which arises when the pitch cycle is not synchronized with the sub-frame length can be avoided.

The invention provides the CELP type voice encoding device which performs a voice encoding process for each sub-frame having a predetermined time length. When the pitch peak position in the present sub-frame is calculated and a difference between the pitch cycle in the immediately previous sub-frame and the pitch cycle in the present sub-frame is in a predetermined range, then the pitch peak position in the immediately previous sub-frame, the pitch cycle in the immediately previous sub-frame and the pitch cycle in the present sub-frame are used to predict the pitch peak position in the present sub-frame. By using the pitch peak position in the present sub-frame which is obtained through the prediction, an existence range of the pitch peak position in the present sub-frame is restricted beforehand, and the pitch peak position is searched in the range. In the voice encoding device above mentioned, by considering the pitch peak position in the immediately previous sub-frame, the pitch peak position in the present sub-frame is determined. If the pitch peak position is obtained only from the present sub-frame, the second peak position in one pitch peak waveform is wrongly detected. In this case, the wrong detection is avoided in the method.

The invention provides a CELP type voice encoding device which performs a voice encoding process for each sub-frame having a predetermined time length. A pulse sound source is used as a noise code book, and there are provided at least two modes of the noise code book. By switching the modes, the number of sound source pulses can be changed. In at least one mode, there are a sufficient quantity of each pulse position information and a small number of pulses. In the other modes, there is a shortage of each pulse position information but a large number of pulses. By transmitting mode switch information, the modes are switched. In the voice encoding device, since there is provided the mode in which there are a sufficient quantity of position information and a small number of sound source pulses, the quality of the voiced rising portion of the voice signal is enhanced. Also, the mode in which there are an insufficient quantity of position information and a large number of sound source pulses can be effectively used.

The invention provides a voice encoding device wherein when the pitch cycle is short, by restricting a sound source pulse search range to a narrow range in accordance with the pitch cycle, the sound source pulse position information is decreased while the number of sound source pulses is increased. For the sound source signal which has a pitch periodicity with a short pitch cycle, while keeping a sufficient quantity of sound source pulse position information per pitch cycle, the number of sound source pulses can be increased. Voice quality can be enhanced.

The invention provides the voice encoding device which determines the pulse position search range in such a manner that in the mode in which there is a shortage of each pulse position information but a large number of pulses, the search positions of sound source pulses become dense in the pitch peak position vicinity while the search positions of sound source pulses become coarse in the other portions. The position information of sound source pulses is concentrated in a portion in which there is a high probability of raising the sound source pulses. Therefore, the mode in which there is an insufficient quantity of sound source pulse position information and a large number of sound source pulses can be used with an enhanced efficiency.

The invention provides a CELP type voice encoding device wherein in the sound source mode in which there are a small number of pulses and a sufficient quantity of position information, a part of the position information is allocated to an index indicative of a noise sound source code vector. Without providing a new mode, an unvoiced consonant portion or a noise input signal can be handled.

The invention provides a recording medium which records a program for executing a function of the voice encoding device and can be read by a computer. Since the recording medium is read by the computer, the function of the voice encoding device can be realized.

The invention provides a recording medium which records a program for executing the voice encoding method and can be read by a computer. Since the recording medium is read by the computer, the function of the voice encoding device can be realized.

The invention provides voice decoding devices which have the sound source generating portions with the substantially same constitutions as mentioned above, each providing the similar effect.

The invention provides a recording medium which records a program for executing the voice decoding device and can be read by a computer. Since the recording medium is read by the computer, the function of the voice encoding device The invention provides a recording medium which records a program for executing the voice decoding method and can be read by a computer. Since the recording medium is read by the computer, the function of the voice encoding device can be realized.

BRIEF DESCRIPTION OF THE DRAWINGS

FIGS. 11(*b*) and 11(*c*) are diagrammatic representations each showing an example of a pulse search position pattern.

FIGS. 16(*a*) and 16(*b*) are tables each showing an example of a fixed search position pattern which is used in the eighth embodiment of the invention.

FIG. 24(*b*) is a diagrammatic representation showing a pulse number and an index which are allocated to each sound source pulse in the case where there is not provided an update means of the pulse number and the index in the thirteenth embodiment of the invention.

FIG. 24(*c*) is a diagrammatic representation showing a pulse number and an index which are allocated to each sound source pulse in the case where there is provided the update means of the pulse number and the index in the thirteenth embodiment of the invention.

FIGS. 26(*b*) and 26(*c*) are diagrammatic representations each showing an example of a search position pattern of a sound source pulse which is generated by a search position calculator for use in the fourteenth embodiment of the invention.

FIGS. 26(*d*) is a diagrammatic representations showing an example of the search position pattern of the sound source pulse for use in a pulse position searcher according to the fourteenth embodiment of the invention.

FIG. 28(*c*) is a diagrammatic representation of an example of an adaptive code vector waveform showing a range of searching a pitch peak position in a pitch peak position corrector.

BEST MODE FOR EMBODYING THE INVENTION

For the best mode for embodying the present invention, some embodiments of sound source generating portion in voice encoding devices will be described hereinafter with reference to FIGS. 1 to 10. As described later, these sound source generating portions are used with the same constitutions in voice decoding devices of the invention.

First Embodiment

Figure 1:
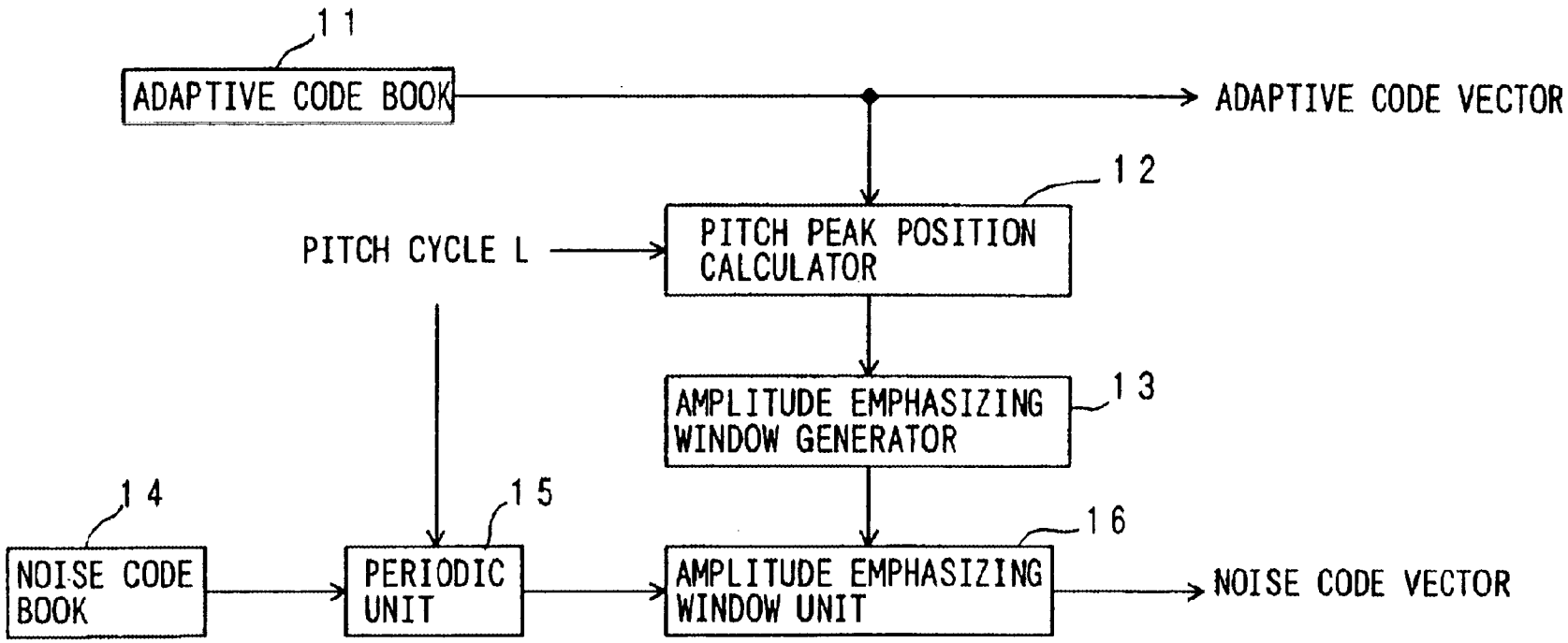
FIG. 1 is a block diagram showing a constitution of a sound source generating portion in a CELP voice encoding device in a first embodiment of the invention.

FIG. 1 shows a first embodiment of the invention, and shows a sound source generating portion in a voice encoding device in which an amplitude of a noise code vector corresponding to a pitch peak position of an adaptive code vector is emphasized. In FIG. 1, numeral 11 denotes an adaptive code book which transmits an adaptive code vector to a pitch peak position detector 12; 12 denotes a pitch peak position calculator which receives the adaptive code vector from the adaptive code book 11 and transmits the pitch peak position to an amplitude emphasizing window generator 13; 13 denotes the amplitude emphasizing window generator which receives the pitch peak position from the pitch peak position calculator 12 and transmits an amplitude emphasizing window to an amplitude emphasizing window unit 16; 14 denotes a noise code book which stores a noise code vector and transmits an output to a periodic unit 15; 15 denotes the periodic unit which receives the noise code vector from the noise code book 14 and a pitch cycle L, pitch-cycles the noise code vector and transmits an output to the amplitude emphasizing window unit 16; and 16 denotes the amplitude emphasizing window unit which receives the amplitude emphasizing window from the amplitude emphasizing window generator 13 and the noise code vector from the periodic unit 15, multiplies the noise code vector by the amplitude emphasizing window and emits the final noise code vector.

Operation of the sound source generating portion of the CELP type voice encoding device constituted as described above will be described with reference to FIG. 1. The pitch peak position calculator 12 uses the received adaptive code vector to determine the pitch peak position which exists in the adaptive code vector. The pitch peak position can be determined by maximizing a normalized correlation of an impulse string arranged by the pitch cycle and the adaptive code vector. Also, it can be determined by minimizing a difference between the impulse string which is arranged in the pitch cycle and passed through a synthesis filter and the adaptive code vector which is passed through the synthesis filter.

The amplitude emphasizing window generator 13 generates the amplitude emphasizing window based on the pitch peak position which is determined by the pitch peak position calculator 12. As the amplitude emphasizing window, various windows can be used, but, for example, a triangular window centering on the pitch peak position is effective in that a window length can be easily controlled.

Figure 2:
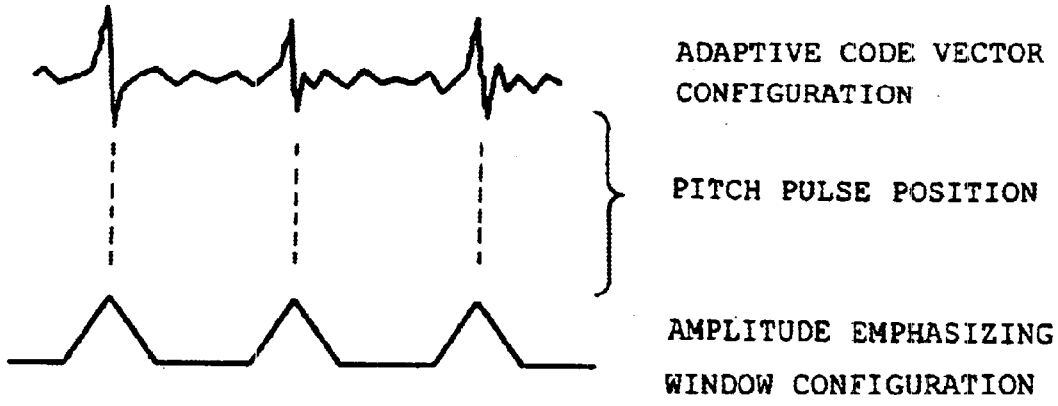
FIG. 2 is a diagrammatic representation showing the relationship of an amplitude emphasizing window configuration, an adaptive code vector and a pitch peak position in the first embodiment of the invention.

FIG. 2 shows a correspondence of a configuration of the amplitude emphasizing window transmitted from the amplitude emphasizing window generator 13 and a configuration of the adaptive code vector. A position shown by a broken line in the figure denotes the pitch peak position which is determined by the pitch peak position calculator 12.

The periodic unit 15 pitch-cycles the noise code vector transmitted from the noise code book 14. The pitch-cycling means that the noise code vector is made periodic by the pitch cycle. The vector stored in the noise code book is cut by the pitch cycle L from the top. This is repeated plural times until a sub-frame length is reached, and vectors are connected. However, the pitch-cycling is performed only when the pitch cycle is equal to or less than the sub-frame length.

The amplitude emphasizing window unit 16 multiplies the noise code vector transmitted from the periodic unit 15 by the amplitude emphasizing window transmitted from the amplitude emphasizing window generator 13.

In this manner, according to the above first embodiment, by using phase information existing in one pitch waveform, sound quality can be enhanced.

Figure 3:
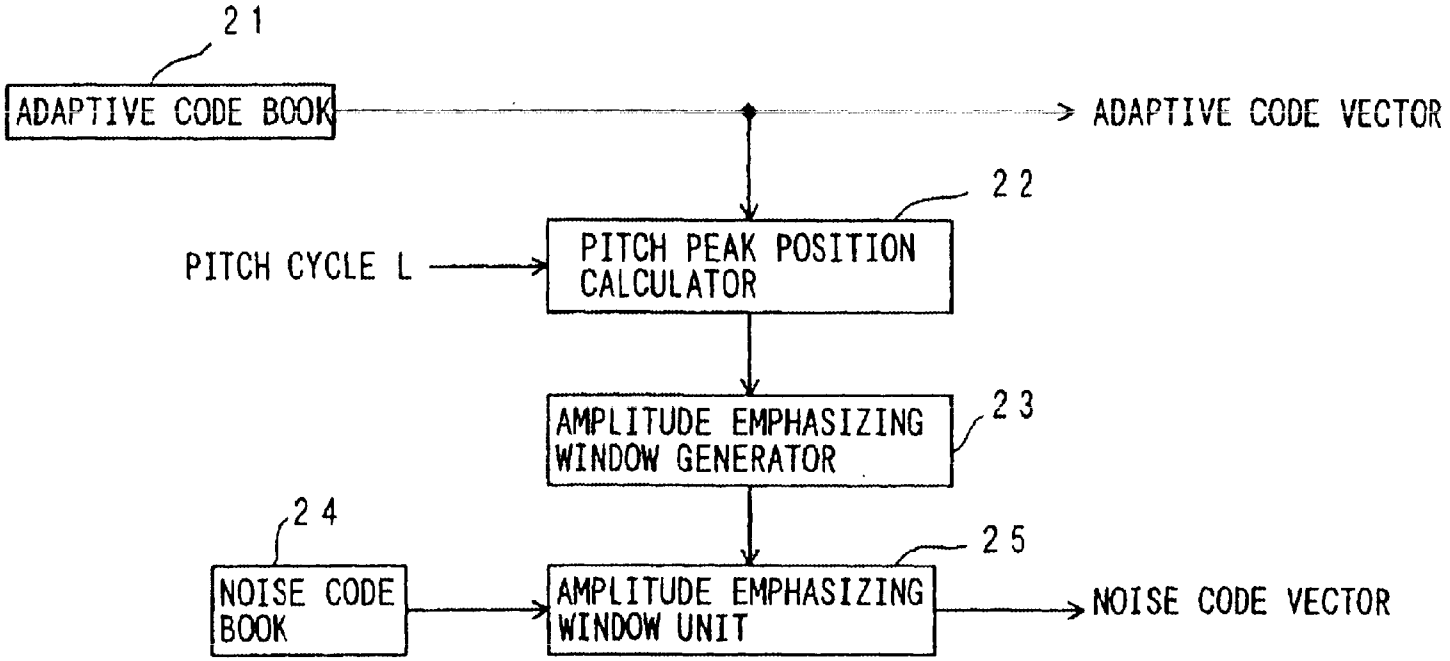
FIG. 3 is a block diagram showing a constitution of a sound source generating portion in a CELP voice encoding device in a modification of the first embodiment of the invention.

Additionally, with reference to FIG. 1, the sound source portion of the CELP type voice encoding device which makes periodic the noise code vector has been described, but the portion can be operated as a sound source portion of a general CELP type voice encoding device in which the noise code vector stored in the noise code book is used as it is, an example of which is shown in FIG. 3. In FIG. 3, numeral 21 denotes an adaptive code book, 22 denotes a pitch peak position calculator, 23 denotes an amplitude emphasizing window generator, 24 denotes a noise code book and 25 denotes an amplitude emphasizing window unit. It is different from the sound source generating portion of FIG. 1 only in that the noise sound source is synchronized in the pitch cycle.

Second Embodiment

Figure 4:
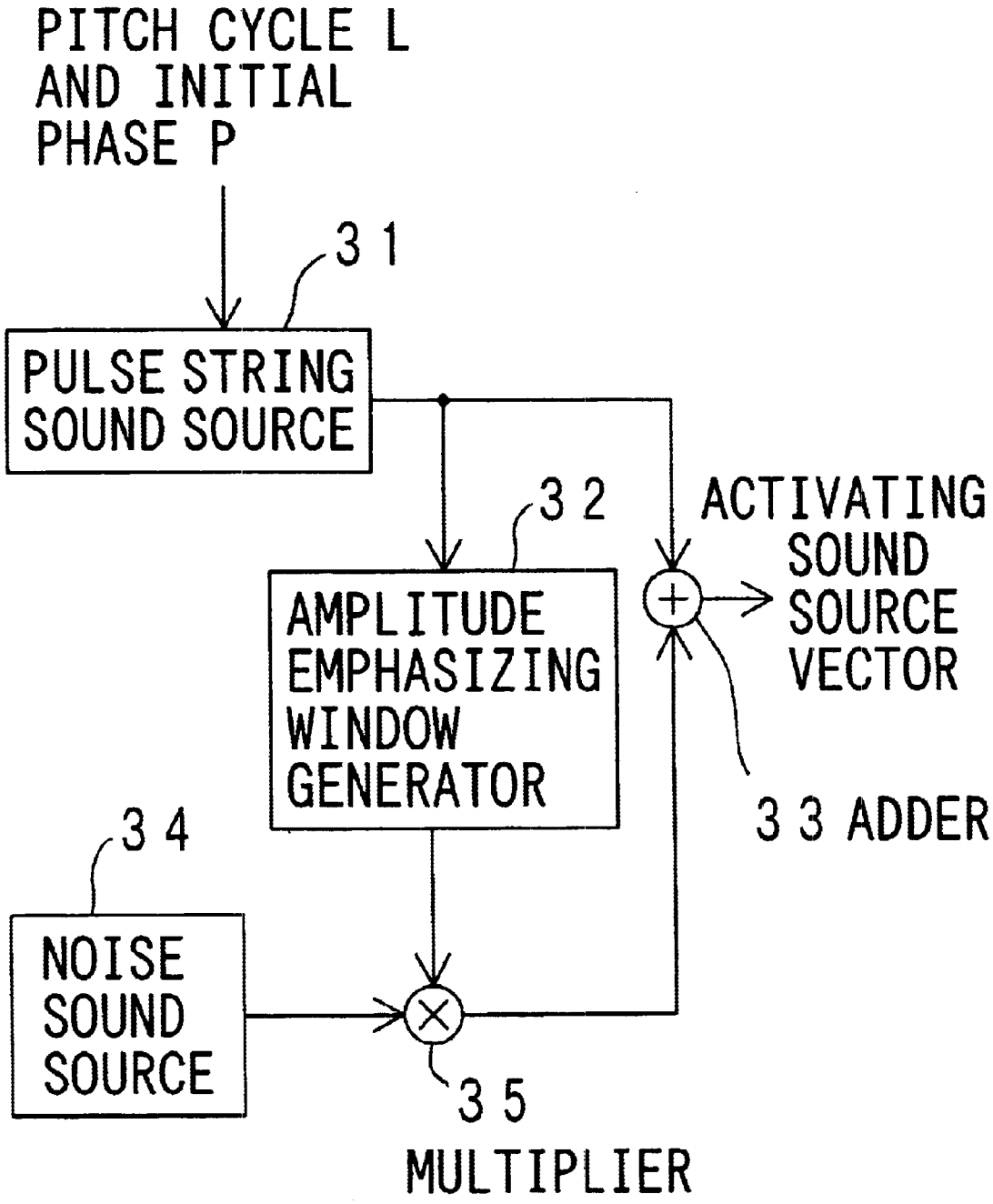
FIG. 4 is a block diagram showing a constitution of a sound source generating portion in a CELP voice encoding device in a second embodiment of the invention.

FIG. 4 shows a second embodiment of the invention, and, for a CELP type voice encoding device having a constitution in which to a rising portion of a voiced portion of a voice signal used is a sound source which is constituted by combining a pulse string sound source and a noise sound source, shows a sound source generating portion of a voice encoding device in which an amplitude of a noise code vector corresponding to a pulse position of a pulse string sound source. In FIG. 4, numeral 31 denotes a pulse string sound source which transmits an output to an amplitude emphasizing window generator 32 and an adder 33 and which is constituted of an impulse string arranged in an interval of the pitch cycle L placed on pitch peak positions; 32 denotes the amplitude emphasizing window generator which generates an amplitude emphasizing window for emphasizing a noise code vector amplitude corresponding to the pulse position of the pulse string and transmits an output to a multiplier 35; 33 denotes the adder which adds the pulse string sound source and the noise code vector transmitted from the multiplier 35 after the amplitude emphasizing windowing and emits an activating vector; 34 denotes a noise sound source which is represented by the noise code vector and transmitted to the multiplier 35; and 35 denotes the multiplier which multiplies the noise sound source vector transmitted from the noise sound source 34 by the amplitude emphasizing window transmitted from the amplitude emphasizing window generator 32.

Operation of the sound source generating portion constituted as aforementioned will be described with reference to FIG. 4. The pulse string sound source 31 is a pulse string in which pulse position and interval are determined by the pitch cycle L and an initial phase P. The pitch cycle L and the initial phase P are separately calculated outside the sound source generating portion. Additionally, in the pulse string sound source, impulses may be arranged, but when an impulse existing between sampling points can be represented, a better performance is obtained. Similarly, when the initial phase (first pulse position) is represented by a fraction precision which can indicate a space between the sampling points, a better performance is obtained. However, when there are not a sufficient number of bits which can be allocated to the information, even an integer precision can provide a good performance. Search for position determination can be facilitated.

The amplitude emphasizing window generator 32 is a window for emphasizing the amplitude of the noise sound source vector in the position which corresponds to the pulse position of the pulse string sound source vector, and is similar to the amplitude emphasizing window which has been described in the first embodiment. The triangular window centering on the pulse position and the like can be used.

The adder 33 adds the pulse string sound source vector 31 and the noise sound source vector 34 multiplied by the amplitude emphasizing window by the multiplier 35 and emits an activating sound source vector.

Further, as not shown in FIG. 4, before transmitted to the adder 33, the pulse string sound source vector and the noise sound source vector are each multiplied by an appropriate gain. In the constitution, the sound source generating portion obtains a higher representation property. In this case, however, gain information needs to be separately transmitted. Also, when the gains of the pulse string sound source vector and the noise sound source vector are fixed, the gains need to be adjusted so that the pulse string sound source vector is prevented from being embedded in the noise sound source vector. For example, the gains are adjusted in such a manner that a power of pulse string sound source vector equals a power of noise sound source vector.

Consequently, according to the above second embodiment, by emphasizing the amplitude of the noise sound source vector in synchronization in the pitch cycle, sound quality can be enhanced.

Third Embodiment

Figure 5:
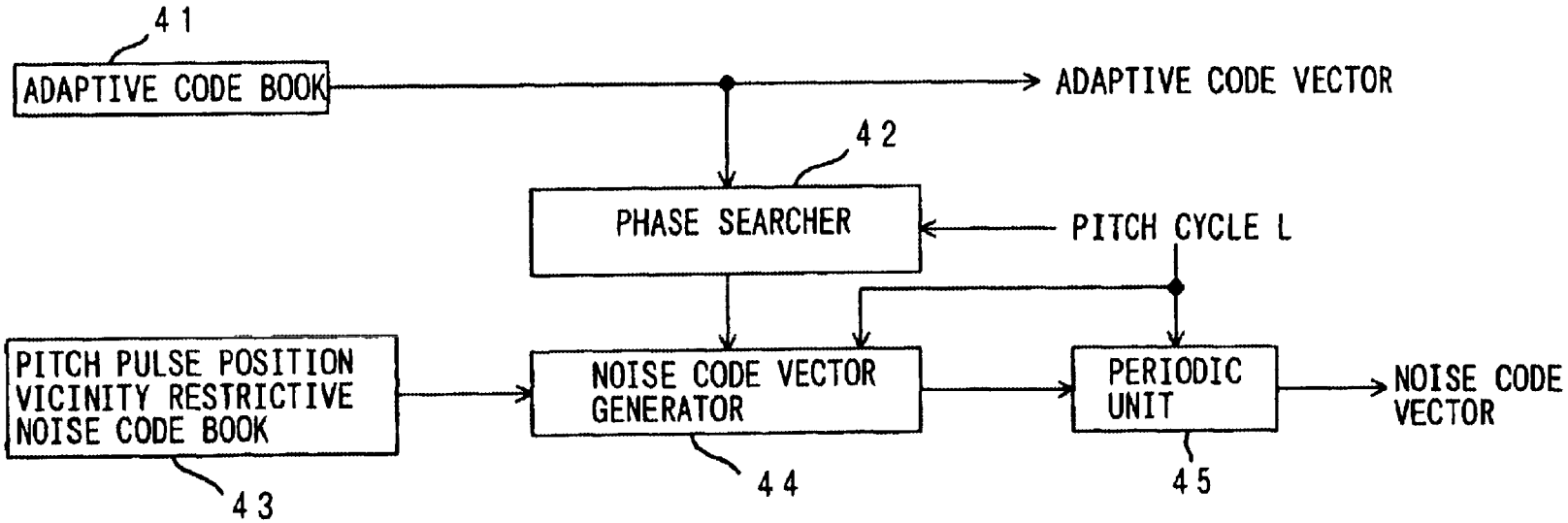
FIG. 5 is a block diagram showing a constitution of a sound source generating portion in a CELP voice encoding device in a third embodiment of the invention.

FIG. 5 shows a third embodiment of the invention, and a CELP type voice encoding device in which a sound source generating portion of the voice encoding device uses a noise code vector restricted only in the vicinity of a pitch peak of an adaptive code vector.

In FIG. 5, numeral 41 denotes an adaptive code book which emits an adaptive code vector; 42 denotes a phase searcher which receives the adaptive code vector transmitted from the adaptive code book 41 and the pitch cycle L and transmits the pitch peak position (phase information) to a noise code vector generator 44; 43 denotes a pitch pulse position vicinity restrictive noise code book which stores a noise code vector with a restricted vector length only in the vicinity of a pitch pulse and transmits the noise code vector in the vicinity of the pitch pulse position to the noise code vector generator 44; 44 denotes the noise code vector generator which receives the noise code vector transmitted from the pitch pulse position vicinity restrictive noise code book 43 and the phase information and the pitch cycle L transmitted from the phase searcher 42 and transmits the noise code vector to a periodic unit 45; and 45 denotes the periodic unit which receives the noise code vector transmitted from the noise code vector generator 44 and the pitch cycle L and emits the final noise code vector.

Operation of the noise source generating portion of the voice encoding device constructed as aforementioned will be described with reference to FIG. 5. The phase searcher 42 uses the adaptive code vector transmitted from the adaptive code book 41 to determine the pitch pulse position (phase) which exists in the adaptive code vector. The pitch pulse position can be determined by maximizing the normalized correlation of the impulse string arranged in the pitch cycle and the adaptive code vector. Also, it can be obtained more precisely by minimizing an error between the impulse string arranged in the pitch cycle which is passed through a synthesis filter and the adaptive code vector which is passed through the synthesis filter.

The pitch pulse position vicinity restrictive noise code book 43 stores the noise code vector to be applied in the vicinity of the pitch peak of the adaptive code vector. The vector length is a fixed length irrespective of the pitch cycle and a frame (sub-frame) length. The range of the pitch peak vicinity may have equal lengths before and after the pitch peak. When the range after the pitch peak is longer than that before the pitch peak, deterioration in sound quality is minimized. For example, when the vicinity range is 5 msec long, it is better to take a length of 0.625 msec before the pitch peak and a length of 4.375 msec after the pitch peak than to take each length of 2.5 msec before and after the pitch peak. Also, in the case where the vector length is about 5 msec when the sub-frame length is 10 msec, substantially the same sound quality can be realized as the case where the vector length is 10 msec or more.

The noise code vector generator 44 arranges the noise code vector transmitted from the pitch pulse position restrictive noise code book 43 in the pitch pulse position determined by the phase searcher 42.

Figure 6:
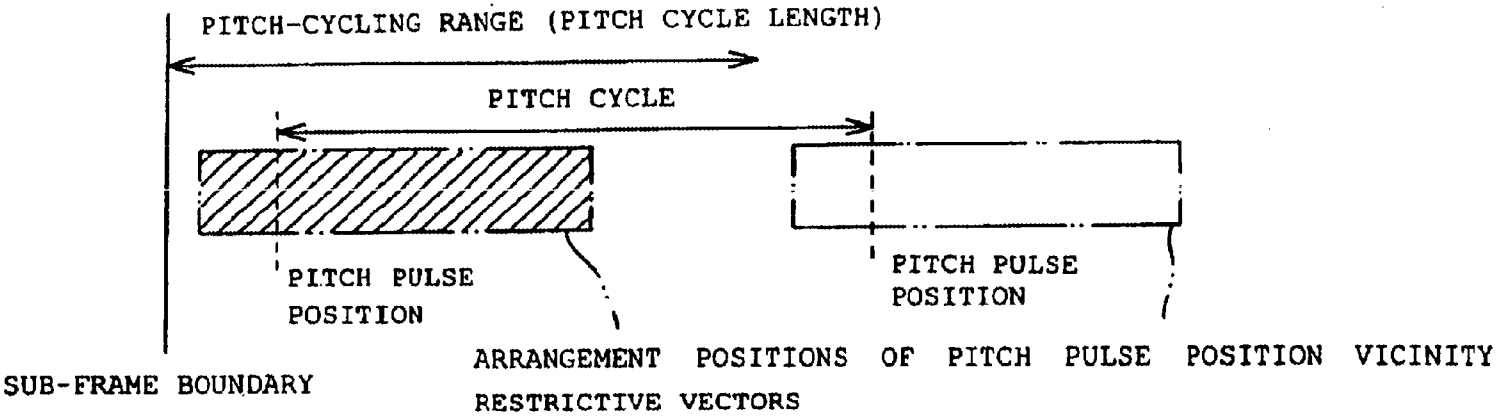
FIGS. 6(*a*) and 6(*b*) are diagrammatic representations showing a former half of arrangement of a pulse position vicinity restricted vector in the third embodiment of the invention.
Figure 6:
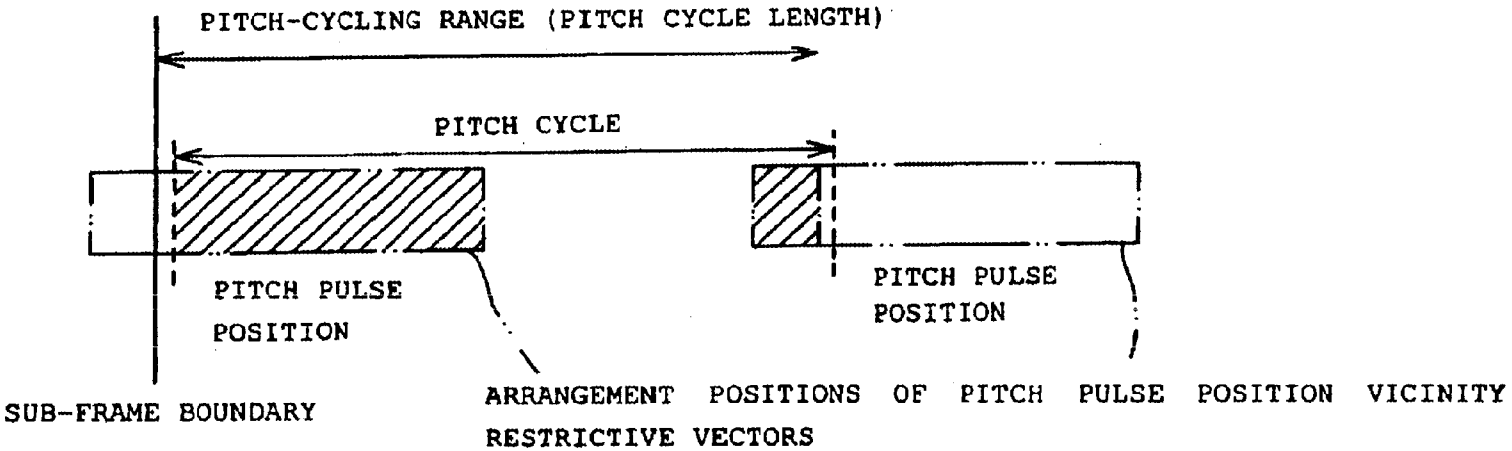
Figure 7:
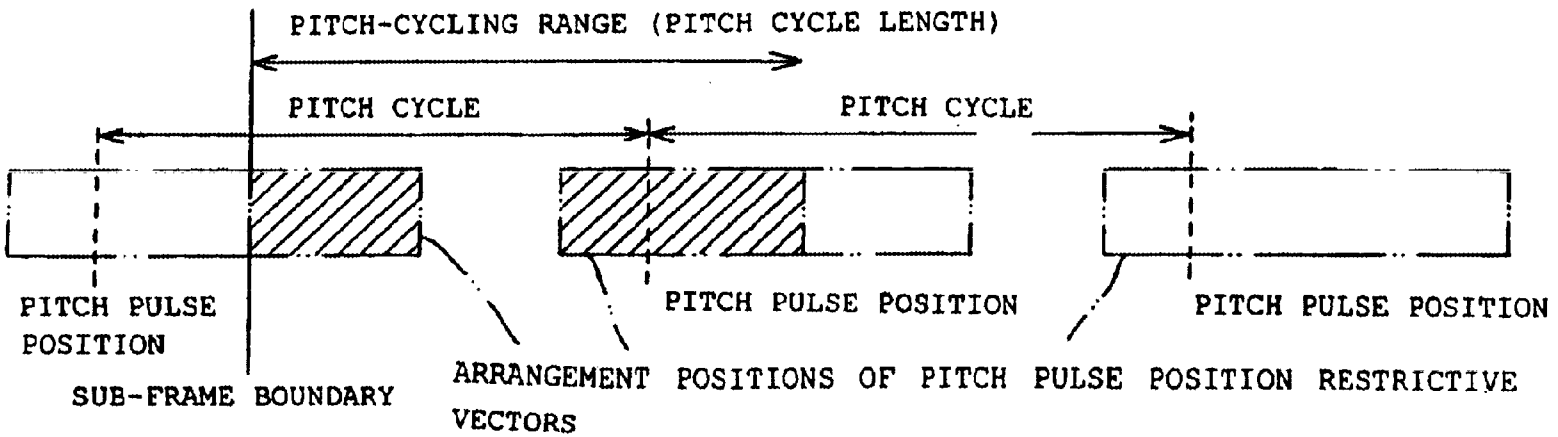
FIGS. 7(*a*) and 7(*b*) are diagrammatic representations showing a latter half of arrangement of a pulse position vicinity restricted vector in the third embodiment of the invention.
Figure 7:
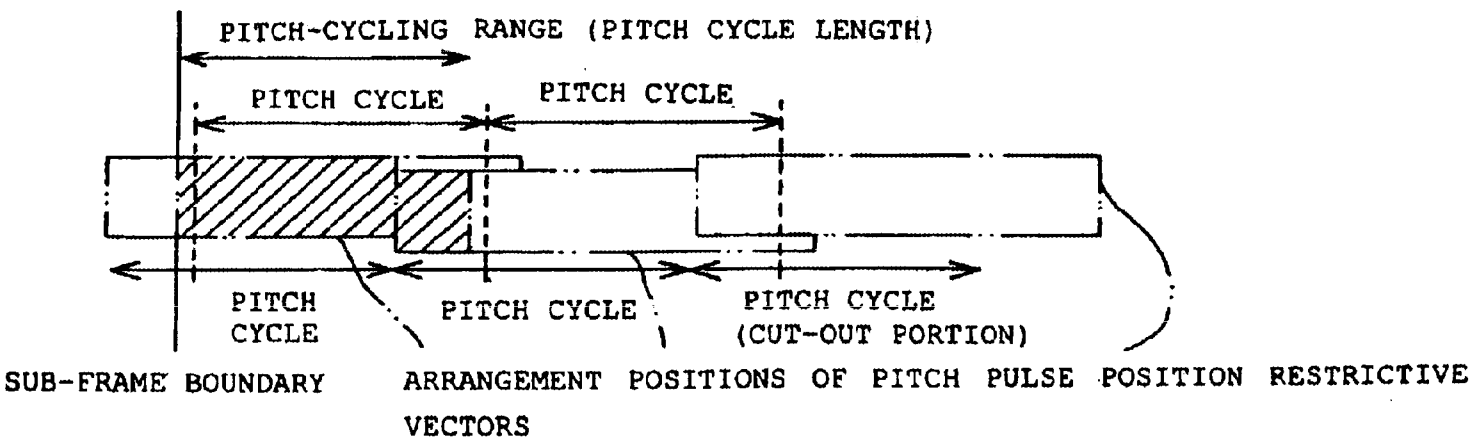

FIGS. 6(*a*), 6(*b*), 7(*a*) and 7(*b*) illustrate a method in which the noise code vectors transmitted from the pitch pulse position restrictive noise code book 43 are arranged in positions corresponding to the pitch pulse positions by the noise code vector generator 44. Basically, as shown in FIG. 6(*a*), the pitch pulse position restrictive noise code vector is disposed in the vicinity of the pitch pulse position. Portions (cross-hatched portions) shown as pitch-cycled ranges in FIGS. 6(*a*) and 6(*b*) are objects to be pitch-cycled in the periodic unit 45. In the case shown in FIG. 6(*a*), the noise code vector generator 44 does not need to perform the pitch-cycling. However, in the case shown in FIG. 6(*b*), since a pitch pulse is positioned near a sub-frame boundary, the former portion of the noise code vector transmitted from the pitch pulse position restrictive noise code book 43 cannot be made periodic in the periodic unit 45 (in the periodic unit 45, the vector cut by the pitch cycle length from the sub-frame boundary is repeatedly arranged in the pitch cycle). Therefore, the noise code vector generator 44 is operated to pitch-cycle the portion beforehand. Also, when the pitch pulse is positioned immediately before the sub-frame boundary and the vector is cut and cycled by the pitch cycle from the top of the sub-frame, then the latter-half portion of the pitch pulse position vicinity restrictive vector is not appropriately pitch-cycled. Therefore, as shown in FIG. 7(*a*), the noise vector generator 44 is operated to perform the pitch-cycling also in a negative direction along a time axis. In this case, however, the cycling is unnecessary when there exists no pitch pulse position in the pitch cycle length from the top of the sub-frame. In this manner, since the pitch-cycling is performed prior to the pitch periodic portion 45, the pitch-cycling effectively using all the pitch position vicinity restrictive vector portions can be performed by the pitch-cycling portion 45. Further, when the pitch cycle is shorter than the vector length which is restricted in the vicinity of the pitch pulse position, the vector having only the pitch cycle length is cut from the restricted vector and pitch-cycled. In this case, there are various ways of cutting out, but the vector is cut out in such a manner that the pitch pulse position is included in the cut-out vector. For example, one pitch cycle of vector is cut out from a point which is positioned in a quarter pitch cycle before the pitch pulse position. Thus, a cut-out starting point is determined by using the pitch pulse position and the pitch cycle.

FIG. 7(*b*) shows an example of the method in which the noise code vector is cut-out when the pitch cycle is shorter than the restrictive vector length. In this case, the pitch cycle length is cut out from the top of the pitch pulse position vicinity restrictive noise code vector. Then, the cut-out starting point does not need to be calculated each time. Specifically, as aforementioned, when one pitch cycle is cut out from the point at the quarter pitch cycle before the pitch pulse position, the pitch cycle is a variable. Therefore, the quarter pitch cycle needs to be calculated each time. However, since the top position of the pitch pulse position vicinity restrictive noise code vector is a fixed value, the calculation is unnecessary. When the vector having only the pitch cycle length is cut out from the top of the pitch pulse position vicinity restrictive noise code vector, a portion corresponding to the pitch pulse position is not included. Then, the cut-out starting point needs to be deviated in such a manner that the portion corresponding to the pitch pulse position is included.

The periodic unit 45 pitch-cycles the noise code vector transmitted from the noise code vector generator 44. During the pitch-cycling, the noise code vector is made periodic by the pitch cycle. The noise code vector only in the pitch cycle L is cut out from the top. This is repeated plural times to connect the vectors until the sub-frame length is reached. However, the pitch-cycling is performed only when the pitch cycle is equal to or less than the sub-frame length. Also, when the pitch cycle has a fractional precision, vectors whose fractional precision point can be calculated by means of interpolation are connected.

As aforementioned, according to the third embodiment described above, by using the noise code vector restricted only in the pitch peak vicinity of the adaptive code vector, even when the number of bits allocated to the noise code vector is small, the deterioration in sound quality can be minimized. In the voiced portion in which residual power is concentrated in the pitch pulse vicinity, sound quality can be enhanced.

Fourth Embodiment

Figure 8:
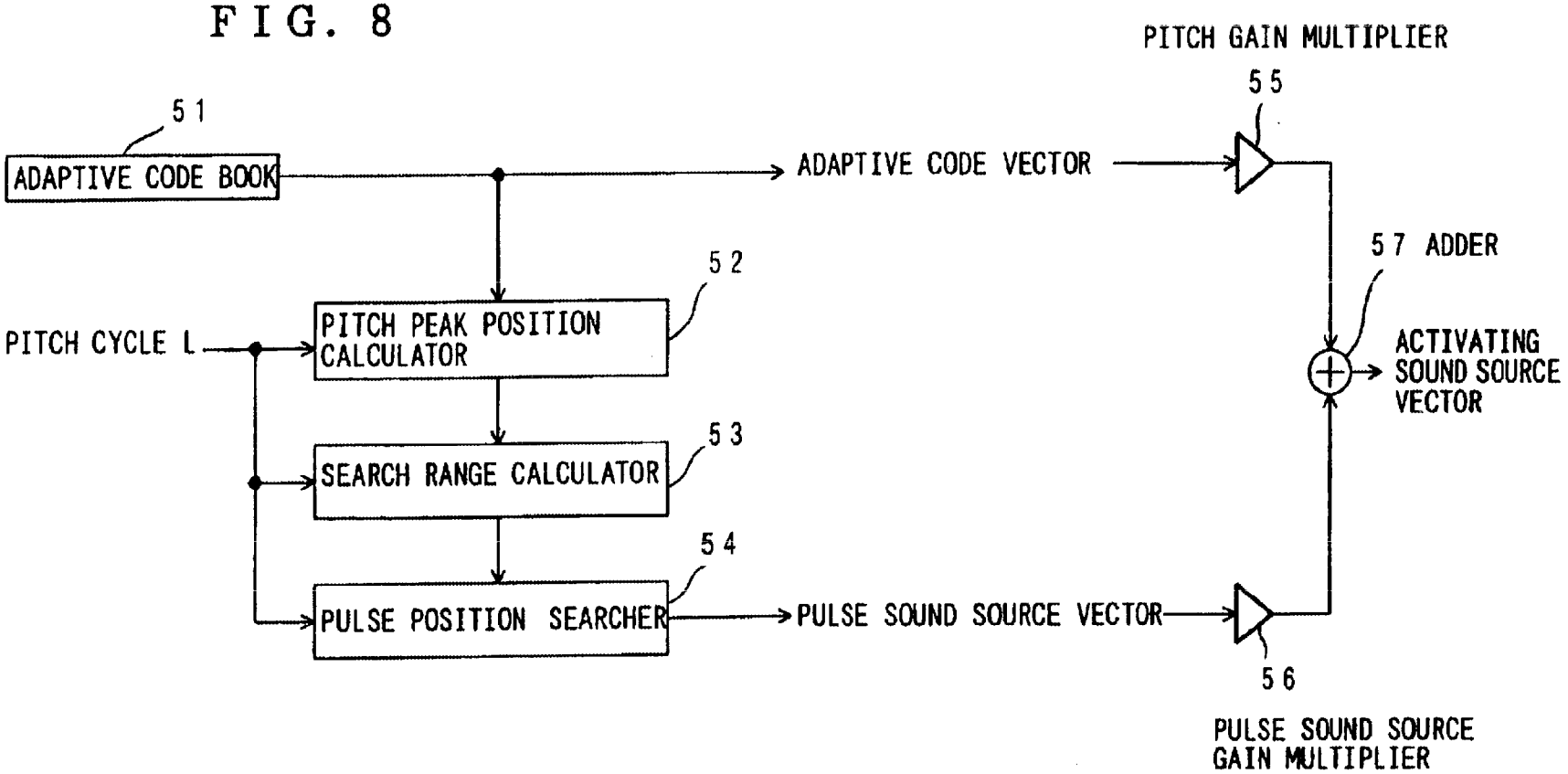
FIG. 8 is a block diagram showing a constitution of a sound source generating portion in a CELP voice encoding device in a fourth embodiment of the invention.

FIG. 8 shows a fourth embodiment of the invention and a sound source generating portion of a voice encoding device which determines a search range of a pulse position by a pitch cycle and a pitch peak position of an adaptive code vector. In FIG. 8, numeral 51 denotes an adaptive code book which stores the past activating sound source vector and transmits an adaptive code vector to a pitch peak position calculator 52 and a pitch gain multiplier 55; 52 denotes the pitch peak position calculator which receives the adaptive code vector transmitted from the adaptive code book 51 and the pitch cycle L, calculates a pitch peak position and transmits an output to a search range calculator 53; 53 denotes the search range calculator which receives the pitch peak position and the pitch cycle L transmitted from the pitch peak position calculator 52, calculates a range in which a pulse sound source is searched and transmits an output to a pulse sound source searcher 54; 54 denotes the pulse sound source searcher which receives the search range transmitted from the search range calculator 53 and the pitch cycle L, searches the pulse sound source and transmits a pulse sound source vector to a pulse sound source gain multiplier 56; 55 denotes the multiplier which multiplies the adaptive code vector transmitted from the adaptive code book by a pitch gain and transmits an output to an adder 57; 56 denotes the multiplier which multiplies the pulse sound source vector transmitted from the pulse sound source searcher by a pulse sound source gain and transmits an output to the adder 57; and 57 denotes the adder which receives an output from the multiplier 55 and an output from the multiplier 56, adds the outputs and emits an activating sound source vector.

Operation of the sound source generating portion constructed as aforementioned will be described with reference to FIG. 8. In FIG. 8, the adaptive code book 51 cuts out the adaptive code vector only by the sub-frame length from the point in which only the pitch cycle L calculated beforehand outside the sound source generating portion is taken back toward the past, and emits the adaptive code vector. When the pitch cycle L does not reach the sub-frame length, the cut-out vector of the pitch cycle L is repeatedly connected until the sub-frame length is reached and transmitted as the adaptive code vector.

The pitch peak position calculator 52 uses the adaptive code vector transmitted from the adaptive code book 51 to determine the pitch pulse position which exists in the adaptive code vector. The pitch peak position is determined by maximizing the normalized correlation of the impulse string arranged in the pitch cycle and the adaptive code vector. Also, it can be obtained more precisely by minimizing an error between the impulse string arranged in the pitch cycle which is passed through the synthesis filter and the adaptive code vector which is passed through the synthesis filter.

Figure 9:
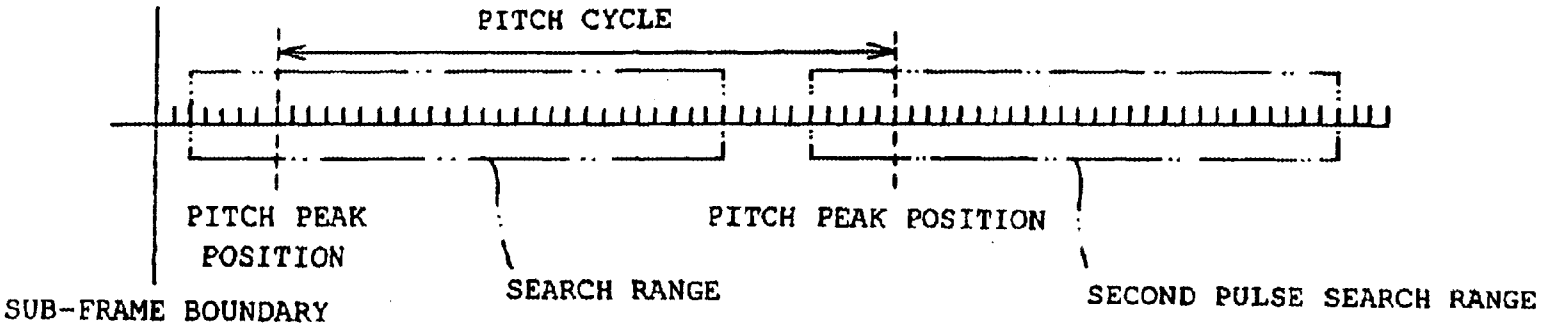
FIGS. 9(*a*) and 9(*b*) are partial diagrammatic representations showing a pulse sound source search range in the fourth embodiment of the invention.
Figure 9:
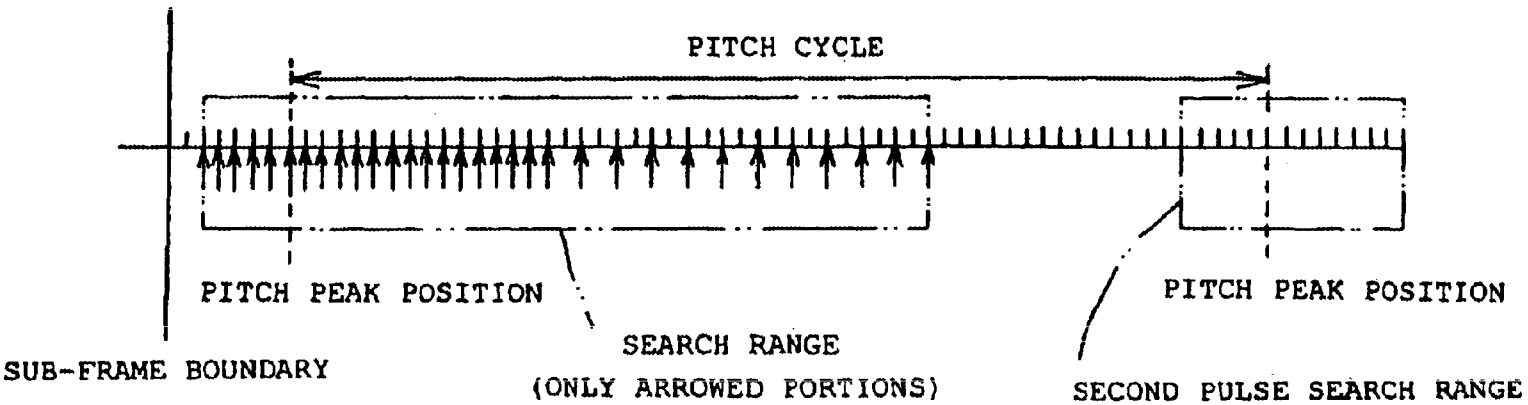
Figure 10:
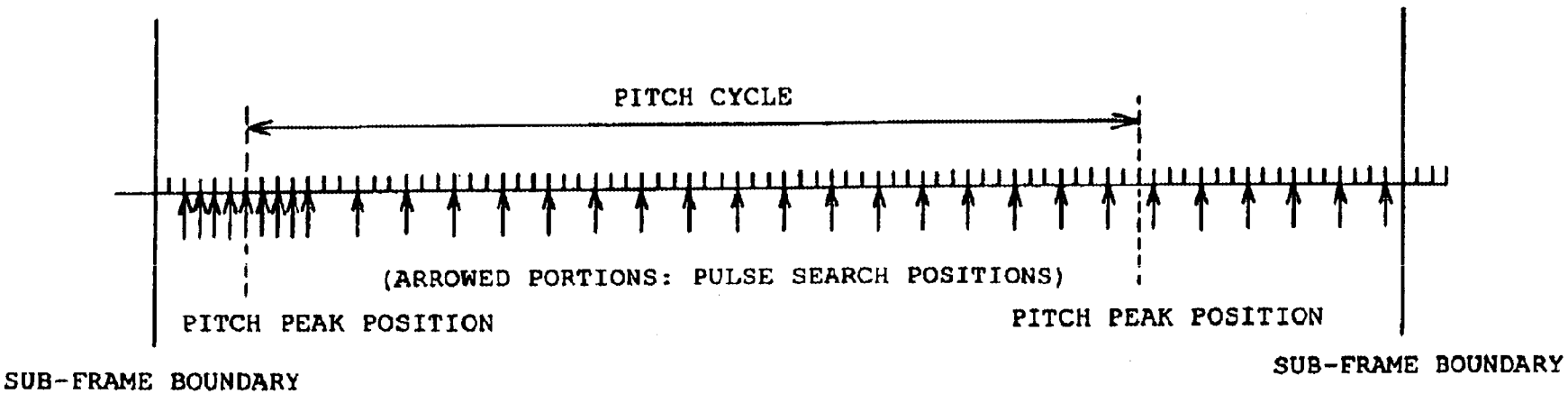
FIG. 10 is the remaining part of the diagrammatic representation showing the pulse sound source search range in the fourth embodiment of the invention.

The search range calculator 53 calculates the range in which the pulse sound source is searched by using the received pitch peak position and pitch cycle L. Specifically, it calculates an auditory important range in one pitch waveform from the position information of pitch peak and determines the range as the search range. The concrete search range determined by the search range calculator 53 is shown in FIGS. 9 and 10. FIG. 9(*a*) shows the case where a range of 32 samples starting from a position five samples before is determined from the pitch peak position as the search range. In the voiced portion, when the impulse string arranged in the pitch cycle is used as the pulse sound source, a pulse can be raised at the same position in the second pulse search range. A sound source can be efficiently represented. FIG. 9(*b*) shows an example of a search range which is determined when the pitch cycle is longer than that of FIG. 9(*a*). When the pitch cycle is long, as shown in FIG. 9(*a*), the pitch peak position vicinity is searched in a concentrated manner. Then, the search range relative to one pitch waveform is narrowed. The frequency band which can be represented is narrowed. For this and other reasons, the representation property of frequency components in a specified band is deteriorated in some case. In this case, as shown in FIG. 9(*b*), instead of enlarging the search range in accordance with the pitch cycle, there is provided a portion in which all the sample points are not searched but every other sample point or every two sample points are searched. Then, without increasing the number of positions to be searched, deterioration in representation property of the frequency components in the specified band can be avoided.

Also, FIG. 10 shows a method in which the pulse position search range is restricted densely in the vicinity of the pitch peak position and coarsely in other portions. The restriction method is based on statistical results that positions which have high probabilities of raising pulses are concentrated in the pitch pulse vicinity. When the pulse position search range is not restricted, in the voiced portion the probability that pulses are raised in the pitch pulse vicinity is higher than the probability that pulses are raised in the other portions. However, the probability that pulses are raised in the other portions is not reduced to a degree which can be ignored. The pulse position search range restriction method shown in FIG. 10 can be said to be an example of the method shown in FIG. 9(*b*) in which the search range is restricted based on a distribution of probabilities of raising pulses. Additionally, in FIG. 9(*a*), if the pitch cycle is short and the first pulse search range overlaps the second pulse search range, then there are provided methods of preventing the second pulse search range from being overlapped: a method of increasing the number of pulses instead of narrowing the first pulse search range; and a method of determining the search range overlapping the second pulse search range (the same as the search range determination method in FIG. 9(*a*)).

The pulse position searcher 54 raises a pulse sound source in the search range (position) determined by the search range calculator 53 and emits a position in which a synthesized voice is closest to an input voice. Especially, in a voiced stationary portion in which the sub-frame length is long sufficient to include plural pitch pulses, impulse string arranged in a pitch-cycle interval is used as the pulse sound source, and a first pulse position in the impulse string is determined from the search range. There are various ways of raising pulses. The predetermined number of pulses, e.g., four pulses are raised in the search range, e.g., any of 32 places. In this case, there are a method of searching all the combinations (8×8×8×8 ways) in such a manner that the 32 places are divided into four and one place is determined from the eight places in which one pulse is allocated, a method of searching all the combinations to select four places from the 32 places and other methods. Additionally, beside the combination of impulses with an amplitude 1, a combination of plural pulses, e.g., two or a pair of pulses, a combination of impulses with different amplitudes or another combination of pulses can be raised.

Gains which are multiplied in the multipliers 55 and 56 are values which are determined for respective vectors by using the adaptive code vector from the adaptive code book and the pulse sound source vector from the pulse position searcher 54 and synthesizing a voice to minimize a difference from the input voice. Here, the gain multiplied by the adaptive code vector is used as a pitch gain, while the gain multiplied by the pulse sound source vector is used as a pulse sound source gain. Then, the multiplier 55 multiplies the adaptive code vector by the pitch gain and transmits an output to the adder 57. The multiplier 56 multiples the pulse sound source vector by the pulse sound source gain and transmits an output to the adder 57.

The adder 57 adds the adaptive code vector which is transmitted from the multiplier 55 after multiplied by the optimum gain and the pulse sound source vector which is transmitted from the multiplier 56 after multiplied by the optimum gain, and emits the activating sound source vector.

As aforementioned, according to the above fourth embodiment, even when a small number of bits are allocated to the pulse, deterioration in sound quality can be minimized.

Fifth Embodiment

Figure 11:
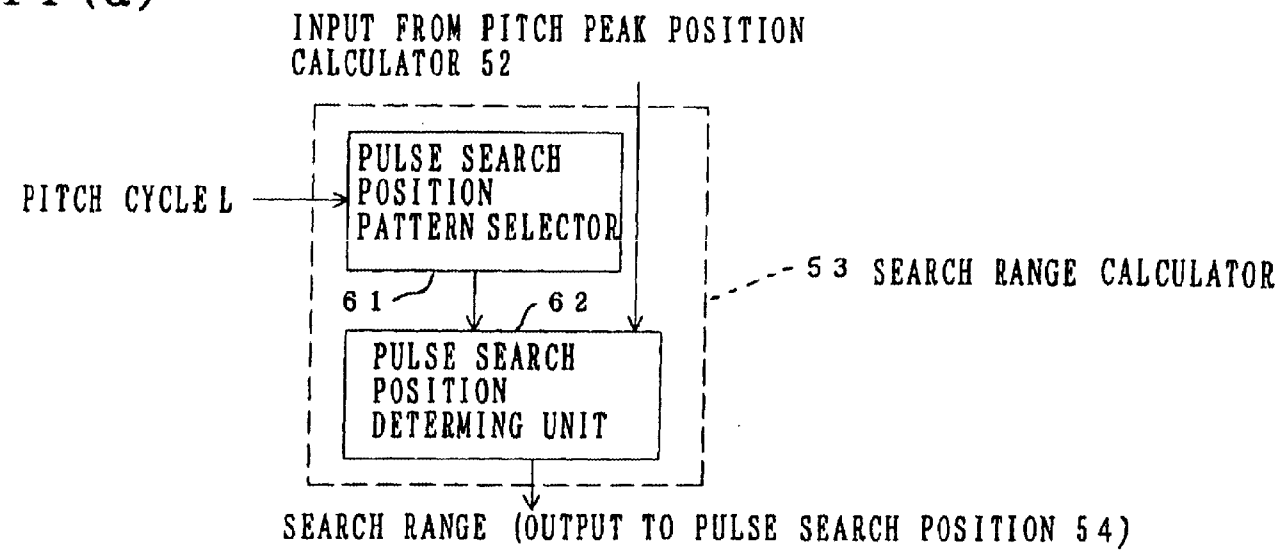
FIG. 11(*a*) is a block diagram showing a constitution of a search position calculator in a fifth embodiment of the invention.
Figure 11:
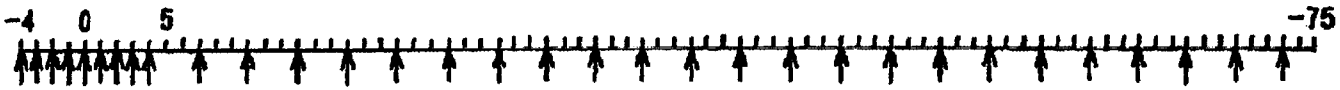
Figure 11:
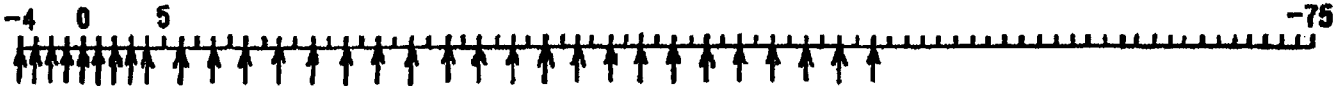

FIG. 11(*a*) shows a fifth embodiment of the invention and a pulse search position determining portion in a sound source generating portion which determines pulse search positions by the pitch cycle and pitch peak position of an adaptive code vector, and finely shows the search range calculator 53 in FIG. 8. In FIG. 11(*a*), numeral 61 denotes a pulse search position pattern selector which receives the pitch cycle L and transmits a pulse search position pattern to a pulse search position determining unit 62; and 62 denotes the pulse search position determining unit which receives pitch peak positions from the pitch peak position calculator 52, respectively, and transmits a search range (pulse search positions) to the pulse position searcher 54.

Operation of the search range calculator 53 in the sound source generating portion will be described with reference to FIGS. 11(*a*), 11(*b*) and 11(*c*). The pulse search position pattern selector 61 beforehand has plural types of pulse search position patterns (the pulse search position pattern is constituted of an assembly of sample point positions in which pulse searching is performed, and represents the sample point at a relative position when the pitch peak position is zero), uses the pitch cycle L obtained through pitch analysis to determine which pulse search position pattern is to be used and transmits the pulse search position pattern to the pulse search position determining unit 62.

FIG. 11(*b*) or 11(*c*) shows an example of the pulse search position pattern owned beforehand by the pulse search position pattern selector 61. In the figures graduations denote positions of sample points. The arrowed sample points correspond to pulse search positions (not-arrowed portions are not searched). Numerical values on the graduations denote relative positions which are obtained from the adaptive code vector while the pitch peak position is zero. Also, FIG. 11(*b*) or 11(*c*) shows the case where one sub-frame has 80 samples. FIG. 11(*b*) shows the search position pattern when the pitch cycle L is long (for example, 45 samples or more), while FIG. 11(*c*) shows the search position pattern when the pitch cycle L is short (for example, less than 44 samples). When the pitch cycle L is short, the entire sub-frame is not searched. By performing a pitch-cycling process, pulses can be raised in the entire sub-frame. The pitch-cycling can be facilitated by using following equation (1) (ITU-T STUDY GROUP15—CONTRIBUTION 152, "G.729-CODING OF SPEECH AT 8 KBIT/S USING CONJUGATE-STRUCTURE ALGEBRAIC-CODE-EXCITED LINEAR-PREDICTION(CS-ACELP)", COM 15-152-E July 1995).

$$code(i)=code(i)+\beta\times code(i-L) \quad (1)$$

In the equation (1), code() represents the pulse sound source vector, and i represents a sample number (0 to 79 in the example of FIG. 11). Also, βa gain value indicating a cycling intensity is enlarged when a periodicity is strong and reduced when the periodicity is weak (usually a value of 0 to 1.0 is used). In FIG. 11(*c*) pulse searching is performed in a range of (−4) to 48 sample (the range of 53 samples). Therefore, when the pitch cycle L is constituted of 53 (or 54) or less, the search range pattern of FIG. 11(*c*) can be used. However, when the pitch cycle L is less than about 45 samples, two pitch peak positions can be included in the search range. Then, the case where a first-cycle pitch pulse waveform and a second-cycle pitch pulse waveform are varied or the case where the obtained pitch peak position is detected by mistake as the position which is one cycle before the actual pitch peak position can be handled.

The pulse search position determining unit 62 uses the pulse search position pattern transmitted from the pulse search position pattern selector to determine pulse search positions in the present sub-frame, and transmits an output to the pulse position searcher 54. The pulse search position pattern transmitted from the pulse search position pattern selector 62 is represented as the relative position when the pitch peak position is zero, therefore, cannot be used as it is for pulse searching. For this, the pattern is converted to an absolute position in which the sub-frame top is zero, and transmitted to the pulse position searcher 54.

Sixth Embodiment

Figure 12:
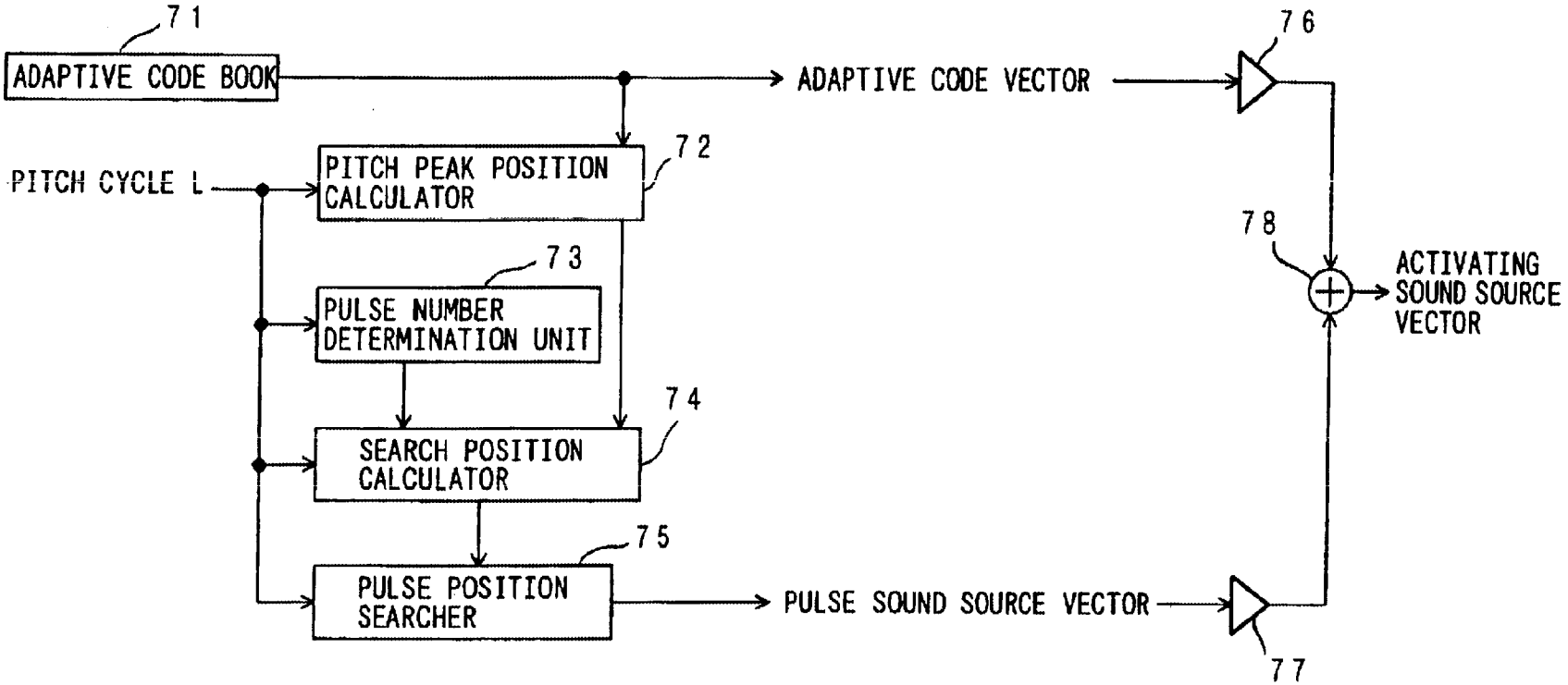
FIG. 12 is a block diagram showing a constitution of a sound source generating portion in a CELP type voice encoding device in a sixth embodiment of the invention.

FIG. 12 shows a sixth embodiment of the invention and a sound source generating portion in a voice encoding device which determines the search positions for pulse positions by the pitch cycle and pitch peak position of an adaptive code vector and has a constitution for switching the number of pulses for use in a pulse sound source. In FIG. 12, numeral 71 denotes an adaptive code book which transmits the adaptive code vector to a pitch peak position calculator 72 and a multiplier 76; 72 denotes the pitch peak position calculator which receives the pitch cycle L obtained outside by means of pitch analysis or adaptive code book searching and the adaptive code vector transmitted from the adaptive code book, and transmits the pitch peak position to a search position calculator 74; 73 denotes a pulse number determination unit which receives the pitch cycle L obtained outside by means of pitch analysis or adaptive code book searching and transmits the number of pulses to the search position calculator 74; 74 denotes the search position calculator which receives the pitch cycle L obtained outside by means of pitch analysis or adaptive code book searching, the pulse number transmitted from the pulse number determination unit 73 and the pitch peak position transmitted from the pitch peak position calculator 72, and transmits the pulse search positions to a pulse position searcher 75; 75 denotes the pulse position searcher which receives the pitch cycle L obtained outside by means of pitch analysis or adaptive code book searching and the pulse search positions transmitted from the search position calculator 74, determines a combination of positions for raising pulses used in the pulse sound source and transmits a pulse sound source vector prepared by the combination to a multiplier 77; 76 denotes the multiplier which receives the adaptive code vector from the adaptive code book, multiplies it by an adaptive code vector gain and transmits an output to an adder 78; 77 denotes the multiplier which receives the pulse sound source vector from the pulse position searcher, multiplies it by a pulse sound source vector gain and transmits an output to the adder 78; and 78 denotes the adder which receives the vectors from the multipliers 76 and 77, performs a vector addition and emits a sound source vector.

Operation of the sound source generating portion of the CELP type voice encoding device which is constructed as aforementioned will be described with reference to FIG. 12. The adaptive code vector from the adaptive code book 71 is transmitted to the multiplier 76, multiplied by the adaptive code vector gain and transmitted to the adder 78. The pitch peak position calculator 72 detects the pitch peak from the adaptive code vector, and transmits its position to the search position calculator 74. The pitch peak position can be detected (calculated) by maximizing an inner product of the impulse string vector arranged in the pitch cycle L and the adaptive code vector. Also, the pitch peak position can be detected more precisely by maximizing an inner product of the vector which is obtained by convoluting an impulse response of a synthesis filter in the impulse string vector arranged in the pitch cycle L and the vector which is obtained by convoluting the impulse response of the synthesis filter in the adaptive code vector.

The pulse number determination unit 73 determines the number of pulses for use in the pulse sound source based on the value of pitch cycle L, and transmits an output to the search position calculator 74. The relationship between the pulse number and the pitch cycle is predetermined by statistics or learning. For example, when the pitch cycle is of 45 samples or less, five pulses are determined; when the pitch cycle is in a range exceeding 45 samples and less than 80 samples, four pulses are determined; and when the pitch cycle is of 80 samples or more, three pulses are determined. In this manner, in accordance with ranges of pitch cycle values, respective numbers of pulses are determined. When the pitch cycle is short, by using the pitch-cycling process, the pulse search range can be restricted to one or two-pitch cycle. Therefore, instead of decreasing position information, the number of pulses can be increased. Also, for the waveform, female voice with a short pitch cycle and a male voice with a long pitch cycle differ from each other in waveform features. There exists the number of pulses suitable for each voice.

Generally, since the male voice has a strong pulse property, the pulse position tends to be important rather than the pulse number. Since the female voice has a weak pulse property, there is a tendency to increase the number of pulses so that power concentration had better be avoided. Therefore, it is effective to reduce the pulse number when the pitch cycle is long, and to increase the pulse number to some degree when the pitch cycle is short. Further, when the number of pulses is determined by considering a change in pulse number between continuous sub-frames, a change in pitch cycle L and the like, then discontinuity is moderated between the continuous sub-frames, and the quality of the rising portion of the voiced portion can be enhanced. Specifically, in the continuous sub-frames, when the number of pulses determined from the pitch cycle L is decreased from five to three, the decrease in pulse number is allowed to have hysteresis. Five pulses are decreased to four, not steeply to three. The number of pulses is thus prevented from largely changing between the sub-frames. On the other hand, when the pitch cycle L differs largely between the continuous sub-frames, there is a large possibility that the voiced portion is rising. Therefore, voice quality is enhanced by decreasing the number of pulses and enhancing the precision of pulse position. When the pitch cycle L of the previous sub-frame largely differs from the pitch cycle L of the present sub-frame, the number of pulses is determined as three irrespective of the value of pitch cycle L in the present sub-frame. By this or other methods the number of pulses is determined. Then, voice quality can be enhanced further. Additionally, the cases where these methods are used are easily influenced by error in double pitch, error in half pitch and the like in the pitch analysis. Therefore, the use of a method of determining the number of pulses to moderate the influence (for example, determination of continuity of the pitch cycle by considering the possibility of half pitch or double pitch or the like) or the raising of precision in pitch analysis as high as possible is more effective.

The search position calculator 74 determines the position in which pulse searching is performed, based on the pitch peak position and the number of pulses. Pulse search positions are distributed in such a manner that they become dense in the pitch peak vicinity and coarse in other portions (this is effective when bits are not sufficiently distributed to search all the sample points). Specifically, in the vicinity of the pitch peak position all the sample points are subjected to the pulse position searching. In portions apart from the pitch peak position, however, the interval of the pulse position searching is broadened to, for example, every two samples or every three samples (for example, search positions are determined as shown in FIGS. 11(*b*) and 11(*c*)). Also, when there is a large number of pulses, the number of bits allocated to one pulse is reduced. Therefore, the interval of coarse portions is broader as compared with the case where there is a small number of pulses (the precision in pulse position becomes rough). Additionally, when the pitch cycle is short, as described in the fifth embodiment, the search range is restricted only to a range which is a little longer than one pitch cycle from the first pitch peak in the sub-frame. Then, voice quality can be enhanced.

The pulse position searcher 75 determines the optimum combination of positions where pulses are raised based on the search positions which are determined by the search position calculator 74. In the pulse searching method, as described in "ITU-T STUDY GROUP15—CONTRIBUTION 152, "G.729-CODING OF SPEECH AT 8 KBIT/S USING CONJUGATE-STRUCTURE ALGEBRAIC-CODE-EXCITED LINEAR-PREDICTION (CS-ACELP)", COM 15-152-E July 1995", for example, when the number of pulses is four, a combination from i0 to i3 is determined in such a manner that equation (2) is maximized.

$$(DN \times DN)/RR \tag{2}$$

$$DN = dn(i0) + dn(i1) + dn(i2) + dn(i3)$$

$$\begin{aligned} RR = {} & rr(i0, i0) + rr(i1, i1) + 2 \times rr(i0, i1) + \\ & rr(i2, i2) + 2 \times (rr(i0, i2) + rr(i1, i2)) + \\ & rr(i3, i3) + 2 \times (rr(i0, i3) + rr(i1, i3) + rr(i2, i3)) \end{aligned}$$

Figure 13:
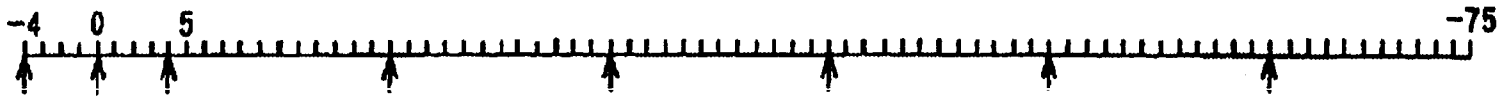
FIGS. 13(*a*) to 13(*d*) are diagrammatic representations each showing an example of pulse search positions which are calculated by a search position calculator in the sixth embodiment of the invention.
Figure 13:
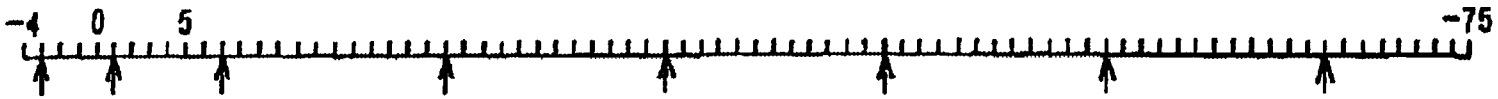
Figure 13:
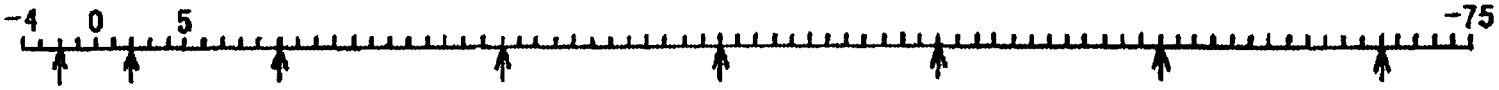
Figure 13:
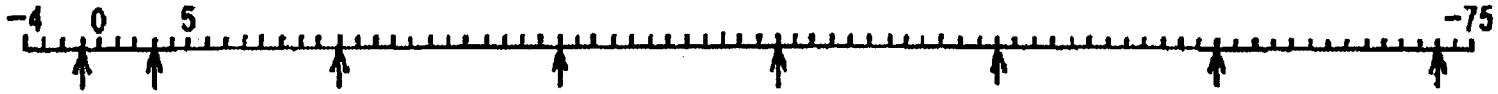

Here, dn(i) (i=0 to 79: in the case where the sub-frame length is of 80 samples) is obtained by backward filtering of target vector x'(i) of pulse sound source component with the impulse response of the synthesis filter, while rr(i,i) is an auto-correlation matrix of impulse response as shown in equation (3). Also, the range of positions which can be taken by i0, i1, i2 and i3 is obtained by the search position calculator 74. Specifically, in the case where the number of pulses is four, refer to FIGS. 13(*a*) to 13(*d*) (in the figures, arrowed portions can be taken, and additionally numeric values on graduations represent relative values when the pitch peak position is zero).

$$dn(i) = \sum_{l=n}^{79} x'(i)h(i-n),\ n = 0, 1, \ldots, 79 \tag{3}$$

$$rr(imj) = \sum_{n=j}^{79} h(n-i)h(n-j),\ i = 0, 1, \ldots, 79,\ j = i, i+1, \ldots, 79$$

When the pulse position searcher 75 determines a combination of optimum pulse positions, the pulse sound source vector prepared by the combination is transmitted to the multiplier 77, multiplied by the pulse code vector gain and transmitted to the adder 78.

The adder 78 adds an adaptive code vector component and a pulse sound source vector component, and emits an activating sound source vector.

Seventh Embodiment

Figure 14:
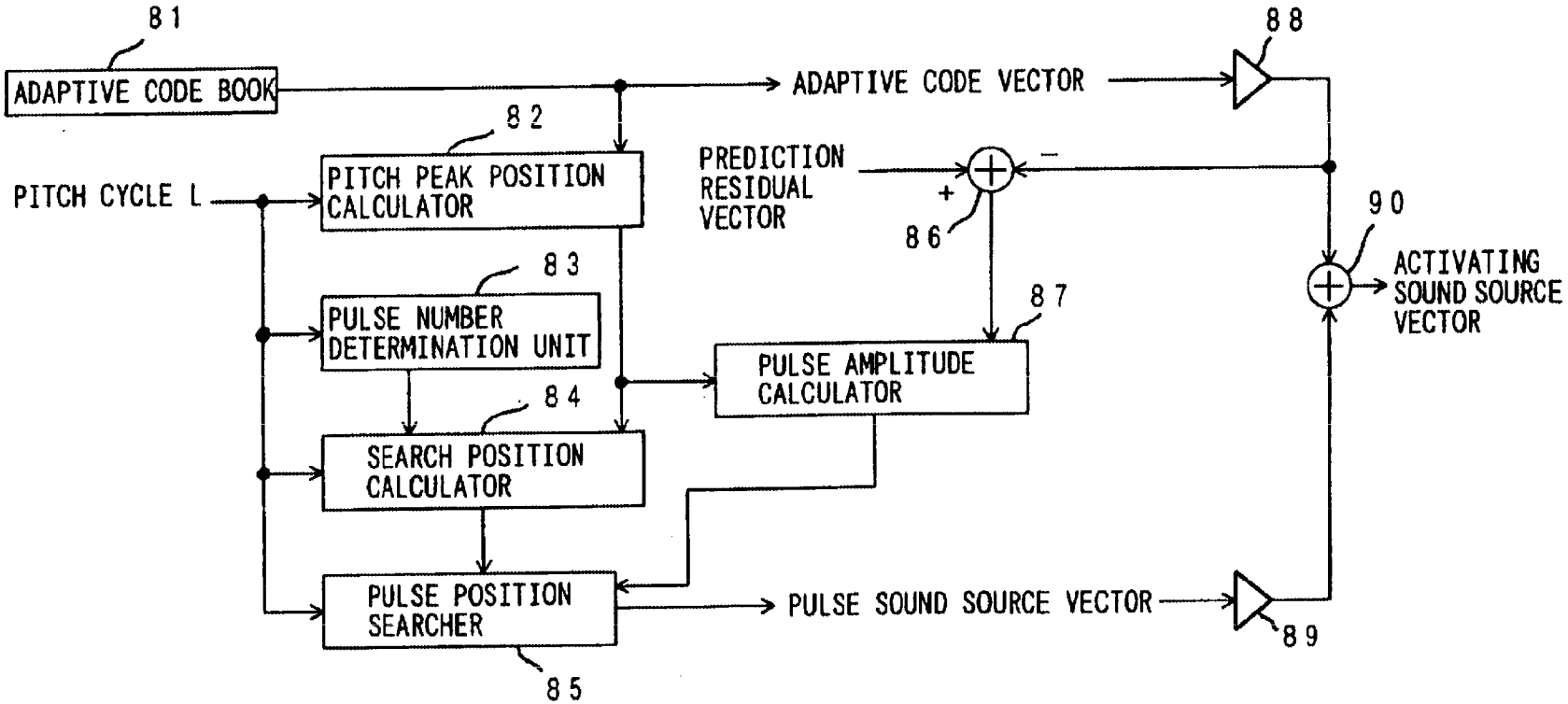
FIG. 14 is a block diagram showing a constitution of a sound source generating portion in a CELP type voice encoding device in a seventh embodiment of the invention.

FIG. 14 shows a seventh embodiment of the invention and a sound source generating portion in a CELP type voice encoding device, which has a constitution for determining a pulse amplitude before searching a pulse. In FIG. 14, numeral 81 denotes an adaptive code book which is constituted of the past activating sound source signal buffer and transmits an adaptive code vector to a pitch peak position calculator 82 and a multiplier 88; 82 denotes the pitch peak position calculator which receives the pitch cycle L obtained outside by means of pitch analysis or adaptive code book searching and the adaptive code vector transmitted from the adaptive code book 81 and which transmits a pitch peak position to a search position calculator 84 and a pulse amplitude calculator 87; 83 denotes a pulse number determination unit which receives the pitch cycle L obtained outside by means of pitch analysis or adaptive code book searching and transmits the number of pulses to the search position calculator 84; 84 denotes the search position calculator which receives the pitch cycle L obtained outside by means of pitch analysis or adaptive code book searching, the number of pulses transmitted from the pulse number determination unit 83 and the pitch peak position transmitted from the pitch peak position calculator 82 and which transmits pulse search positions to a pulse position searcher 85; 85 denotes the pulse position searcher which receives the pitch cycle L obtained outside by means of pitch analysis or adaptive code book searching, the pulse search positions transmitted from the search position calculator 84 and the pulse amplitude from the pulse amplitude calculator 87, determines a combination of positions for raising pulses for use in a pulse sound source and which transmits a pulse sound source vector prepared by the combination to a multiplier 89; 86 denotes an adder which subtracts the adaptive code vector transmitted from the multiplier 88 (after multiplied by the gain) from a prediction residual signal obtained by a linear prediction filter determined by outside LPC analysis or LPC quantization unit and which transmits a differential signal to the pulse amplitude calculator 87; 87 denotes the pulse amplitude calculator which receives the differential signal from the adder 86 and transmits pulse amplitude information to the pulse position searcher 85; 88 denotes the multiplier which multiplies the input of adaptive code vector from the adaptive code book 81 by an adaptive code vector gain and transmits an output to adders 90 and 86; 89 denotes the multiplier which receives a pulse sound source vector from the pulse position searcher 85, multiplies it by a pulse sound source vector gain and transmits an output to the adder 90; and 90 denotes the adder which adds the vectors from the multipliers 88 and 89 and emits an activating sound source vector.

Operation of the sound source generating portion of the CELP type voice encoding device which is constructed as aforementioned will be described with reference to FIG. 14. The adaptive code vector from the adaptive code book 81 is transmitted to the multiplier 88, multiplied by the adaptive code vector gain and transmitted to the adders 90 and 86.

The pitch peak position calculator 82 detects the pitch peak from the adaptive code vector, and transmits its position to the search position calculator 84 and the pulse amplitude calculator 87. The pitch peak position can be detected (calculated) by maximizing an inner product of the impulse string vector arranged in the pitch cycle L and the adaptive code vector. Also, the pitch peak position can be detected more precisely by maximizing an inner product of the vector which is obtained by convoluting an impulse response of a synthesis filter in the impulse string vector arranged in the pitch cycle L and the vector which is obtained by convoluting the impulse response of the synthesis filter in the adaptive code vector.

The pulse number determination unit 83 determines the number of pulses for use in the pulse sound source based on the value of pitch cycle L, and transmits an output to the search position calculator 84. The relationship between the pulse number and the pitch cycle is predetermined by statistics or learning. For example, when the pitch cycle is of 45 samples or less, five pulses are determined; when the pitch cycle is in a range exceeding 45 samples and less than 80 samples, four pulses are determined; and when the pitch cycle is of 80 samples or more, three pulses are determined. In this manner, in accordance with ranges of pitch cycle values, respective numbers of pulses are determined. Further, when the number of pulses is determined by considering a change in pulse number between continuous sub-frames, a change in pitch cycle L and the like, then discontinuity is moderated between the continuous sub-frames, and the quality of the rising portion of the voiced portion can be enhanced. Specifically, in the continuous sub-frames, when the number of pulses determined from the pitch cycle L is decreased from five to three, the decrease in pulse number is allowed to have hysteresis. Five pulses are decreased to four, not steeply to three. The number of pulses is thus prevented from largely changing between the sub-frames. On the other hand, when the pitch cycle L differs largely between the continuous sub-frames, there is a large possibility that the voiced portion is rising. Therefore, voice quality is enhanced by decreasing the number of pulses and enhancing the precision of pulse position. When the pitch cycle L of the previous sub-frame largely differs from the pitch cycle L of the present sub-frame, the number of pulses is determined as three irrespective of the value of pitch cycle L in the present sub-frame. By this or other methods the number of pulses is determined. Then, voice quality can be enhanced further. Additionally, the cases where these methods are used are easily influenced by error in double pitch, error in half pitch and the like in the pitch analysis. Therefore, the use of a method of determining the number of pulses to moderate the influence (for example, determination of continuity of the pitch cycle by considering the possibility of half pitch or double pitch or the like) or the raising of precision in pitch analysis as high as possible is more effective.

The search position calculator 84 determines the position in which pulse searching is performed, based on the pitch peak position and the number of pulses. Pulse search positions are distributed in such a manner that they become dense in the pitch peak vicinity and coarse in other portions (this is effective when bits are not sufficiently distributed to search all the sample points). Specifically, in the vicinity of the pitch peak position all the sample points are subjected to the pulse position searching. In portions apart from the pitch peak position, however, the interval of the pulse position searching is broadened to, for example, every two samples or every three samples (for example, the search positions are determined as shown in FIGS. 11(*b*) and 11(*c*)). Also, when there is a large number of pulses, the number of bits allocated to one pulse is reduced. Therefore, the interval of coarse portions is broader as compared with the case where there is a small number of pulses (the precision in pulse position becomes rough). Additionally, when the pitch cycle is short, as described in the fifth embodiment, the search range is restricted only to a range which is a little longer than one pitch cycle from the first pitch peak in the sub-frame. Then, voice quality can be enhanced.

The pulse position searcher 85 determines the optimum combination of positions where pulses are raised based on the search positions which are determined by the search position calculator 84 and the pulse amplitude information which is determined by the pulse amplitude calculator 87 as described later. In the pulse searching method, as described in "ITU-T STUDY GROUP15—CONTRIBUTION 152, "G.729-CODING OF SPEECH AT 8 KBIT/S USING CONJUGATE-STRUCTURE ALGEBRAIC-CODE-EXCITED LINEAR-PREDICTION(CS-ACELP)", COM 15-152-E July 1995", for example, when the number of pulses is four, a combination from i0 to i3 is determined in such a manner that equation (4) is maximized.

$$(DN \times DN)/RR \tag{4}$$

$$DN = a0 \times dn(i0) + a1 \times dn(i1) + a2 \times dn(i2) + a3 \times dn(i3)$$

$$\begin{aligned} RR = {} & a0 \times a0 \times rr(i0, i0) + a1 \times a1 \times rr(i1, i1) + \\ & 2 \times a0 \times a1 \times rr(i0, i1) + a2 \times a2 \times rr(i2, i2) + \\ & 2 \times (a0 \times a2 \times rr(i0, i2) + a1 \times a2 \times rr(i1, i2)) + \\ & a3 \times a3 \times rr(i3, i3) + 2 \times (a0 \times a3 \times rr(i0, i3) + \\ & a1 \times a3 \times rr(i1, i3) + a2 \times a3 \times rr(i2, i3)) \end{aligned}$$

Here, dn(i) (i=0 to 79: in the case where the sub-frame length is of 80 samples) is obtained by convoluting the impulse response of the synthesis filter in a target vector of pulse sound source component, while rr(i,i) is an auto-correlation matrix of impulse response as shown in equation (3). Also, the range of positions which can be taken by i0, i1, i2 and i3 is obtained by the search position calculator 84. Specifically, in the case where the number of pulses is four, refer to FIGS. 13(*a*) to 13(*d*) (in the figures, arrowed portions can be taken, and additionally numeric values on graduations represent relative values when the pitch peak position is zero). Also, a0, a1, a2 and a3 are pulse amplitudes which are obtained by the pulse amplitude calculator 87.

When the pulse position searcher 85 determines a combination of optimum pulse positions, the pulse sound source vector prepared by the combination is transmitted to the multiplier 89, multiplied by the pulse code vector gain and transmitted to the adder 90.

The adder 86 subtracts an adaptive code vector component (the adaptive code vector multiplied by the adaptive code vector gain) from the linear prediction residual signal (prediction residual vector) obtained by the outside LPC analysis, and transmits the differential signal to the pulse amplitude calculator 87. Additionally, in the sound source portion of the CELP type voice encoding device, usually the adaptive code vector gain and the noise code vector (corresponding to the pulse sound source vector in the invention) gain are determined after the searching of both the adaptive code book and the noise code book (corresponding to the pulse position searching in the invention) is finished. Therefore, the vector which is obtained by multiplying the adaptive code vector by the adaptive code vector gain cannot be obtained before the pulse position searching. For this reason, the adaptive code vector component which is used for subtraction by the adder 86 is obtained by multiplying the adaptive code vector by the adaptive code vector gain (which is not the final optimum adaptive code vector gain) which is obtained from equation (5) at the time of searching the adaptive code book.

$$gp = \frac{\sum_{n=0}^{79} x(n)y(n)}{\sum_{n=0}^{79} y(n)y(n)} \tag{5}$$

Here, x(n) is a so-called target vector which is obtained by removing a zero input response of an LPC synthesis filter in the present sub-frame from an input signal with an auditory importance applied thereto. Also, y(n) is a component in a synthesized voice signal prepared by the adaptive code vector, and here obtained by convoluting in the adaptive code vector an impulse response of a filter which is obtained by cascade-connecting the LPC synthesis filter in the present sub-frame and a filter for applying the auditory importance.

The pulse amplitude calculator 87 uses the pitch peak position obtained by the pitch peak position calculator 82 to divide the differential signal from the adder 86 into the pitch peak position vicinity and the other portions, obtains an average value of powers in respective portions or an average value of absolute values of signal amplitudes at respective sample points included in respective portions, and transmits each amplitude to the pulse position searcher 85 as the pulse amplitude in the vicinity of the pitch peak position or the pulse amplitude of the other portions. In the pulse position searcher 85, by using different amplitudes for the pulse in the pitch pulse vicinity and the pulse in the other portions, the equation (4) is evaluated to perform the pulse position search. The pulse sound source vector which is represented by the pulse position determined by the pulse position search and the pulse amplitude allocated to the pulse in the position is transmitted from the pulse position searcher 85.

The adder 90 adds the adaptive code vector component and the pulse sound source vector component, and transmits the activating sound source vector.

Eighth Embodiment

Figure 15:
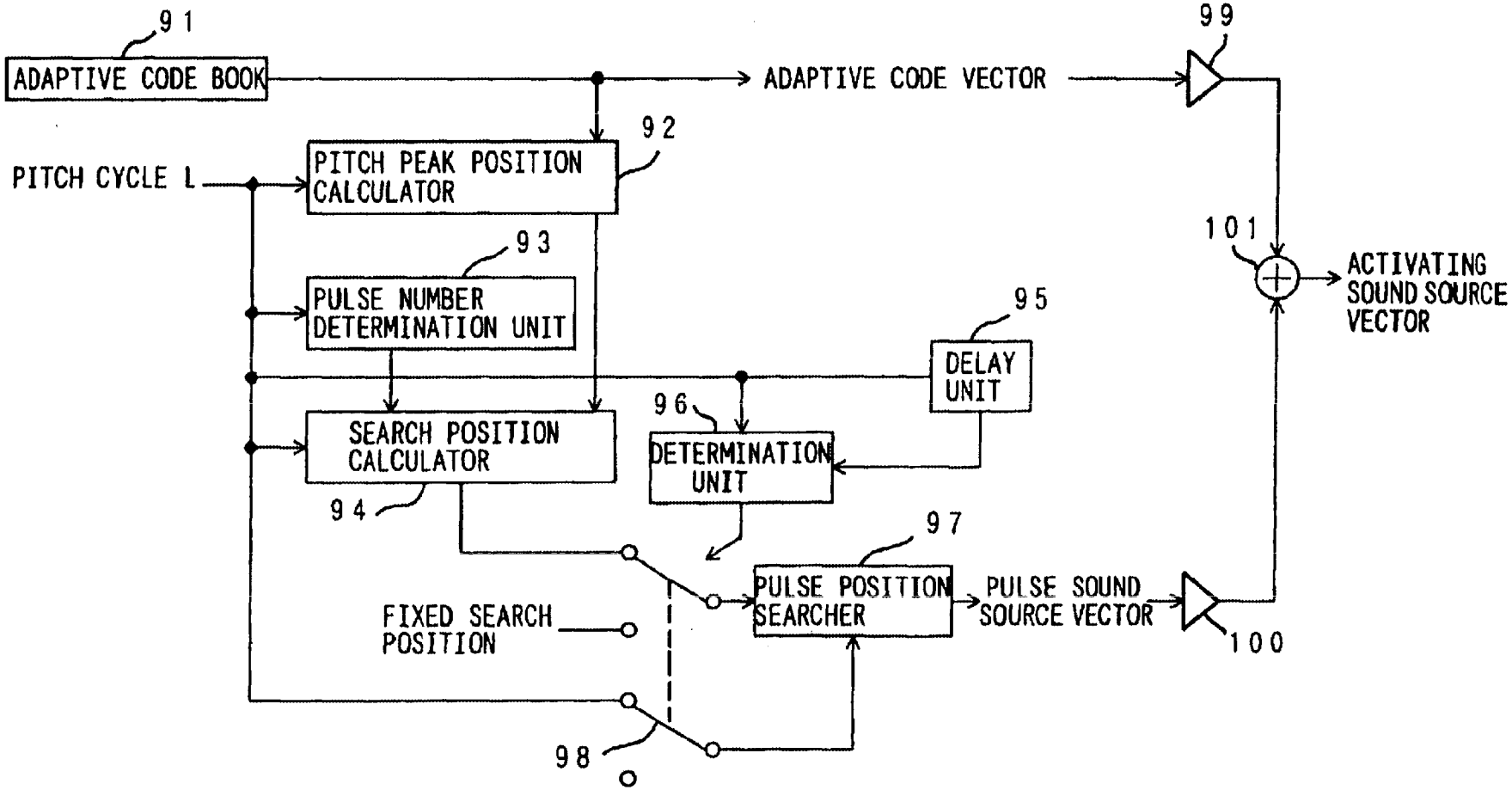
FIG. 15 is block diagram showing a constitution of a sound source generating portion in a CELP type voice encoding device in an eighth embodiment of the invention.

FIG. 15 shows an eighth embodiment of the invention and a sound source generating portion in a CELP type voice encoding device, which has a constitution for switching search positions used for pulse searching based on a continuity determination result of a pitch cycle. In FIG. 15, numeral 91 denotes an adaptive code book which transmits an adaptive code vector to a pitch peak position calculator 92 and a multiplier 99; 92 denotes the pitch peak position calculator which receives the adaptive code vector from the adaptive code book 91 and the pitch cycle L and transmits a pitch peak position in the adaptive code vector to a search position calculator 94; 93 denotes a pulse number determination unit which receives the pitch cycle L and transmits the number of pulses of a pulse sound source to the search position calculator 94; 94 denotes the search position calculator which receives the pitch cycle L, the pitch peak position from the pitch peak position calculator 92 and the number of pulses from the pulse number determination unit 93 and which transmits pulse search positions via a switch 98 to a pulse position searcher 97; 95 denotes a delay unit which receives the pitch cycle L in the present sub-frame, delays it by one sub-frame and transmits an output to a determination unit 96; 96 denotes the determination unit which receives the pitch cycle L in the present sub-frame and the pitch cycle in the previous sub-frame transmitted from the delay unit 95 and which transmits the determination result of continuity of the pitch cycle to the switch 98; 97 denotes the pulse position searcher which receives the pulse search positions transmitted via the switch 98 from the search position calculator 94 or fixed search positions transmitted via the switch 98 and the pitch cycle L transmitted via the switch 98, respectively, which searches the pulse position by using the received search positions and the pitch cycle L and which transmits a pulse sound source vector to a multiplier 100; and 98 denotes two-system switches which are interconnected to switch based on the determination result from the determination unit 96, one system switch being used for switching the pulse search positions to the search positions calculated by the search position calculator 94 and to predetermined fixed search positions while the other system switch being used for ON/OFF to determine whether or not the pitch cycle L is transmitted to the pulse position searcher 97. Numeral 99 denotes the multiplier which multiplies the input of adaptive code vector from the adaptive code book 91 by an adaptive code vector gain and transmits an output to an adder 101; 100 denotes the multiplier which multiplies the input of pulse sound source vector from the pulse position searcher 97 by a pulse sound source vector gain and transmits an output to the adder 101; and 101 denotes the adder which adds the vectors from the multipliers 99 and 100 and emits an activating sound source vector.

Operation of the sound source generating portion of the CELP type voice encoding device constituted as aforementioned will be described with reference to FIG. 15. The adaptive code book 91 is constituted of the past activating sound source buffer, cuts out the relevant portion from the buffer of the activating sound source based on the pitch cycle or pitch lug which is obtained by outside pitch analysis or adaptive code book search means, and transmits the adaptive code vector to the pitch peak position calculator 92 and the multiplier 99. The adaptive code vector transmitted from the adaptive code book 91 to the multiplier 99 is multiplied by the adaptive code vector gain and transmitted to the adder 101.

The pitch peak position calculator 92 detects the pitch peak from the adaptive code vector, and transmits its position to the search position calculator 94. The pitch peak position can be detected (calculated) by maximizing the inner product of the impulse string vector arranged in the pitch cycle L and the adaptive code vector. Also, the pitch peak position can be detected more precisely by maximizing the inner product of the vector which is obtained by convoluting the impulse response of the synthesis filter in the impulse string vector arranged in the pitch cycle L and the vector which is obtained by convoluting the impulse response of the synthesis filter in the adaptive code vector.

The pulse number determination unit 93 determines the number of pulses for use in the pulse sound source based on the value of pitch cycle L, and transmits an output to the search position calculator 94. The relationship between the pulse number and the pitch cycle is predetermined by learning or statistics. For example, when the pitch cycle is of 45 samples or less, five pulses are determined; when the pitch cycle is in a range exceeding 45 samples and less than 80 samples, four pulses are determined; and when the pitch cycle is of 80 samples or more, three pulses are determined. In this manner, in accordance with ranges of pitch cycle values, respective numbers of pulses are determined.

The search position calculator 94 determines the position in which pulse searching is performed, based on the pitch peak position and the number of pulses. Pulse search positions are distributed in such a manner that they become dense in the pitch peak vicinity and coarse in other portions (this is effective when bits are not sufficiently distributed to search all the sample points). Specifically, in the vicinity of the pitch peak position all the sample points are subjected to the pulse position searching. In portions apart from the pitch peak position, however, the interval of the pulse position searching is broadened to, for example, every two samples or every three samples (for example, the search positions are determined as shown in FIGS. 11(*b*) and 11(*c*)). Also, when there is a large number of pulses, the number of bits allocated to one pulse is reduced. Therefore, the interval of coarse portions is broader as compared with the case where there is a small number of pulses (the precision in pulse position becomes rough). Additionally, when the pitch cycle is short, as described in the fifth embodiment, the search range is restricted only to a range which is a little longer than one pitch cycle from the first pitch peak in the sub-frame. Then, voice quality can be enhanced.

The pulse position searcher 97 determines the optimum combination of positions where pulses are raised based on the search positions which are determined by the search position calculator 94 or the predetermined fixed search positions and the pitch cycle L. In the pulse searching method, as described in "ITU-T STUDY GROUP15—CONTRIBUTION 152, "G.729-CODING OF SPEECH AT 8 KBIT/S USING CONJUGATE-STRUCTURE ALGEBRAIC-CODE-EXCITED LINEAR-PREDICTION (CS-ACELP)", COM 15-152-E July 1995", for example, when the number of pulses is four, the combination from i0 to i3 is determined in such a manner that the equation (2) is maximized.

The switches 98 are switched based on the determination result of the determination unit 96. The determination unit 96 uses the pitch cycle L in the present sub-frame and the pitch cycle in the immediately previous sub-frame which is transmitted from the delay unit 95 to determine whether or not the pitch cycle is continuous. Specifically, when a difference of the value of pitch cycle in the present sub-frame from the value of pitch cycle in the immediately previous sub-frame is a predetermined or calculated threshold value or less, it is determined that the pitch cycle is continuous. When it is determined that the pitch cycle is continuous, the present sub-frame is regarded as a voiced/voiced stationary portion. The switch 98 connects the search position calculator 94 and the pulse position searcher 97, and transmits the pitch cycle L to the pulse position searcher 97 (one system of the switch 98 is switched to the search position calculator 94, while the other system is in an ON condition to transmit the pitch cycle L to the pulse position searcher 97). When it is determined that the pitch cycle is not continuous (the difference between the pitch cycle in the present sub-frame and the pitch cycle in the immediately previous sub-frame exceeds the threshold value), the present sub-frame is regarded as not being the voiced/voiced stationary portion (as a unvoiced portion/voiced rising portion). The switch 98 transmits the predetermined fixed search positions to the pulse searcher 97, and does not transmit the pitch cycle L to the pulse position searcher (one system of the switch 98 is switched to the fixed search positions, while the other system is in an OFF condition so that the pitch cycle L is not transmitted to the pulse position searcher 97).

When the pulse position searcher 97 determines the optimum pulse position combination, the pulse sound source vector prepared by the combination is transmitted to the multiplier 100, multiplied by the pulse code vector gain and transmitted to the adder 101.

The adder 101 adds the adaptive code vector component and the pulse sound source vector component, and transmits the activating sound source vector.

Additionally, a table shown in FIG. 16 shows an example of fixed search positions in FIG. 15. In FIG. 16(*b*), in the same manner as the search positions shown in FIG. 13, when eight positions are allocated per one pulse, the search positions are determined in such a manner that the search positions are scattered uniformly in the entire sub-frame (instead of making dense the pitch peak vicinity and coarse the other portions, the entire density is made uniform). Also, in FIG. 16(*a*) the search positions allocated to each of two pulses of four pulses are decreased to four positions, but there are provided four types of search positions. All the sample points in the sub-frame are included in either one of search position groups (the same numbers of bits for representing the pulse positions are used in FIGS. 16(*a*), 16(*b*) and 13). In this case, as shown in FIG. 16(*b*), there is no position that is not searched at all. Therefore, even when the same numbers of bits are used, usually FIG. 16(*a*) shows a better performance.

Additionally, in the embodiment, the sound source generating portion of the pulse number variable type voice encoding device which has the pulse number determination unit 93 has been described. Even in the pulse number fixed type which has no pulse number determination unit 93, however, the pulse search positions are effectively switched by using the continuity of the pitch cycle. Also, in the embodiment, the continuity of the pitch cycle is determined only by the pitch cycles in the immediately previous sub-frame and the present sub-frame. Alternatively, by using the pitch cycle of the past sub-frame, determination accuracy can be enhanced.

Ninth Embodiment

Figure 17:
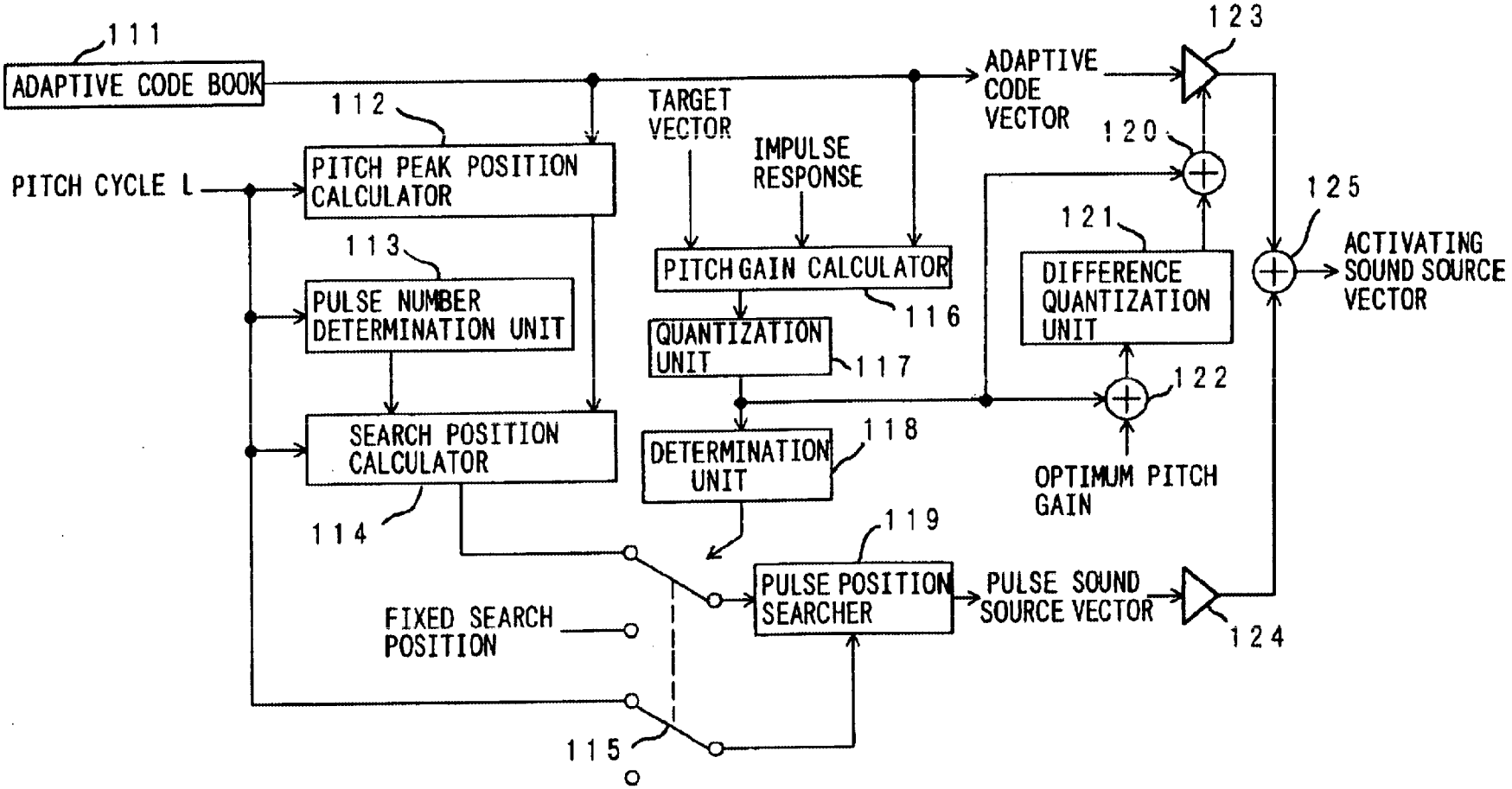
FIG. 17 is a block diagram showing a constitution of a sound source generating portion in a CELP type voice encoding device in a ninth embodiment of the invention.

FIG. 17 shows a ninth embodiment of the invention and a sound source generating portion in a CELP type voice encoding device, in which a two-stage quantizing constitution is provided for quantizing a pitch gain (adaptive code vector gain), a first-stage target is a pitch gain calculated immediately after adaptive code book searching and search positions for use in pulse searching are switched based on a first-stage quantized pitch gain. In FIG. 17, numeral 111 denotes an adaptive code book which transmits outputs to a pitch peak position calculator 112, a pitch gain calculator 116 and a multiplier 123; 112 denotes the pitch peak position calculator which receives an adaptive code vector from the adaptive code book 111 and the pitch cycle L and transmits a pitch peak position in the adaptive code vector to a search position calculator 114; 113 denotes a pulse number determination unit which receives the pitch cycle L and transmits the number of pulses of a pulse sound source to the search position calculator 114; 114 denotes the search position calculator which receives the pitch cycle L, the pitch peak position from the pitch peak position calculator 112 and the number of pulses from the pulse number determination unit 113 and which transmits pulse search positions via a switch 115 to a pulse position searcher 119; and 115 denotes two-system switches which are interconnected to switch based on the determination result from a determination unit 118, one system switch being used for switching the pulse search positions to the search positions calculated by the search position calculator 114 and to predetermined fixed search positions while the other system switch being used for ON/OFF to determine whether or not the pitch cycle L is transmitted to the pulse position searcher 119. Numeral 116 denotes the pitch gain calculator which receives the adaptive code vector from the adaptive code book 111, a target vector in the present frame and an impulse response and which transmits a pitch gain to a quantization unit 117; 117 denotes the quantization unit which quantizes the pitch gain transmitted from the pitch gain calculator 116 and transmits an output to the determination unit 118 and adders 120 and 122; 118 denotes the determination unit which receives the first-stage quantized pitch gain from the quantization unit 117 and transmits the determination result of pitch periodicity to the switch 115; 119 denotes the pulse position searcher which receives the pulse search positions transmitted via the switch 115 from the search position calculator 114 or fixed search positions transmitted via the switch 115 and the pitch cycle L transmitted via the switch 115, respectively, which searches the pulse position by using the received search positions and the pitch cycle L and which transmits a pulse sound source vector to a multiplier 124; 120 denotes the adder which adds the first-stage quantized pitch gain from the quantization unit 117 and a difference quantized pitch gain from a difference quantization unit 121 and which transmits addition result to the multiplier 123 as the optimum quantized pitch gain (adaptive code vector gain); 121 denotes the quantization unit which receives a difference value from the adder 122 and transmits the quantized value to the adder 120; 122 denotes the adder which receives the adaptive code vector, the optimum pitch gain (adaptive code vector gain) calculated outside after the pulse sound source vector is determined and the first-stage quantized pitch gain (adaptive code vector gain) from the quantization unit 117 and which transmits their difference to the difference quantization unit 121; 123 denotes the multiplier which multiplies the input of adaptive code vector from the adaptive code book 111 by the quantized pitch gain (adaptive code vector gain) from the adder 120 and which transmits an output to an adder 125; 124 denotes the multiplier which multiplies the input of pulse sound source vector from the pulse position searcher 119 by a pulse sound source vector gain and which transmits an output to the adder 125; and 125 denotes the adder which adds the vectors from the multipliers 123 and 124 and emits an activating sound source vector.

Operation of the sound source generating portion of the voice encoding device constructed as aforementioned will be described with reference to FIG. 17. The adaptive code book 111 is constituted of the past activating sound source buffer, cuts out the relevant portion from the buffer of the activating sound source based on the pitch cycle or pitch lug which is obtained by outside pitch analysis or adaptive code book search means, and transmits the adaptive code vector to the pitch peak position calculator 112, the pitch gain calculator 116 and the multiplier 123. The adaptive code vector transmitted from the adaptive code book 111 to the multiplier 123 is multiplied by the quantized pitch gain (adaptive code vector gain) from the adder 120, and transmitted to the adder 125.

The pitch peak position calculator 112 detects the pitch peak from the adaptive code vector, and transmits its position to the search position calculator 114. The pitch peak position can be detected (calculated) by maximizing the inner product of the impulse string vector arranged in the pitch cycle L and the adaptive code vector. Also, the pitch peak position can be detected more precisely by maximizing the inner product of the vector which is obtained by convoluting the impulse response of the synthesis filter in the impulse string vector arranged in the pitch cycle L and the vector which is obtained by convoluting the impulse response of the synthesis filter in the adaptive code vector.

The pulse number determination unit 113 determines the number of pulses for use in the pulse sound source based on the value of pitch cycle L, and transmits an output to the search position calculator 114. The relationship between the pulse number and the pitch cycle is predetermined by learning or statistics. For example, when the pitch cycle is of 45 samples or less, five pulses are determined; when the pitch cycle is in a range exceeding 45 samples and less than 80 samples, four pulses are determined; and when the pitch cycle is of 80 samples or more, three pulses are determined. In this manner, in accordance with ranges of pitch cycle values, respective numbers of pulses are determined.

The search position calculator 114 determines the position in which pulse searching is performed, based on the pitch peak position and the number of pulses. Pulse search positions are distributed in such a manner that they become dense in the pitch peak vicinity and coarse in other portions (this is effective when bits are not sufficiently distributed to search all the sample points). Specifically, in the vicinity of the pitch peak position all the sample points are subjected to the pulse position searching. In portions apart from the pitch peak position, however, the interval of the pulse position searching is broadened to, for example, every two samples or every three samples (for example, the search positions are determined as shown in FIGS. 11(*b*) and 11(*c*)). Also, when there is a large number of pulses, the number of bits allocated to one pulse is reduced. Therefore, the interval of coarse portions is broader as compared with the case where there is a small number of pulses (the precision in pulse position becomes rough). Additionally, when the pitch cycle is short, as described in the fifth embodiment, the search range is restricted only to a range which is a little longer than one pitch cycle from the first pitch peak in the sub-frame. Then, voice quality can be enhanced.

The pulse position searcher 119 determines the optimum combination of positions where pulses are raised based on the search positions which are determined by the search position calculator 114 or the predetermined fixed search positions and the pitch cycle L. In the pulse searching method, as described in "ITU-T STUDY GROUP 15—CONTRIBUTION 152, "G.729-CODING OF SPEECH AT 8 KBIT/S USING CONJUGATE-STRUCTURE ALGEBRAIC-CODE-EXCITED LINEAR-PREDICTION(CS-ACELP)", COM 15-152-E July 1995", for example, when the number of pulses is four, the combination from i0 to i3 is determined in such a manner that the equation (2) is maximized.

The switches 115 are switched based on the determination result of the determination unit 118. The determination unit 118 uses the first-stage quantized pitch gain transmitted from the quantization unit 117 to determine whether or not the present sub-frame is a sub-frame with a strong pitch periodicity. Specifically, when the first-stage quantized pitch gain is in a predetermined or calculated range, it is determined that the pitch periodicity is strong. When it is determined that the pitch periodicity is strong, the present sub-frame is regarded as a voiced/voiced stationary portion. Then, the switch 115 connects the search position calculator 114 and the pulse position searcher 119, and transmits the pitch cycle L to the pulse position searcher (one system of the switch 115 is switched to the search position calculator 114, while the other system is in an ON condition to transmit the pitch cycle L to the pulse position searcher 119). When it is determined that the pitch cycle is not continuous (the difference between the pitch cycle in the present sub-frame and the pitch cycle in the immediately previous sub-frame exceeds the threshold value), the present sub-frame is regarded as not being the voiced/voiced stationary portion (as a unvoiced portion/voiced rising portion). The switch 115 transmits the predetermined fixed search positions to the pulse searcher 119, and does not transmit the pitch cycle L to the pulse position searcher (one system of the switch 115 is switched to the fixed search positions, while the other system is in an OFF condition so that the pitch cycle L is not transmitted to the pulse position searcher 119).

When the pulse position searcher 119 determines the optimum pulse position combination, the pulse sound source vector prepared by the combination is transmitted to the multiplier 124, multiplied by the pulse code vector gain and transmitted to the adder 125.

The pitch gain calculator 116 uses an impulse response of a filter which is obtained by cascade-connecting a quantization LPC synthesis filter in the present sub-frame and a filter for applying the auditory importance, the target vector and the adaptive code vector which is transmitted from the adaptive code book, to calculate the pitch gain (adaptive code vector gain) with the equation (5). The calculated pitch gain is quantized by the quantization unit 117, and transmitted to the determination unit 118 for determining the intensity of the pitch periodicity and the adders 120 and 122. In the adder 122, after the searching of the sound source code book (the searching of the adaptive code book and the searching of the noise code book (the pulse position searching in the embodiment)) is finished, a difference between the calculated optimum quantized pitch gain and the (first-stage) quantized pitch gain transmitted from the quantization unit 117 is calculated, and transmitted to the difference quantization unit 121. The adder 120 adds the difference value quantized by the difference quantization unit 121 to the first-stage quantized pitch gain transmitted from the quantization unit 117, and transmits the optimum quantized pitch gain to the multiplier 123.

The multiplier 123 multiplies the adaptive code vector transmitted from the adaptive code book 111 by the optimum quantized pitch gain, and transmits an output to the adder 125.

The adder 125 adds an adaptive code vector component and a pulse sound source vector component, and emits the activating sound source vector.

Additionally, in the embodiment, as the input to the determination unit 118, the first-stage quantized pitch gain in the present sub-frame is used. However, when a general gain quantization is performed (when the multi-stage quantization described in the embodiment is not performed), the quantized pitch gain (adaptive code vector gain) in the immediately previous sub-frame can be used as the input to the determination unit 118. Also, in the embodiment, the sound source generating portion of the pulse number variable type voice encoding device which has the pulse number determination unit has been described. Even in the pulse number fixed type which has no pulse number determination unit, however, the pulse search positions are effectively switched by using the pitch gain value to determine the intensity of the periodicity.

Tenth Embodiment

Figure 18:
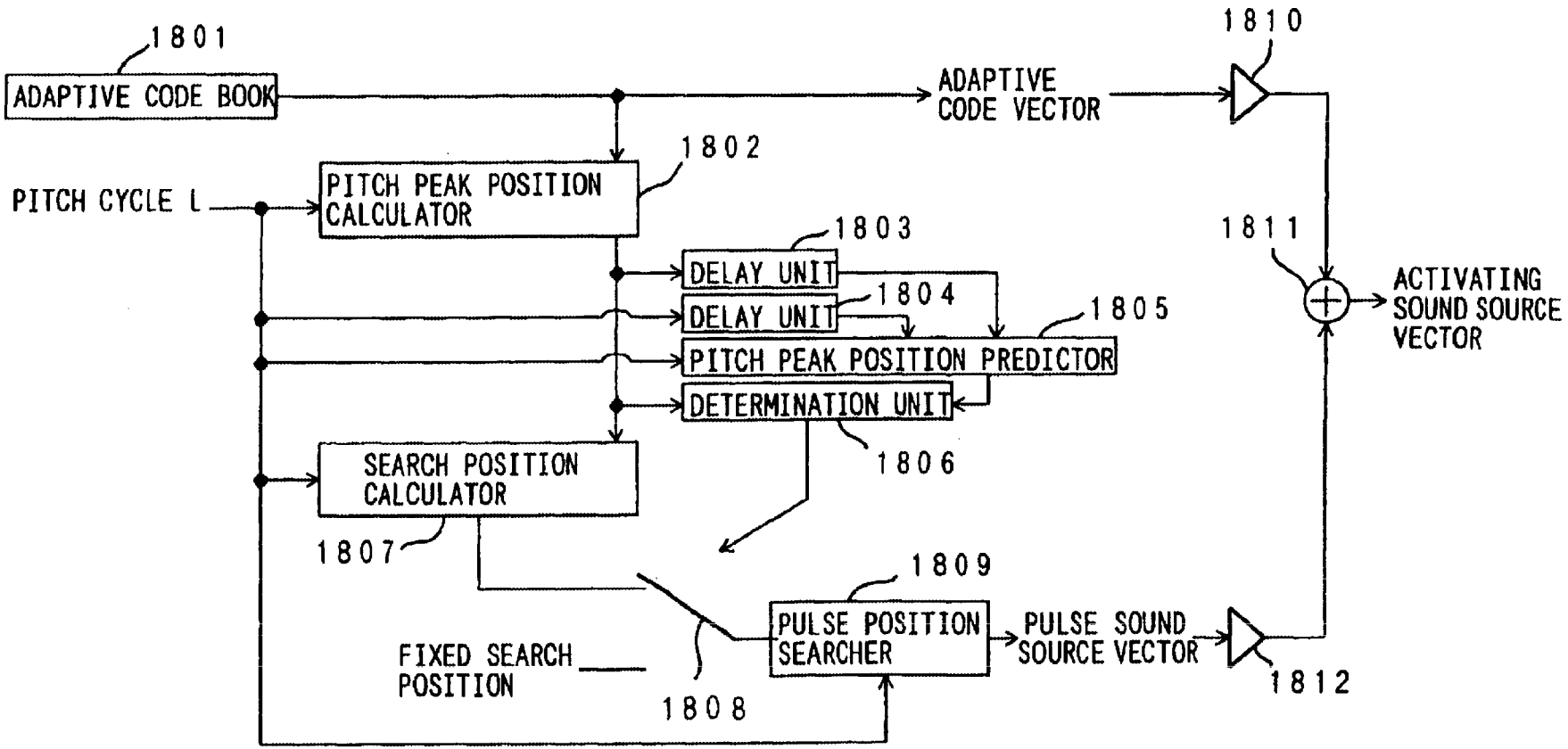
FIG. 18 is a block diagram showing a constitution of a sound source generating portion in a CELP type voice encoding device in a tenth embodiment of the invention.

FIG. 18 shows a tenth embodiment of the invention and a sound source generating portion of a voice encoding device which uses a phase continuity of sound source signal waveform between continuous sub-frames to switch backward a phase adaptation process of a noise code book. In FIG. 18, numeral 1801 denotes an adaptive code book which transmits an adaptive code vector to a pitch peak position calculator 1802 and a multiplier 1810; 1802 denotes the pitch peak position calculator which receives the adaptive code vector from the adaptive code book 1801 and the pitch cycle L and transmits a pitch peak position in the adaptive code vector to a delay unit 1803, a determination unit 1806 and a search position calculator 1807; 1803 denotes the delay unit which receives the pitch peak position from the pitch peak position calculator 1802, delays it by one sub-frame and transmits an output to a pitch peak position predictor 1805; 1804 denotes a delay unit which receives the pitch cycle L, delays it by one sub-frame and transmits an output to the pitch peak position predictor 1805; 1805 denotes the pitch peak position predictor which receives the pitch peak position in the immediately previous sub-frame from the delay unit 1803, the pitch cycle in the immediately previous sub-frame from the delay unit 1804 and the pitch cycle L in the present sub-frame and which transmits a predicted pitch peak position to the determination unit 1806; 1806 denotes the determination unit which receives the pitch peak position from the pitch peak position calculator 1802 and the predicted pitch peak position from the pitch peak position predictor 1805, determines whether or not there is a phase continuity between the immediately previous sub-frame and the present sub-frame and transmits a determination result to a switch 1808; 1807 denotes the search position calculator which receives the pitch peak position from the pitch peak position calculator 1802 and the pitch cycle L and transmits sound source pulse search positions via the switch 1808 to a pulse position searcher 1809; and 1808 denotes the switch which is switched based on the determination result from the determination unit 1806 and used for switching between the search positions transmitted from the search position calculator and predetermined fixed search positions. Numeral 1809 denotes the pulse position searcher which receives the sound source pulse search positions transmitted via the switch 1808 from the search position calculator 1807 or the fixed search positions transmitted via the switch 1808 and the pitch cycle L, respectively, which uses the received sound source pulse search positions and the pitch cycle L to search the sound source pulse position and which transmits a pulse sound source vector to a multiplier 1812; 1810 denotes the multiplier which multiplies the input of adaptive code vector from the adaptive code book 1801 by a quantized adaptive code vector gain and transmits an output to an adder 1811; 1812 denotes the multiplier which multiplies the input of pulse sound source vector from the pulse position searcher 1809 by a quantized pulse sound source vector gain and transmits an output to the adder 1811; and 1811 denotes the adder which receives the vectors from the multipliers 1810 and 1812, adds the respective received vectors and emits an activating sound source vector.

Operation of the sound source generating portion of the voice encoding device constructed as aforementioned will be described with reference to FIG. 18. The adaptive code book 1801 is constituted of the past activating sound source buffer, cuts out the relevant portion from the buffer of the activating sound source based on the pitch cycle or pitch lug which is obtained by outside pitch analysis or adaptive code book search means, and transmits the adaptive code vector to the pitch peak position calculator 1802 and the multiplier 1810. The adaptive code vector transmitted from the adaptive code book 1801 to the multiplier 1810 is multiplied by the quantized adaptive code vector gain quantized by an outside gain quantization unit, and transmitted to the adder 1811.

The pitch peak position calculator 1802 detects the pitch peak from the adaptive code vector, and transmits its position to the delay unit 1803, the determination unit 1806 and the search position calculator 1807, respectively. The pitch peak position can be detected (calculated) by maximizing a normalized correlation function of the impulse string vector arranged in the pitch cycle L and the adaptive code vector. Also, the pitch peak position can be detected more precisely by maximizing the normalized correlation function of the vector which is obtained by convoluting the impulse response of the synthesis filter in the impulse string vector arranged in the pitch cycle L and the vector which is obtained by convoluting the impulse response of the synthesis filter in the adaptive code vector. Further, by applying a post-processing in which a position having a maximum amplitude value in one pitch cycle waveform including the detected pitch peak position is used as the pitch peak, a second peak in one pitch cycle waveform can be prevented from being detected by mistake.

The delay unit 1803 delays the pitch peak position calculated by the pitch peak position calculator 1802 by one sub-frame and transmits an output to the pitch peak position predictor 1805. Specifically, to the pitch peak position predictor 1805 transmitted is the pitch peak position in the immediately previous sub-frame from the delay unit 1803. The delay unit 1804 delays the pitch cycle L by one sub-frame and transmits an output to the pitch peak position calculator 1805. Specifically, to the pitch peak position predictor 1805 transmitted is the pitch cycle in the immediately previous sub-frame from the delay unit 1804.

Figure 19:
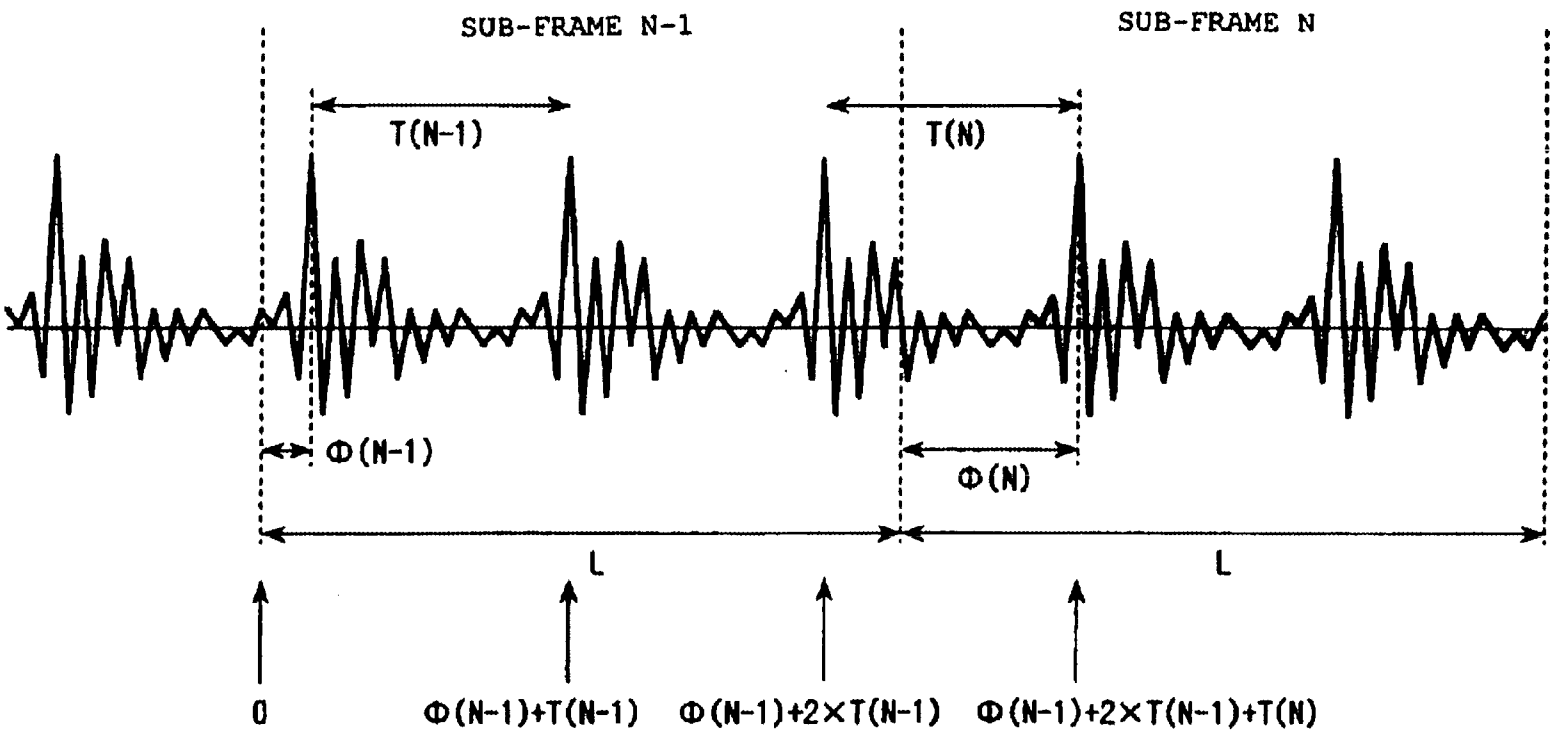
FIG. 19 is a diagrammatic representation showing a prediction principle in a pitch peak position predictor according to the tenth embodiment of the invention.

The pitch peak position predictor 1805 receives the pitch peak position in the immediately previous sub-frame from the delay unit 1803, the pitch cycle in the immediately previous sub-frame from the delay unit 1804 and the pitch cycle L in the present sub-frame, predicts the pitch peak position in the present sub-frame and transmits the predicted pitch peak position to the determination unit 1806. The predicted pitch peak position is obtained with equation (6) (Refer to FIG. 19).

$$\Phi(N)=\Phi(N-1)+n\times T(N-1)+T(N)-L,$$

$$n=INT((L-\Phi(N-1))/T(N-1)) \quad (6)$$

In the above equation, $\Phi(k)$ represents the first pitch peak position in the $k^{th}$ sub-frame while the top of the sub-frame is zero, T(k) represents the pitch cycle of a sound source (voice) signal in the $k^{th}$ sub-frame, and L represents a sub-frame length. Also, n is an integer value which represents how many pitch cycle lengths are included between the first pitch peak position ($\Phi(k)$) in the $k^{th}$ sub-frame and the last of the $k^{th}$ sub-frame (with decimal places truncated)(k=0, 1, 2, . . . ).

The determination unit 1806 receives the pitch peak position from the pitch peak position calculator 1802 and the predicted pitch peak position from the pitch peak position predictor 1805. When the pitch peak position is not largely deviated from the predicted pitch peak position, it is determined that the phase is continuous. When the pitch peak position is far different from the predicted pitch peak position, it is determined that the phase is not continuous.

Then, the determination result is transmitted to the switch 1808. Additionally, when the pitch peak position is compared with the predicted pitch peak position, the pitch peak position or the predicted pitch peak position may exist in the vicinity of the sub-frame boundary. In this case, also by considering a possibility that the position one pitch cycle after corresponds to the pitch peak position, the comparison of the pitch peak position and the predicted pitch peak position is performed to determine the phase continuity.

The search position calculator 1807 determines the sound source pulse search positions on the basis of the pitch peak position and transmits the search positions via the switch 1808 to the pulse position searcher 1809. The search positions are determined, as described in, for example, the sixth embodiment or the eighth embodiment, in such a manner that the search positions are distributed densely in the pitch peak vicinity and coarsely in the other portions. Additionally, as described in the sixth embodiment or the eighth embodiment, the using of the pitch cycle information to change the number of sound source pulses or to restrict the sound source pulse search range is also effectively performed.

The switch 1808 switches whether to perform the phase adaptive type sound source pulse searching based on the determination result of the determination unit 1806 or to perform the sound source pulse searching by using the fixed position (or the general noise code book searching). Specifically, when the determination result of the determination unit 1806 shows "there is a phase continuity", the search position calculator 1807 is connected to the pulse position searcher 1809. Then, the sound source pulse search positions calculated by the search position calculator 1807 are transmitted to the pulse position searcher 1809 (specifically, the phase adaptive type sound source pulse searching is performed). Conversely, when the determination result of the determination unit 1806 shows "there is no phase continuity", the switch is switched to transmit the fixed search positions to the pulse position searcher 1809 (when the switch is switched to the general noise code book searching, provided is a noise code book searcher, which is constituted to be switched to the pulse position searcher 1809).

The pulse position searcher 1809 determines the optimum combination of positions where pulses are raised by using the sound source pulse search positions which are determined by the search position calculator 1807 or the predetermined fixed search positions and the pitch cycle L which is separately transmitted. In the pulse searching method, as described in "ITU-T Recommendation G.729: Coding of Speech at 8 kbits/s using Conjugate-Structure Algebraic-Code-Excited Linear-Prediction (CS-ACELP), March 1996", for example, when the number of pulses is four, the combination from i0 to i3 is determined in such a manner that the equation (2) shown in the sixth embodiment is maximized. Additionally, the polarity of each sound source pulse at this time is predetermined before the pulse position searching is performed in such a manner that the polarity becomes equal to the polarity in each position of the target vector of a noise code book component, i.e., a signal vector which is obtained by subtracting from an input voice with auditory importance applied thereto a zero input response signal of a synthesis filter for applying the auditory importance and a signal of an adaptive code book component. Also, when the pitch cycle is shorter than the sub-frame length, as described in the fifth embodiment, by using a pitch-cycling filter, sound source pulses are made into a string of pitch cycle pulses, not impulses. In the aforementioned pitch-cycling process, the impulse response vector of the auditory importance applying synthesis filter is passed through the pitch-cycling filter beforehand. Then, in the same manner as the case where the pitch-cycling is not performed, by maximizing the equation (2), the sound source pulse can be searched. In the respective sound source pulse positions determined in this manner, pulses are raised in accordance with each determined polarity of each sound source pulse. Subsequently, by using the pitch cycle L and applying the pitch-cycling filter, the pulse sound source vector can be prepared. The prepared pulse sound source vector is transmitted to the multiplier 1812. The pulse sound source vector transmitted from the pulse position searcher 1809 to the multiplier 1812 is multiplied by the quantized pulse sound source vector gain quantized by the outside gain quantization unit, and transmitted to the adder 1811.

The adder 1811 performs a vector addition of an adaptive code vector component from the multiplier 1810 and a pulse sound source vector component from the multiplier 1812, and emits the activating sound source vector.

Additionally, according to the voice encoding device of the invention, in the portions other than the voiced stationary portion there easily arises a condition that the fixed search positions continue to be selected. Therefore, when the influence of an error in transmission line is propagated, the effect of resetting can be obtained. (In the case where the pulse position is represented in the relative position while the pitch peak position is zero, once the transmission line error arises, the content of the adaptive code book on the side of an encoder largely differs from that on the side of a decoder. Then in some case, even if there is no transmission line error in subsequent frames, a phenomenon arises in which the pitch peak position on the encoder continues not to coincide with that on the decoder. The influence of the error is thus prolonged.)

Also, for the way to raise pulses, the predetermined number of pulses, e.g., four pulses are raised in the search range, e.g., any of 32 places. In this case, as aforementioned, besides the method of searching all the combinations (8×8×8×8 ways) in such a manner that the 32 places are divided into four and one place is determined from the eight places in which one pulse is allocated, there are a method of searching all the combinations to select four places from the 32 places and other methods. Additionally, beside the combination of impulses with an amplitude 1, a combination of plural pulses, e.g., two or a pair of pulses, a combination of impulses with different amplitudes or another combination of pulses can be raised.

Eleventh Embodiment

Figure 20:
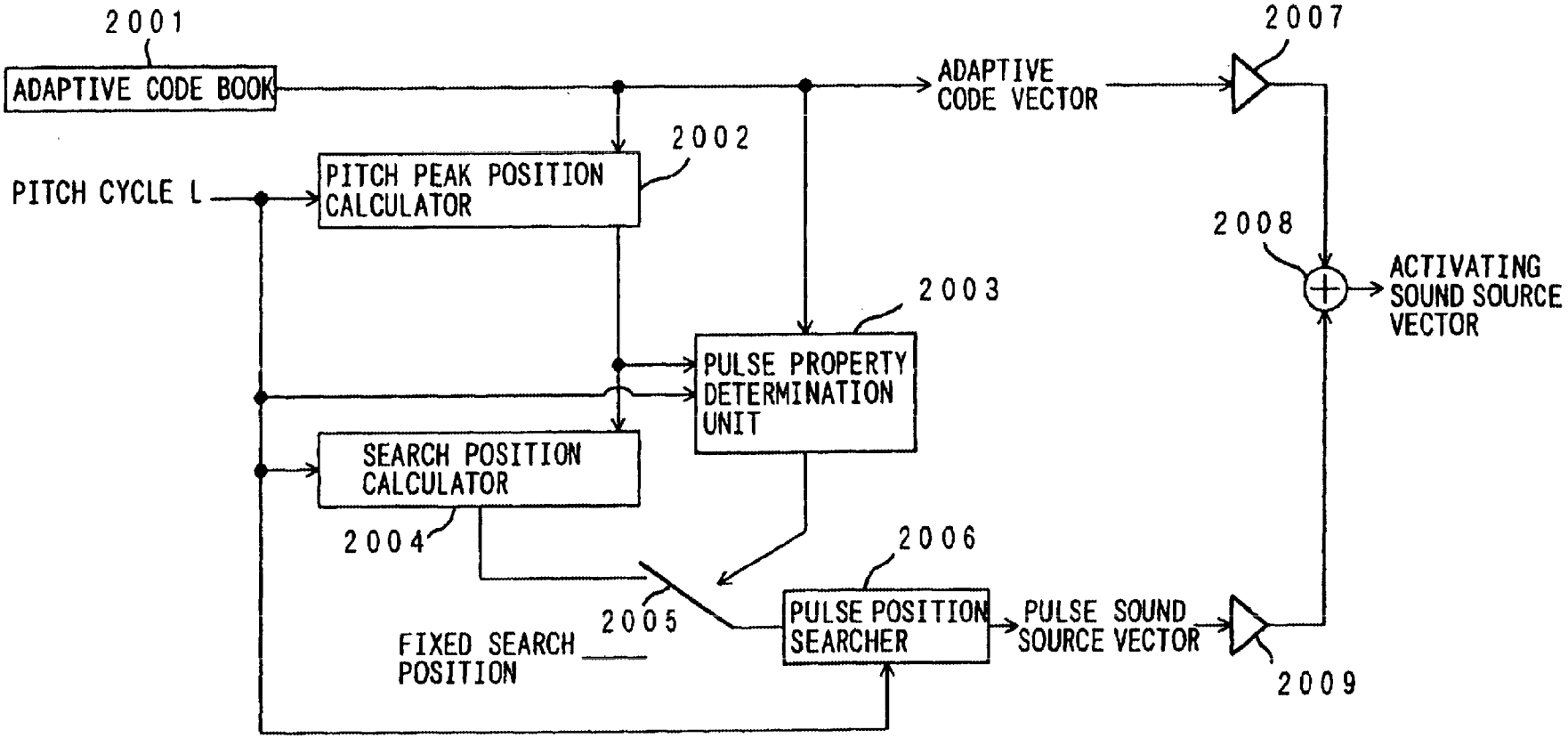
FIG. 20 is a block diagram showing a constitution of a sound source generating portion in a CELP type voice encoding device in an eleventh embodiment of the invention.

FIG. 20 shows an eleventh embodiment of the invention and a sound source generating portion of a CELP type voice encoding device which determines whether or not a strong pulse property exists in the configuration of an adaptive code vector to switch whether or not to perform a phase adaptation process. In FIG. 20, numeral 2001 denotes an adaptive code book which transmits an adaptive code vector to a pitch peak position calculator 2002, a pulse property determination unit 2003 and a multiplier 2007; 2002 denotes the pitch peak position calculator which receives the adaptive code vector from the adaptive code book 2001 and the pitch cycle L and transmits a pitch peak position in the adaptive code vector to the pulse property determination unit 2003 and a search position calculator 2004; 2003 denotes the pulse property determination unit which receives the adaptive code vector from the adaptive code book 2001, the pitch peak position from the pitch peak position calculator 2002 and the pitch cycle L from the outside, determines whether or not a good pulse property exists in the adaptive code vector and transmits a determination result to a switch 2005; 2004 denotes the search position calculator which receives the pitch cycle L from the outside and the pitch peak position from the pitch peak position calculator 2002 and transmits sound source pulse search positions via the switch 2005 to a pulse position searcher 2006; and 2005 denotes the switch which is switched based on the determination result from the pulse property determination unit 2003 and used for switching between the search positions transmitted from the search position calculator 2004 and predetermined fixed search positions. Numeral 2006 denotes the pulse position searcher which receives the sound source pulse search positions transmitted via the switch 2005 from the search position calculator 2004 or the fixed search positions transmitted via the switch 2005 and the pitch cycle L from the outside, respectively, which uses the received sound source pulse search positions and the pitch cycle L to search the sound source pulse position and which transmits a pulse sound source vector to a multiplier 2009; 2007 denotes the multiplier which multiplies the input of adaptive code vector from the adaptive code book 2001 by a quantized adaptive code vector gain and transmits an output to an adder 2008; 2009 denotes the multiplier which multiplies the input of pulse sound source vector from the pulse position searcher 2006 by a quantized pulse sound source vector gain and transmits an output to the adder 2008; and 2008 denotes the adder which receives the vectors from the multipliers 2007 and 2009, adds the respective received vectors and emits an activating sound source vector.

Operation of the sound source generating portion of the voice encoding device constructed as aforementioned will be described with reference to FIG. 20. The adaptive code book 2001 is constituted of the past activating sound source buffer, cuts out the relevant portion from the buffer of the activating sound source based on the pitch cycle or pitch lug which is obtained by outside pitch analysis or adaptive code book search means, and transmits the adaptive code vector to the pitch peak position calculator 2002, the pulse property determination unit 2003 and the multiplier 2007. The adaptive code vector transmitted from the adaptive code book 2001 to the multiplier 2007 is multiplied by the quantized adaptive code vector gain quantized by an outside gain quantization unit, and transmitted to the adder 2008.

The pitch peak position calculator 2002 detects the pitch peak from the adaptive code vector, and transmits its position to the pulse determination unit 2003 and the search position calculator 2004, respectively. The pitch peak position can be detected (calculated) by maximizing a normalized correlation function of the impulse string vector arranged in the pitch cycle L and the adaptive code vector. Also, the pitch peak position can be detected more precisely by maximizing the normalized correlation function of the vector which is obtained by convoluting the impulse response of the synthesis filter in the impulse string vector arranged in the pitch cycle L and the vector which is obtained by convoluting the impulse response of the synthesis filter in the adaptive code vector. Further, by applying a post-processing in which a position having a maximum amplitude value in one pitch cycle waveform including the detected pitch peak position is used as the pitch peak, a second peak in one pitch cycle waveform can be prevented from being detected by mistake.

The pulse property determination unit 2003 determines whether or not the signal power of the adaptive code vector is concentrated in the vicinity of the pitch peak position calculated by the pitch peak position calculator 2002. When the signal power is concentrated, the determination result "there is a pulse property" is transmitted to the switch 2005. When the concentration of signal power is not found, the determination result "there is no pulse property" is transmitted to the switch 2005. As a method of seeing whether or not the signal power is concentrated, for example, the following method is used. First, the adaptive code vector having one pitch cycle length in which the pitch peak position is included is cut out. Then, the power of the entire cut-out signal is calculated and used as PW0. Subsequently, the adaptive code vector having half to one third pitch length in the vicinity of the pitch peak position is cut out. Then, the cut-out signal power is calculated and used as PW1. When a value of PW1/ PW0 is a predetermined value or more (e.g., about 0.5 to 0.6), the signal power is concentration in the pitch peak vicinity. Therefore, it can be determined that the pulse property is high. Alternatively, in another determination method, the adaptive code vector is approximated with the impulse string vector arranged in a pitch cycle interval in which the first impulse is raised in the pitch peak position. In this case, an error between the impulse string vector and the adaptive code vector is used. Further, by maximizing the normalized correlation function of the vector which is obtained by convoluting the impulse response of the synthesis filter in the impulse string vector arranged in the pitch cycle L and the vector which is obtained by convoluting the impulse response of the synthesis filter in the adaptive code vector, the pitch peak position is obtained. In this case, in the determination method used is an error between the vector which is obtained by convoluting the impulse response of the synthesis filter in the impulse string vector arranged in the pitch cycle L and the vector which is obtained by convoluting the impulse response of the synthesis filter in the adaptive code vector. As means for evaluating the error between these vectors used are a prediction gain as shown in equation (7), the normalized correlation function as shown in equation (8) and the like. In the equations (7) and (8), x(n) is the adaptive code vector or the vector which is obtained by convoluting in the adaptive code vector the impulse response of the synthesis filter, while y(n) is the impulse string vector or the vector which is obtained by convoluting in impulse string vector the impulse response of the synthesis filter. In either equation, when the value is, for example, 0.3 to 0.4 or more, a pulse property strong to some degree is considered to exist in the adaptive code vector.

$$\frac{\left[\sum_{n=0}^{79} x(n)y(n)\right]^2}{\sum_{n=0}^{79} x(n)x(n) \times \sum_{n=0}^{79} y(n)y(n)} \tag{7}$$

$$\frac{\sum_{n=0}^{79} x(n)y(n)}{\sqrt{\sum_{n=0}^{79} y(n)y(n)}} \text{ or } \frac{\left[\sum_{n=0}^{79} x(n)y(n)\right]^2}{\sum_{n=0}^{79} y(n)y(n)} \tag{8}$$

The search position calculator 2004 determines the sound source pulse search positions on the basis of the pitch peak position and transmits the search positions via the switch 2005 to the pulse position searcher 2006. The search positions are determined, as described in, for example, the sixth embodiment or the eighth embodiment, in such a manner that the search positions are distributed densely in the pitch peak vicinity and coarsely in the other portions.

Additionally, as described in the sixth embodiment or the eighth embodiment, the using of the pitch cycle information to change the number of sound source pulses or to restrict the sound source pulse search range is also effectively performed.

The switch 2005 switches whether to perform the phase adaptive type sound source pulse searching based on the determination result of the pulse property determination unit 2003 or to perform the sound source pulse searching by using the fixed position. Specifically, when the determination result of the pulse property determination unit 2003 shows "there is a pulse property", the search position calculator 2004 is connected to the pulse position searcher 2006. Then, the sound source pulse search positions calculated by the search position calculator 2004 are transmitted to the pulse position searcher 2006 (specifically, the phase adaptive type sound source pulse searching is performed). Conversely, when the determination result of the pulse property determination unit 2003 shows "there is no pulse property", the switch is switched to transmit the fixed search positions to the pulse position searcher 2006.

The pulse position searcher 2006 determines the optimum combination of positions where pulses are raised by using the sound source pulse search positions which are determined by the search position calculator 2004 or the predetermined fixed search positions and the pitch cycle L which is separately transmitted. In the pulse searching method, as described in "ITU-T Recommendation G.729: Coding of Speech at 8 kbits/s using Conjugate-Structure Algebraic-Code-Excited Linear-Prediction (CS-ACELP), March 1996", for example, when the number of pulses is four, the combination from i0 to i3 is determined in such a manner that the equation (2) shown in the sixth embodiment is maximized. Additionally, the polarity of each sound source pulse at this time is predetermined before the pulse position searching is performed in such a manner that the polarity becomes equal to the polarity in each position of the target vector of a noise code book component, i.e., a signal vector which is obtained by subtracting from an input voice with auditory importance applied thereto a zero input response signal of a synthesis filter for applying the auditory importance and a signal of an adaptive code book component. Also, when the pitch cycle is shorter than the sub-frame length, as described in the fifth embodiment, by using a pitch-cycling filter, sound source pulses are made into a string of pitch cycle pulses, not impulses. In the aforementioned pitch-cycling process, the impulse response vector of the auditory importance applying synthesis filter is passed through the pitch-cycling filter beforehand. Then, in the same manner as the case where the pitch-cycling is not performed, by maximizing the equation (2), the sound source pulse can be searched. In the respective sound source pulse positions determined in this manner, pulses are raised in accordance with each determined polarity of each sound source pulse. Subsequently, by using the pitch cycle L and applying the pitch-cycling filter, the pulse sound source vector can be prepared. The prepared pulse sound source vector is transmitted to the multiplier 2009. The pulse sound source vector transmitted from the pulse position searcher 2006 to the multiplier 2009 is multiplied by the quantized pulse sound source vector gain quantized by the outside gain quantization unit, and transmitted to the adder 2008.

The adder 2008 performs a vector addition of an adaptive code vector component from the multiplier 1007 and a pulse sound source vector component from the multiplier 2009, and emits the activating sound source vector.

Additionally, according to the voice encoding device of the invention, in the portions other than the voiced stationary portion there easily arises a condition that the fixed search positions continue to be selected. Therefore, when the influence of an error in transmission line is propagated, the effect of resetting can be obtained. (in the case where the pulse position is represented in the relative position while the pitch peak position is zero, once the transmission line error arises, the content of the adaptive code book on the side of an encoder largely differs from that on the side of a decoder. Then in some case, even if there is no transmission line error in subsequent frames, a phenomenon arises in which the pitch peak position on the encoder continues not to coincide with that on the decoder. The influence of the error is thus prolonged.)

Also, for the way to raise pulses, the predetermined number of pulses, e.g., four pulses are raised in the search range, e.g., any of 32 places. In this case, as aforementioned, besides the method of searching all the combinations (8×8×8×8 ways) in such a manner that the 32 places are divided into four and one place is determined from the eight places in which one pulse is allocated, there are a method of searching all the combinations to select four places from the 32 places and other methods. Additionally, beside the combination of impulses with an amplitude 1, a combination of plural pulses, e.g., two or a pair of pulses, a combination of impulses with different amplitudes or another combination of pulses can be raised.

Twelfth Embodiment

Figure 21:
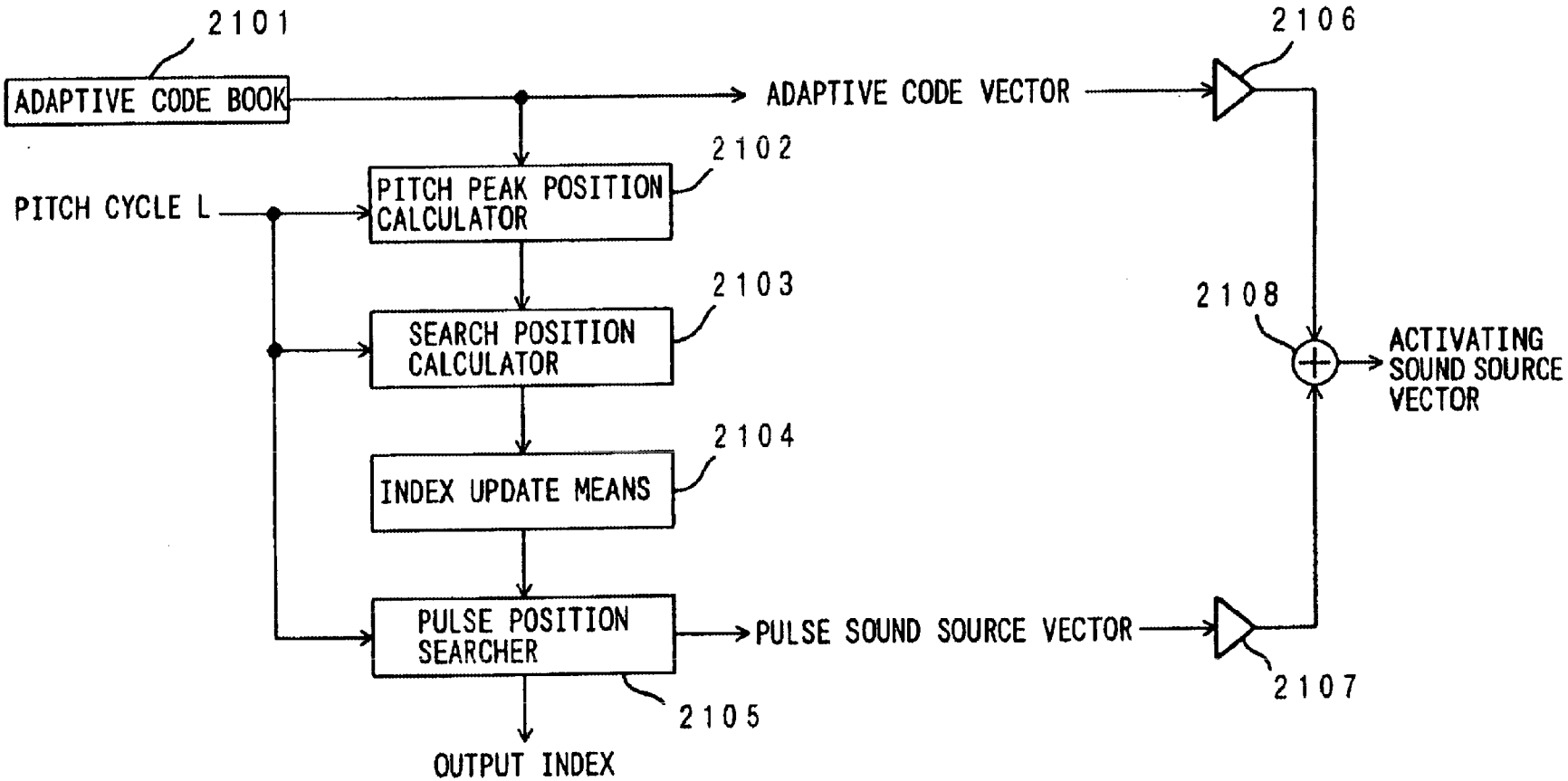
FIG. 21 is a block diagram showing a constitution of a sound source generating portion in a CELP type voice encoding device in a twelfth embodiment of the invention.

FIG. 21 shows a twelfth embodiment of the invention and a sound source generating portion on an encoder side of a CELP type voice encoding device which is provided with an index update means for updating indexes of pulse search positions and which determines a pulse position search range in accordance with a pitch cycle and pitch peak position of an adaptive code vector. More specifically, in the CELP type voice encoding device which performs a sound source pulse searching in positions relative to the pitch peak position, by indexing pulse positions in order from the top of a sub-frame, the influence of a transmission line error which arises in some frame is prevented from being propagated to subsequent frames with no transmission line error. Such sound source generating portion is shown.

In FIG. 21, numeral 2101 denotes an adaptive code book which stores the past activating sound source vector and transmits a selected adaptive code vector to a pitch peak position calculator 2102 and a pitch gain multiplier 2106; 2102 denotes the pitch peak position calculator which receives the adaptive code vector from the adaptive code book 2101 and the pitch cycle L, calculates a pitch peak position and transmits an output to a search position calculator 2103; 2103 denotes the search position calculator which receives the pitch peak position from the pitch peak position calculator 2102 and the pitch cycle L, calculates a pulse sound source search range and transmits an output to an index update means 2104; 2104 denotes the index update means which updates an index of each pulse position of the sound source transmitted from the search position calculator 2103 and transmits an output to a pulse position searcher 2105; 2105 denotes a pulse position searcher which receives search positions (with the updated indexes indicative of pulse positions) from the index update means 2104 and the pitch cycle L separately calculated outside the sound source generating portion, searches the pulse sound source, transmits a pulse sound source vector to a pulse sound source gain multiplier 2107 and transmits the index indicative of the pulse sound source vector as an encoded output to the outside of the sound source generating portion; 2106 denotes the multiplier which multiplies the adaptive code vector from the adaptive code book 2101 by an adaptive code vector gain and transmits an output to an adder 2108; 2107 denotes the multiplier which multiplies the pulse sound source vector from the pulse position searcher 2105 by a pulse sound source vector gain and transmits an output to the adder 2108; and 2108 denotes the adder which receives the output from the multiplier 2106 and the output from the multiplier 2107, performs a vector addition and emits an activating sound source vector.

Figure 22:
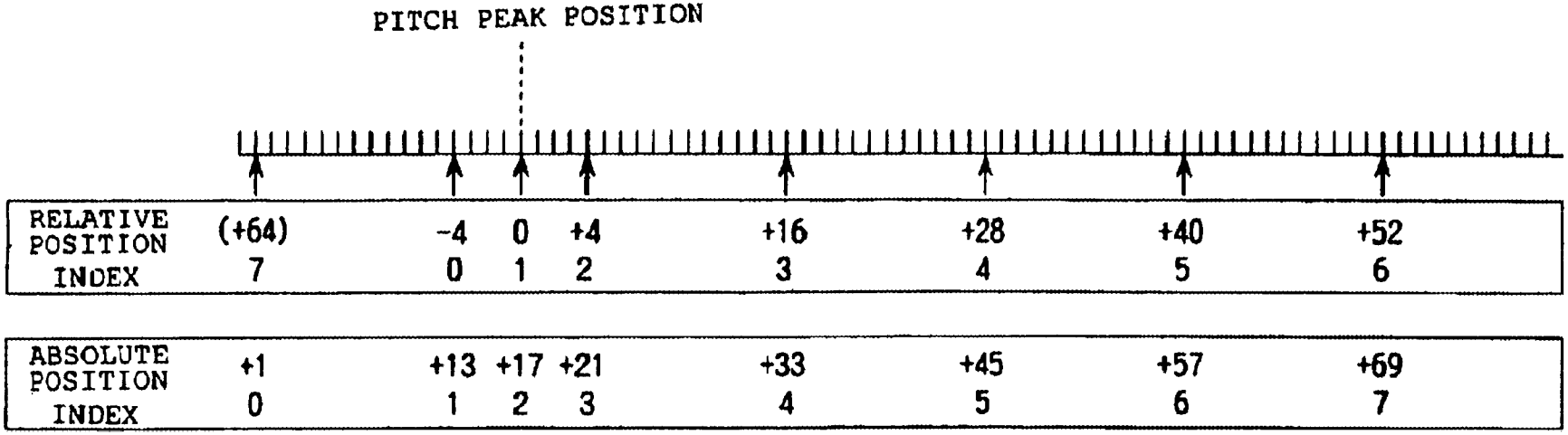
FIG. 22 is a diagrammatic representation showing a search position pattern of a certain sound source pulse transmitted by a search position calculator in the twelfth embodiment of the invention, an index for each position in the case where there is not provided an index update means and an index for each position in the case where the index update means is provided.

Operation of the sound source generating portion constructed as aforementioned will be described with reference to FIGS. 21 and 22. In FIG. 21, the adaptive code book 2101 cuts out the adaptive code vector having only the sub-frame length from a point which is taken back toward the past only by the pitch cycle L calculated beforehand outside the sound source generating portion, and emits the adaptive code vector. When the pitch cycle L is less than the sub-frame length, the cut-out vectors each having the pitch cycle L are repeatedly connected until the sub-frame length is reached. Then, the connected vector is emitted as the adaptive code vector.

The pitch peak position calculator 2102 uses the adaptive code vector transmitted from the adaptive code book 2101 to determine the pitch peak position which exists in the adaptive code vector. The pitch peak position can be determined by maximizing a normalized correlation of the impulse string arranged in the pitch cycle and the adaptive code vector. Also, the pitch peak position can be obtained more precisely by minimizing an error between the impulse string arranged in the pitch cycle which has been passed through the synthesis filter and the adaptive code vector which has been passed through the synthesis filter.

The search position calculator 2103 determines the sound source pulse search positions on the basis of the pitch peak position and transmits an output to the index update means 2104. The search positions are determined, as described in, for example, the fifth embodiment or the sixth embodiment, in such a manner that the search positions are distributed densely in the pitch peak vicinity and coarsely in the other portions. Additionally, as described in the sixth embodiment or the eighth embodiment, the pitch cycle information is used to change the number of sound source pulses or to restrict the sound source pulse search range. This is also effectively applied. Concrete examples of the search positions which are determined by the search position calculator 2103 are shown in FIGS. 10, 11(*b*), 11(*c*) and 13. For example, in FIG. 10, the search positions are distributed densely in the pitch pulse position vicinity and coarsely in the other portions. The method of restricting the pulse position search range is shown concretely. The restriction method is based on the statistical result that positions with a high probability of raising pulses are concentrated in the pitch pulse vicinity. When the pulse position search range is not restricted, in the voiced portion a probability that pulses are raised in the pitch pulse vicinity is higher than a probability that pulses are raised in the other portions. Additionally, the search position calculator calculates sound source pulse search positions by using positions relative to the pitch peak position. At this time, positions are indexed in order from the position which has a smaller numerical relative position value while the pitch peak position is zero (refer to FIG. 22). Additionally, FIG. 22 shows the case where the number of pulses is four, which corresponds the case in FIG. 13(*a*)).

The index update means 2104 converts the sound source pulse search positions (relative positions in FIG. 22) which are indexed in order from the position with a smaller value relative to the pitch peak position to absolute positions with the top of sub-frame being zero. Subsequently, indexes are updated in order from a smaller absolute position value (absolute positions in FIG. 22). The absolute positions are transmitted to the pulse position searcher 2105. Therefore, if the encoder side differs from the decoder side in calculated pitch peak position because of the transmission line error or the like, a deviation in pulse positions can be minimized.

The pulse position searcher 2105 uses the sound source pulse search positions which have the indexes indicative of respective search positions updated by the index update means 2104 and the pitch cycle L which is separately transmitted to determine the optimum combination of positions where sound source pulses are raised. In the pulse searching method, as described in "ITU-T Recommendation G.729: Coding of Speech at 8 kbits/s using Conjugate-Structure Algebraic-Code-Excited Linear-Prediction (CS-ACELP), March 1996", for example, when the number of pulses is four, the combination from i0 to i3 is determined in such a manner that the equation (2) shown in the sixth embodiment is maximized. Additionally, the polarity of each sound source pulse at this time is predetermined before the pulse position searching is performed in such a manner that the polarity becomes equal to the polarity in each position of the target vector of a noise code book component, i.e., a signal vector which is obtained by subtracting from an input voice with auditory importance applied thereto a zero input response signal of a synthesis filter for applying the auditory importance and a signal of an adaptive code book component. Then, the quantity of arithmetic operation for the searching can be largely reduced. Also, when the pitch cycle is shorter than the sub-frame length, as described in the fifth embodiment, by using a pitch-cycling filter, sound source pulses are made into a string of pitch cycle pulses, not impulses. In the aforementioned pitch-cycling process, the impulse response vector of the auditory importance applying synthesis filter is passed through the pitch-cycling filter beforehand. Then, in the same manner as the case where the pitch-cycling is not performed, by maximizing the equation (2), the sound source pulse can be searched. In the respective sound source pulse positions determined in this manner, pulses are raised in accordance with each determined polarity of each sound source pulse. Subsequently, by using the pitch cycle L and applying the pitch-cycling filter, the pulse sound source vector can be prepared. The prepared pulse sound source vector is transmitted to the multiplier 2107. The pulse sound source vector transmitted from the pulse position searcher 2105 to the multiplier 2107 is multiplied by the quantized pulse sound source vector gain quantized by the outside gain quantization unit, and transmitted to the adder 2108. Additionally, in the pulse position searcher 2105, together with the pulse sound source vector, the polarity of each sound source pulse indicative of the pulse sound source vector and index information are separately transmitted to the outside of the sound source generating portion. The sound source pulse polarity and the index information are passed through an encoder, a multiplex unit and the like, converted to a series of data to be fed to a transmission line, and transmitted to the transmission line.

The adder 2108 adds an adaptive code vector component from the multiplier 2106 and a pulse sound source vector component from the multiplier 2107, and emits the activating sound source vector.

Additionally, the method of allocating the indexes based on the embodiment can be applied to all the cases where sound source position information is represented by relative values. Only the way of allocating the indexes differs. Therefore, without influencing the performance, the propagation of transmission line error can be effectively inhibited.

Further, the side of the decoder is provided with the index update means in the same manner as on the side of encoder. Also, for the way to raise pulses, the predetermined number of pulses, e.g., four pulses are raised in the search range, e.g., any of 32 places. In this case, as aforementioned, besides the method of searching all the combinations (8×8×8×8 ways) in such a manner that the 32 places are divided into four and one place is determined from the eight places in which one pulse is allocated, there are a method of searching all the combinations to select four places from the 32 places and other methods. Additionally, beside the combination of impulses with an amplitude 1 , a combination of plural pulses, e.g., two or a pair of pulses, a combination of impulses with different amplitudes or another combination of pulses can be raised.

Thirteenth Embodiment

Figure 23:
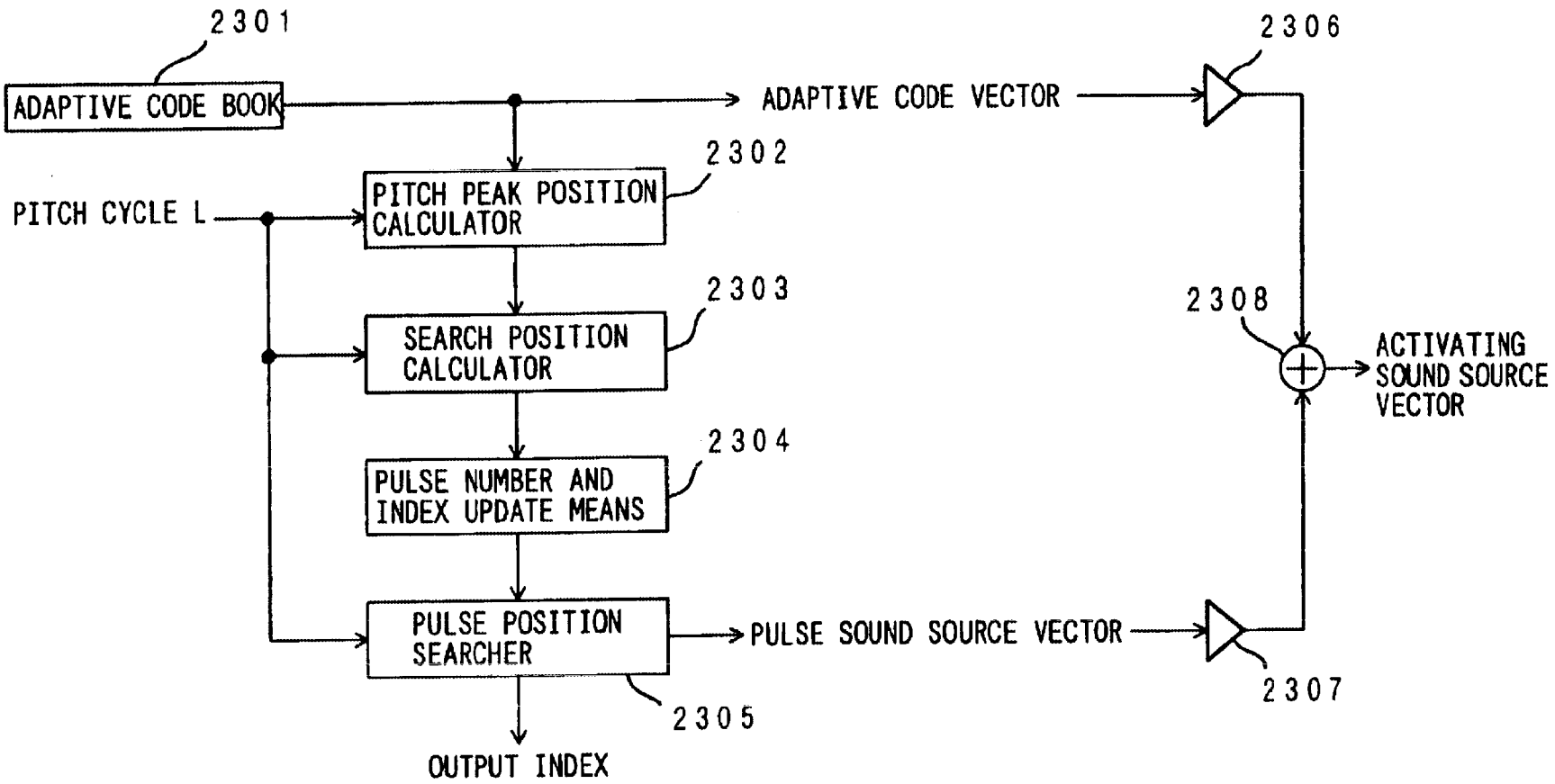
FIG. 23 is a block diagram showing a constitution of a sound source generating portion in a CELP type voice encoding device in a thirteenth embodiment of the invention.

FIG. 23 shows a thirteenth embodiment of the invention and a sound source generating portion on an encoder side of a CELP type voice encoding device which is provided with a pulse number and index update means for allocating indexes and pulse numbers to pulse search positions and which determines a pulse position search-range in accordance with a pitch cycle and pitch peak position of an adaptive code vector. More specifically, in the CELP type voice encoding device which performs a sound source pulse searching in positions relative to the pitch peak position, pulse positions are indexed in order from the top of a sub-frame, while pulses which have the same index number but different numbers are given pulse numbers in order from the top of the sub-frame. Specifically, in the case of the same index number, a smaller pulse number indicates that the relevant pulse is positioned toward the top of the sub-frame. By determining the respective pulse numbers in this manner, the influence of a transmission line error which arises in some frame is prevented from being propagated to subsequent frames with no transmission line error. Such sound source generating portion is shown.

In FIG. 23, numeral 2301 denotes an adaptive code book which stores the past activating sound source vector and transmits a selected adaptive code vector to a pitch peak position calculator 2302 and a pitch gain multiplier 2306; 2302 denotes the pitch peak position calculator which receives the adaptive code vector from the adaptive code book 2301 and the pitch cycle L, calculates a pitch peak position and transmits an output to a search position calculator 2303; 2303 denotes the search position calculator which receives the pitch peak position from the pitch peak position calculator 2302 and the pitch cycle L, calculates a pulse sound source search range and transmits an output to a pulse number and index update means 2304; 2304 denotes the pulse number and index update means which updates each sound source pulse number and an index of each pulse position of the sound source transmitted from the search position calculator 2303 and transmits an output to a pulse position searcher 2305; 2305 denotes a pulse position searcher which receives search positions (with the pulse numbers and the indexes indicative of the pulse positions both updated) from the pulse number and index update means 2304 and the pitch cycle L separately calculated outside the sound source generating portion, searches the pulse sound source, transmits a pulse sound source vector to a pulse sound source gain multiplier 2307 and transmits the index indicative of the pulse sound source vector as an encoded output to the outside of the sound source generating portion; 2306 denotes the multiplier which multiplies the adaptive code vector from the adaptive code book 2301 by an adaptive code vector gain and transmits an output to an adder 2308; 2307 denotes the multiplier which multiplies the pulse sound source vector from the pulse position searcher 2305 by a pulse sound source vector gain and transmits an output to the adder 2308; and 2308 denotes the adder which receives the output from the multiplier 2306 and the output from the multiplier 2307, performs a vector addition and emits an activating sound source vector.

Operation of the sound source generating portion constructed as aforementioned will be described with reference to FIGS. 23 and 24. In FIG. 23, the adaptive code book 2301 cuts out the adaptive code vector having only the sub-frame length from a point which is taken back toward the past only by the pitch cycle L calculated beforehand outside the sound source generating portion, and emits the adaptive code vector. When the pitch cycle L is less than the sub-frame length, the cut-out vectors each having the pitch cycle L are repeatedly connected until the sub-frame length is reached. Then, the connected vector is emitted as the adaptive code vector.

The pitch peak position calculator 2302 uses the adaptive code vector transmitted from the adaptive code book 2301 to determine the pitch peak position which exists in the adaptive code vector. The pitch peak position can be determined by maximizing a normalized correlation of the impulse string arranged in the pitch cycle and the adaptive code vector. Also, the pitch peak position can be obtained more precisely by minimizing an error between the impulse string arranged in the pitch cycle which has been passed through the synthesis filter and the adaptive code vector which has been passed through the synthesis filter.

The search position calculator 2303 determines the sound source pulse search positions on the basis of the pitch peak position and transmits an output to the pulse number and index update means 2304. The search positions are determined, as described in, for example, the sixth embodiment or the eighth embodiment, in such a manner that the search positions are distributed densely in the pitch peak vicinity and coarsely in the other portions. Additionally, as described in the sixth embodiment or the eighth embodiment, the pitch cycle information is used to change the number of sound source pulses or to restrict the sound source pulse search range. This is also effectively applied. Concrete examples of the search positions which are determined by the search position calculator 2303 are shown in FIGS. 10, 11(*b*), 11(*c*) and 13. For example, in FIG. 10, the search positions are distributed densely in the pitch pulse position vicinity and coarsely in the other portions. The method of restricting the pulse position search range is shown concretely. The restriction method is based on the statistical result that positions with a high probability of raising pulses are concentrated in the pitch pulse vicinity. When the pulse position search range is not restricted, in the voiced portion a probability that pulses are raised in the pitch pulse vicinity is higher than a probability that pulses are raised in the other portions. Additionally, the search position calculator calculates sound source pulse search positions by using positions relative to the pitch peak position. At this time, positions are given pulse numbers and indexed in order from the position which has a smaller numerical relative position value while the pitch peak position is zero (refer to FIG. 24(*b*)). Additionally, FIG. 24 shows the case where the number of pulses is four, which corresponds the case in FIG. 11(*b*) or 13. FIG. 24(*a*) shows the sound source pulse search positions which are determined by the search position calculator 2103 when the number of pulses is four. Also, in relative positions in FIG. 24(*a*), while the pitch peak position is zero, respective sample points are represented by numeric values from −4 to +75. The points before −4 are represented by plus numeric values by folding back the points extended behind the sub-frame boundary.

Figure 24:
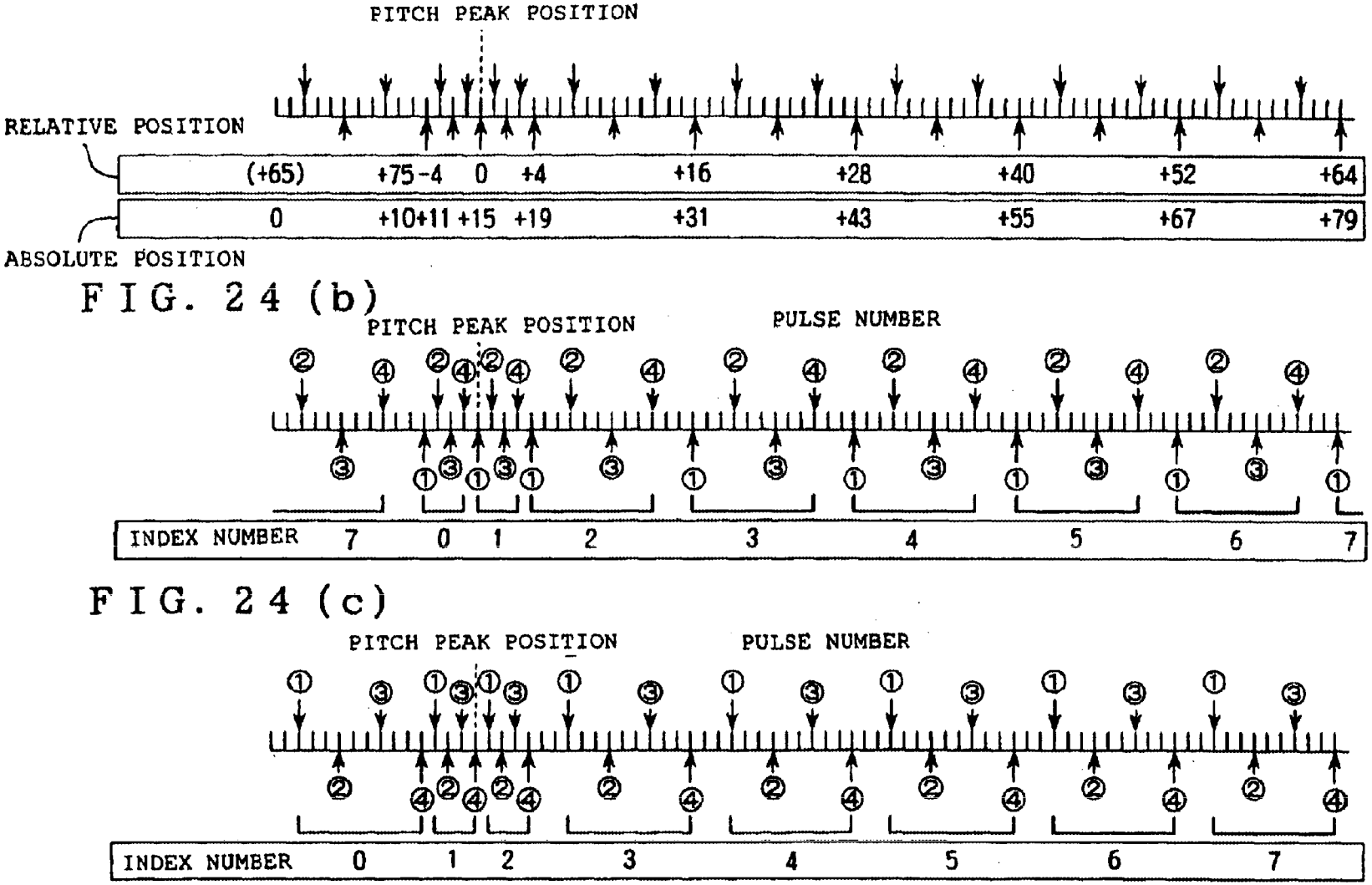
FIG. 24(*a*) is a diagrammatic representation showing a search position pattern of a sound source pulse which is transmitted by a search position calculator in the thirteenth embodiment of the invention and a correspondence between a relative position and an absolute position of each position.

The pulse number and index update means 2304 converts the sound source pulse search positions (FIG. 24(*b*)) which are indexed in order from the position with a smaller value relative to the pitch peak position into absolute positions with the top of sub-frame being zero. Subsequently, pulse numbers and indexes are updated in order from a smaller absolute position value (FIG. 24(*c*)). The positions are transmitted to the pulse position searcher 2305. Therefore, if the encoder side differs from the decoder side in calculated pitch peak position because of the transmission line error or the like, a deviation in pulse positions can be minimized.

The pulse position searcher 2305 uses the sound source pulse search positions which have the indexes indicative of respective search positions updated by the pulse number and index update means 2304 and the pitch cycle L which is separately transmitted, to determine the optimum combination of positions where sound source pulses are raised. In the pulse searching method, as described in "ITU-T Recommendation G.729: Coding of Speech at 8 kbits/s using Conjugate-Structure Algebraic-Code-Excited Linear-Prediction (CS-ACELP), March 1996", for example, when the number of pulses is four, the combination from i0 to i3 is determined in such a manner that the equation (2) shown in the sixth embodiment is maximized. Additionally, the polarity of each sound source pulse at this time is predetermined before the pulse position searching is performed in such a manner that the polarity becomes equal to the polarity in each position of the target vector of a noise code book component, i.e., a signal vector which is obtained by subtracting from an input voice with auditory importance applied thereto a zero input response signal of a synthesis filter for applying the auditory importance and a signal of an adaptive code book component. Then, the quantity of arithmetic operation for the searching can be largely reduced. Also, when the pitch cycle is shorter than the sub-frame length, as described in the fifth embodiment, by applying a pitch-cycling filter, sound source pulses are made into a string of pitch cycle pulses, not impulses. In the aforementioned pitch-cycling process, the impulse response vector of the auditory importance applying synthesis filter is passed through the pitch-cycling filter beforehand. Then, in the same manner as the case where the pitch-cycling is not performed, by maximizing the equation (2), the sound source pulse can be searched. In the respective sound source pulse positions determined in this manner, pulses are raised in accordance with each determined polarity of each sound source pulse. Subsequently, by using the pitch cycle L and applying the pitch-cycling filter, the pulse sound source vector can be prepared. The prepared pulse sound source vector is transmitted to the multiplier 2307. The pulse sound source vector transmitted from the pulse position searcher 2305 to the multiplier 2307 is multiplied by the quantized pulse sound source vector gain quantized by the outside gain quantization unit, and transmitted to the adder 2308. Additionally, in the pulse position searcher 2305, together with the pulse sound source vector, the polarity of each sound source pulse indicative of the pulse sound source vector and index information are separately transmitted to the outside of the sound source generating portion. The sound source pulse polarity and the index information are passed through an encoder, a multiplex unit and the like, converted to a series of data to be fed to a transmission line, and transmitted to the transmission line.

The adder 2308 performs a vector addition of an adaptive code vector component from the multiplier 2306 and a pulse sound source vector component from the multiplier 2307, and emits the activating sound source vector.

Additionally, the method of allocating the indexes based on the embodiment can be applied to all the cases where sound source position information is represented by relative values. Only the way of allocating the pulse numbers and indexes differs. Therefore, without influencing the performance, the propagation of transmission line error can be effectively inhibited. Also, by switching and operating the pulse sound source with the fixed search positions, the propagation of the influence of the transmission line error can also be inhibited.

Further, the side of the decoder is provided with the similar pulse number and index update means 2304. Also, for the way to raise pulses, the predetermined number of pulses, e.g., four pulses are raised in the search range, e.g., any of 32 places. In this case, as aforementioned, besides the method of searching all the combinations (8×8×8×8 ways) in such a manner that the 32 places are divided into four and one place is determined from the eight places in which one pulse is allocated, there are a method of searching all the combinations to select four places from the 32 places and other methods. Additionally, beside the combination of impulses with an amplitude 1 , a combination of plural pulses, e.g., two or a pair of pulses, a combination of impulses with different amplitudes or another combination of pulses can be raised.

Fourteenth Embodiment

Figure 25:
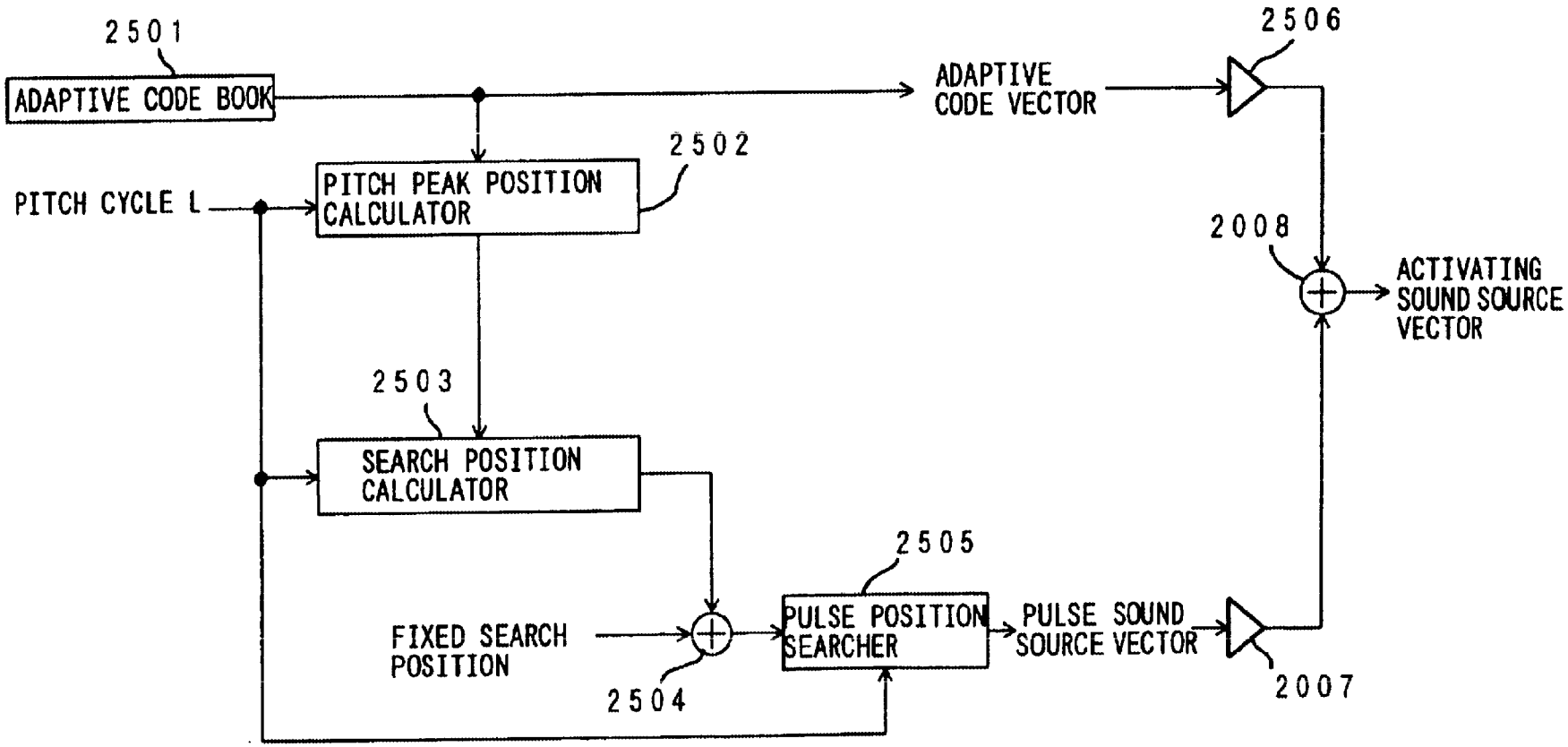
FIG. 25 is a block diagram showing a constitution of a sound source generating portion in a CELP type voice encoding device in a fourteenth embodiment of the invention.

FIG. 25 shows a fourteenth embodiment of the invention and a sound source generating portion of a CELP type voice encoding device which uses sound source pulse search positions constituted both of fixed search positions and phase adaptive type search positions to search pulses.

In FIG. 25, numeral 2501 denotes an adaptive code book which stores the past activating sound source vector and transmits a selected adaptive code vector to a pitch peak position calculator 2502 and a pitch gain multiplier 2506; 2502 denotes the pitch peak position calculator which receives the adaptive code vector from the adaptive code book 2501 and the pitch cycle L transmitted from the outside, calculates a pitch peak position and transmits an output to a search position calculator 2503; 2503 denotes the search position calculator which receives the pitch peak position from the pitch peak position calculator 2502 and the pitch cycle L from the outside, calculates pulse sound source search positions and transmits an output to an adder 2504; 2504 denotes the adder which combines the search positions transmitted from the search position calculator 2503 and represented by relative positions with the pitch peak position being zero and search positions used for searching fixed positions (not performing a numeric value addition, but obtaining a union of sets of two types of search positions) and transmits an output to a pulse position searcher 2505; 2505 denotes the pulse position searcher which receives the search positions from the adder 2504 and the pitch cycle L separately calculated outside the sound source generating portion, searches the pulse sound source and transmits a pulse sound source vector to a pulse sound source gain multiplier 2507; 2506 denotes the multiplier which multiplies the adaptive code vector from the adaptive code book

2501 by an adaptive code vector gain and transmits an output to an adder 2508; 2507 denotes the multiplier which multiplies the pulse sound source vector from the pulse position searcher 2505 by a pulse sound source vector gain and transmits an output to the adder 2508; and 2508 denotes the adder which receives the output from the multiplier 2506 and the output from the multiplier 2507, performs a vector addition and emits an activating sound source vector.

Operation of the sound source generating portion constructed as aforementioned will be described with reference to FIGS. 25 and 26. In FIG. 25, the adaptive code book 2501 cuts out the adaptive code vector having only the sub-frame length from a point which is taken back toward the past only by the pitch cycle L calculated beforehand outside the sound source generating portion, and emits the adaptive code vector. When the pitch cycle L is less than the sub-frame length, the cut-out vectors each having the pitch cycle L are repeatedly connected until the sub-frame length is reached. Then, the connected vector is emitted as the adaptive code vector.

The pitch peak position calculator 2502 uses the adaptive code vector transmitted from the adaptive code book 2501 to determine the pitch peak position which exists in the adaptive code vector. The pitch peak position can be determined by maximizing a normalized correlation of the impulse string arranged in the pitch cycle and the adaptive code vector. Also, the pitch peak position can be obtained more precisely by minimizing an error (maximizing the normalized correlation function) of the impulse string arranged in the pitch cycle which has been passed through the synthesis filter and the adaptive code vector which has been passed through the synthesis filter.

The search position calculator 2503 determines the sound source pulse search positions on the basis of the pitch peak position and transmits an output to the adder 2504. The search positions are determined, as shown in, for example, FIG. 26, in such a manner that points which do not overlap the fixed search positions in the pitch peak vicinity are emitted. Additionally, as described in the sixth embodiment or the eighth embodiment, the pitch cycle information is used to change the number of sound source pulses or to restrict the sound source pulse search range. This is also applied in the same manner. Concrete examples of the search positions which are determined by the search position calculator 2503 are shown in FIGS. 26(*b*) and 26(*c*). For example, in FIG. 26, the fixed search positions are set on odd sample points (FIG. 26(*a*)). It shows that the search position calculator 2503 sets the search positions on even sample points in the pitch peak vicinity (FIG. 26(*b*), 26(*c*)). FIG. 26(*b*) shows that the pitch peak position exists on the even sample point (the pitch peak position is not included in the fixed search positions), and FIG. 26(*c*) shows that the pitch peak position exists on the odd sample point (the pitch peak position is included in the fixed search positions), respectively. As seen from a comparison of FIGS. 26(*b*) and 26(*c*), depending on where the pitch peak position is, the search positions (relative positions when the pitch peak position is zero) slightly differ.

Figure 26:
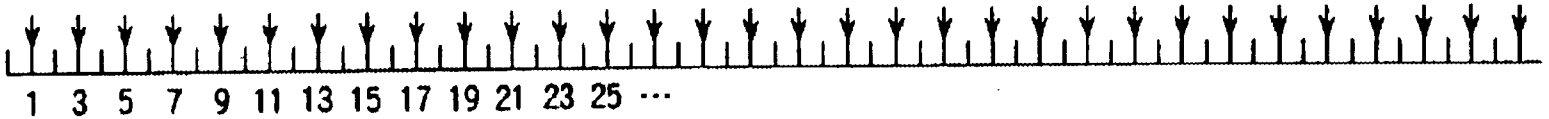
FIG. 26(*a*) is a diagrammatic representation showing an example of a fixed search position pattern for use in the fourteenth embodiment of the invention.
Figure 26:
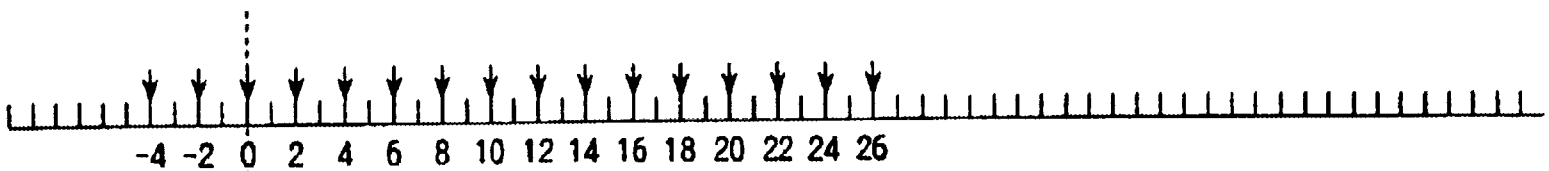
Figure 26:
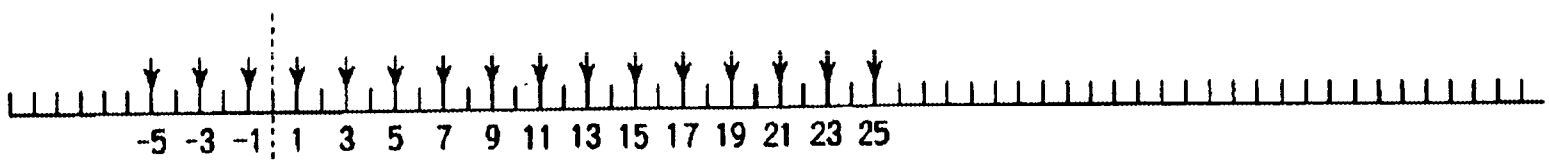
Figure 26:
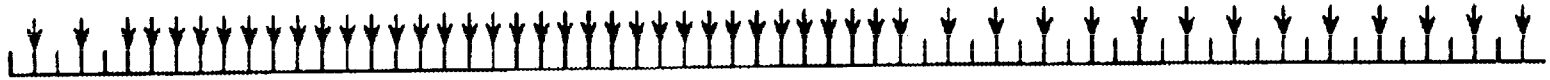

The adder 2504 obtains the union of set (FIG. 26(*d*)) of the set (FIG. 26(*b*), 26(*c*)) of the sound source pulse search positions transmitted from the search position calculator 2503 and the set (FIG. 26(*a*)) of the predetermined fixed search positions, and transmits an output to the pulse position searcher 2505. In this manner, the sound source pulse search positions are restricted in such a manner that they become dense in the vicinity of the pitch peak position and coarse in the other portions. The restriction method is based on the statistical result that positions with a high probability of raising pulses are concentrated in the pitch pulse vicinity. When the pulse position search range is not restricted, in the voiced portion a probability that pulses are raised in the pitch pulse vicinity is higher than a probability that pulses are raised in the other portions. Additionally, by the influence of a transmission line error or the like, the pitch peak position is wrongly calculated on the side of the decoder. In this case, the sound source pulse search positions calculated by the search position calculator 2503 differ on the encoder side and on the decoder side. However, a part of the sound source pulse search positions transmitted to the pulse position searcher 2505 correspond to the fixed search positions. Therefore, a probability that the encoder side and the decoder side differ from each other in pulse positions can be reduced. Also, the influence of the transmission line error can be moderated.

The pulse position searcher 2505 uses the sound source pulse search positions which are transmitted from the adder 2504 and the pitch cycle L which is separately transmitted, to determine the optimum combination of positions where sound source pulses are raised. In the pulse searching method, as described in "ITU-T Recommendation G.729: Coding of Speech at 8 kbits/s using Conjugate-Structure Algebraic-Code-Excited Linear-Prediction (CS-ACELP), March 1996", for example, when the number of pulses is four, the combination from i0 to i3 is determined in such a manner that the equation (2) shown in the sixth embodiment is maximized. Additionally, the polarity of each sound source pulse at this time is predetermined before the pulse position searching is performed in such a manner that the polarity becomes equal to the polarity in each position of the target vector of a noise code book component, i.e., a signal vector which is obtained by subtracting from an input voice with auditory importance applied thereto a zero input response signal of a synthesis filter for applying the auditory importance and a signal of an adaptive code book component. Then, the quantity of arithmetic operation for the searching can be largely reduced. Also, when the pitch cycle is shorter than the sub-frame length, as described in the fifth embodiment, by applying a pitch-cycling filter, sound source pulses are made into a string of pitch cycle pulses, not impulses. In the aforementioned pitch-cycling process, the impulse response vector of the auditory importance applying synthesis filter is passed through the pitch-cycling filter beforehand. Then, in the same manner as the case where the pitch-cycling is not performed, by maximizing the equation (2), the sound source pulse can be searched. In the respective sound source pulse positions determined in this manner, pulses are raised in accordance with each determined polarity of each sound source pulse. Subsequently, by using the pitch cycle L and applying the pitch-cycling filter, the pulse sound source vector can be prepared. The prepared pulse sound source vector is transmitted to the multiplier 2507. The pulse sound source vector transmitted from the pulse position searcher 2505 to the multiplier 2507 is multiplied by the quantized pulse sound source vector gain quantized by the outside gain quantization unit, and transmitted to the adder 2508. Additionally, as omitted from FIG. 25, in the pulse position searcher 2505, together with the pulse sound source vector, the polarity of each sound source pulse indicative of the pulse sound source vector and index information are separately transmitted to the outside of the sound source generating portion. The sound source pulse polarity and the index information are passed through an encoder, a multiplex unit and the like, converted to a series of data to be fed to a transmission line, and transmitted to the transmission line.

The adder 2508 performs a vector addition of an adaptive code vector component from the multiplier 2506 and a pulse sound source vector component from the multiplier 2507, and emits the activating sound source vector.

Also, by switching and operating the pulse sound source with the fixed search positions, the propagation of the influence of the transmission line error can also be inhibited.

Further, for the way to raise pulses, the predetermined number of pulses, e.g., four pulses are raised in the search range, e.g., any of 32 places. In this case, as aforementioned, besides the method of searching all the combinations (8×8×8×8 ways) in such a manner that the 32 places are divided into four and one place is determined from the eight places in which one pulse is allocated, there are a method of searching all the combinations to select four places from the 32 places and other methods. Additionally, beside the combination of impulses with an amplitude 1 , a combination of plural pulses, e.g., two or a pair of pulses, a combination of impulses with different amplitudes or another combination of pulses can be raised.

Fifteenth Embodiment

Figure 27:
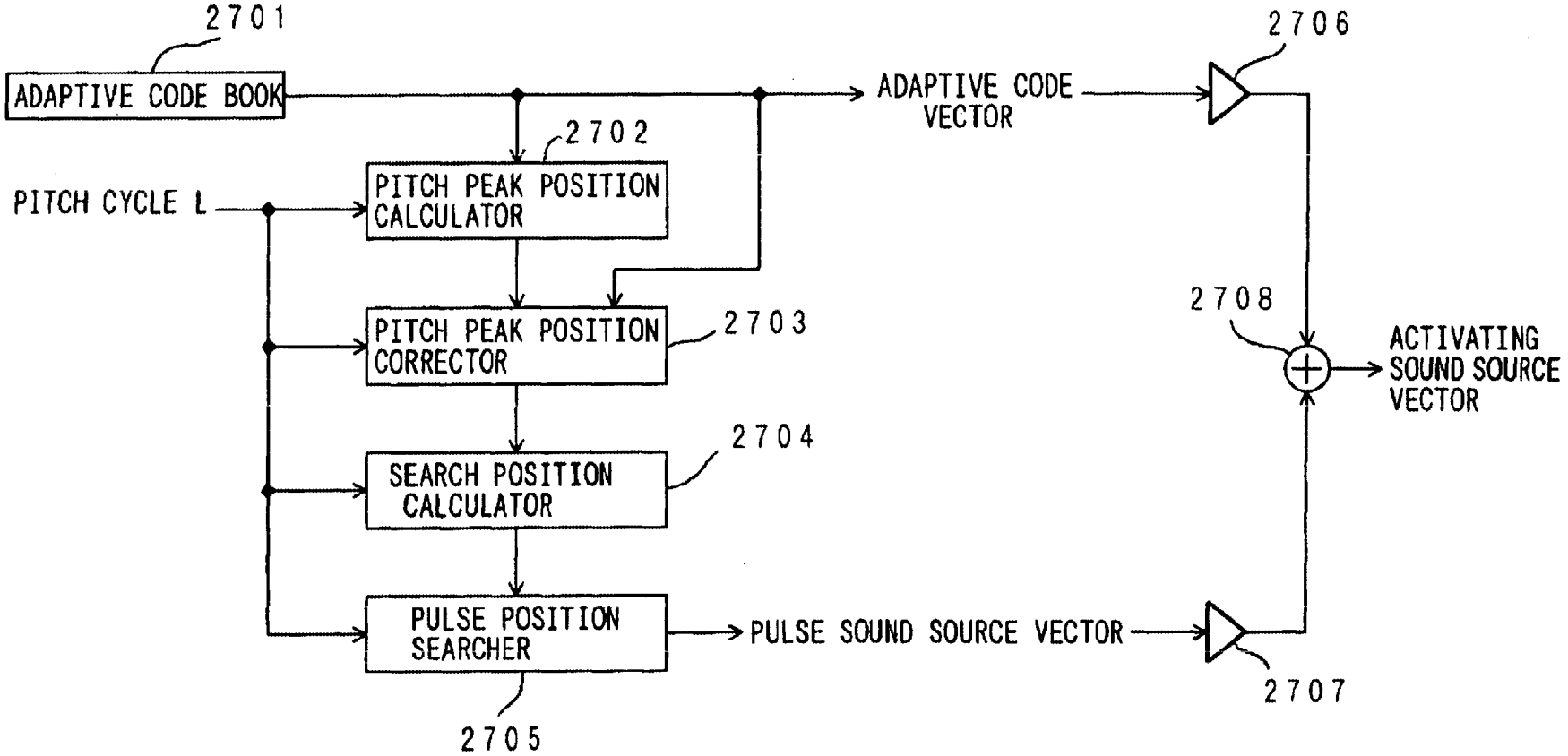
FIG. 27 is a block diagram showing a constitution of a sound source generating portion in a CELP type voice encoding device in a fifteenth embodiment of the invention.

FIG. 27 shows a fifteenth embodiment of the invention and the sound source generating portion of the CELP type voice encoding device as described in the fifth embodiment which is provided with a pitch peak position corrector.

In FIG. 27, numeral 2701 denotes an adaptive code book which stores the past activating sound source vector and transmits a selected adaptive code vector to a pitch peak position calculator 2702, a pitch peak position corrector 2703 and a pitch gain multiplier 2706; 2702 denotes the pitch peak position calculator which receives the adaptive code vector from the adaptive code book 2701 and the pitch cycle L transmitted from the outside, calculates a pitch peak position and transmits an output to the pitch peak position corrector 2703; 2703 denotes the pitch peak position corrector which receives the adaptive code vector from the adaptive code book 2701, the pitch peak position from the pitch peak position calculator 2702 and the pitch cycle L from the outside, corrects the pitch peak position and transmits an output to a search position calculator 2704; 2704 denotes the search position calculator which receives the pitch peak position from the pitch peak position corrector 2703 and the pitch cycle L transmitted separately and transmits sound source pulse search positions to a pulse position searcher 2705; 2705 denotes the pulse position searcher which receives the search positions from the search position calculator 2704 and the pitch cycle L separately calculated outside the sound source generating portion, searches the pulse sound source and transmits a pulse sound source vector to a pulse sound source gain multiplier 2707; 2706 denotes the multiplier which multiplies the adaptive code vector from the adaptive code book 2701 by an adaptive code vector gain and transmits an output to an adder 2708; 2707 denotes the multiplier which multiplies the pulse sound source vector from the pulse position searcher 2705 by a pulse sound source vector gain and transmits an output to the adder 2708; and 2708 denotes the adder which receives the output from the multiplier 2706 and the output from the multiplier 2707, performs a vector addition and emits an activating sound source vector.

Figure 28:
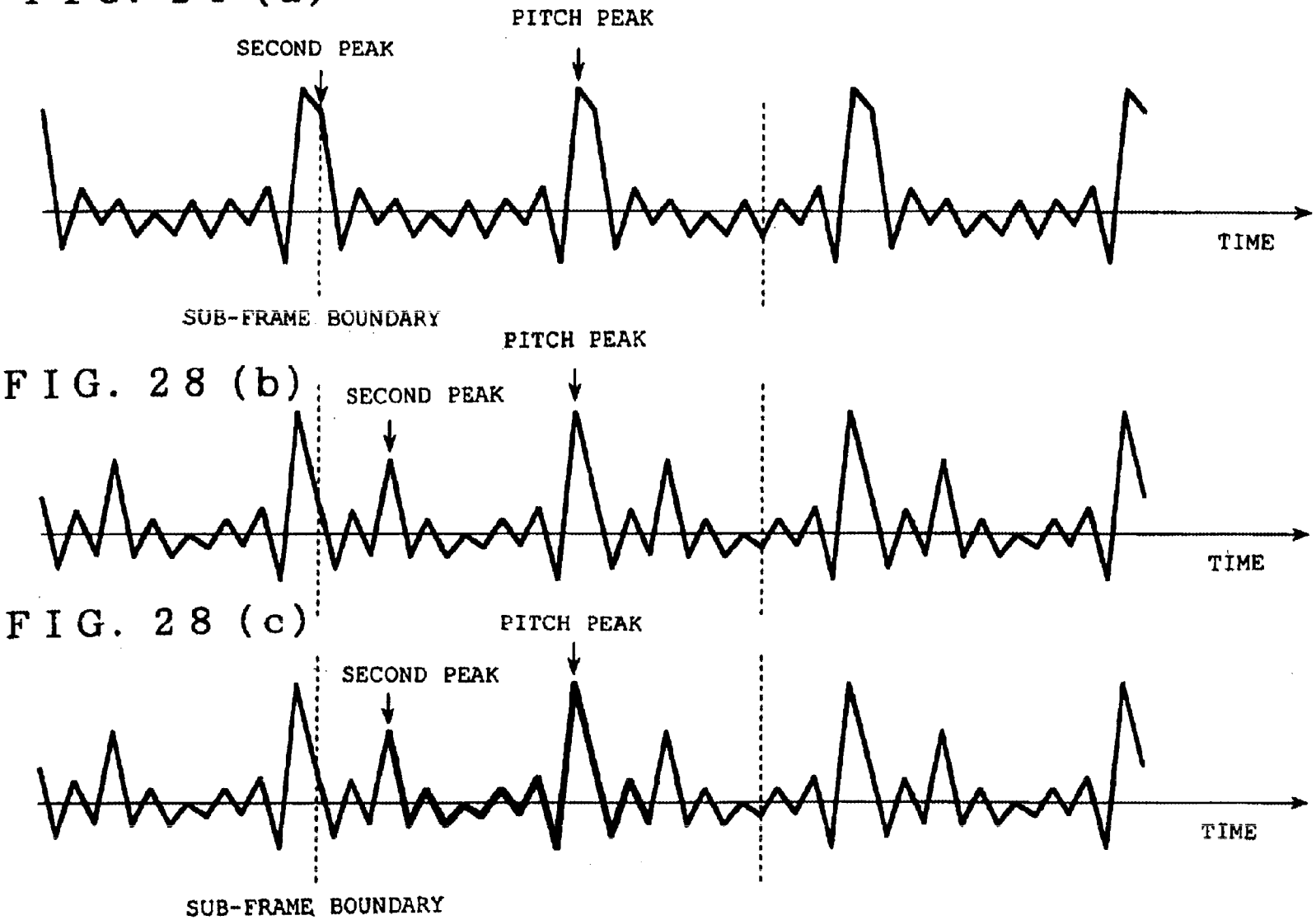
FIGS. 28(*a*) and 28(*b*) are diagrammatic representations each showing an example an adaptive code vector waveform in which a second peak is mistaken for a pitch peak in a pitch peak calculator.

Operation of the sound source generating portion constructed as aforementioned will be described with reference to FIGS. 27 and 28. In FIG. 27, the adaptive code book 2701 cuts out the adaptive code vector having only the sub-frame length from a point which is taken back toward the past only by the pitch cycle L calculated beforehand outside the sound source generating portion, and emits the adaptive code vector. When the pitch cycle L is less than the sub-frame length, the cut-out vectors each having the pitch cycle L are repeatedly connected until the sub-frame length is reached. Then, the connected vector is emitted as the adaptive code vector.

The pitch peak position calculator 2702 uses the adaptive code vector transmitted from the adaptive code book 2701 to determine the pitch peak position which exists in the adaptive code vector. The pitch peak position can be determined by maximizing a normalized correlation of the impulse string arranged in the pitch cycle and the adaptive code vector. Also, the pitch peak position can be obtained more precisely by minimizing an error (maximizing the normalized correlation function) of the impulse string arranged in the pitch cycle which has been passed through the synthesis filter and the adaptive code vector which has been passed through the synthesis filter.

The pitch peak position corrector 2703 cuts out from the adaptive code vector transmitted from the adaptive code book 1701 a vector which has a length of one pitch cycle length L including the pitch peak position point calculated by the pitch peak position calculator 2702. From the cut-out waveform, a point which has a maximum amplitude value is found out and transmitted to the search position calculator 2704. Additionally, the process is performed only when the pitch cycle L is shorter than the sub-frame length. When the pitch cycle L is longer than the sub-frame length, the pitch peak position from the pitch peak position calculator 2702 is transmitted to the pulse position searcher 2705 as it is. When one sub-frame length substantially corresponds to one pitch cycle, there is a possibility that the pitch peak position transmitted from the pitch peak position calculator 2702 is in a place which has a second high amplitude in one pitch waveform (FIG. 28(*a*), 28(*b*): there exists only one pitch peak in one sub-frame, but in one sub-frame there are two points (second peak) which have a second large amplitude value in one pitch cycle waveform, therefore, the second peak is detected by mistake as the pitch peak). To solve the problem, the pitch peak position corrector 2703 checks if there exists a point which has a larger amplitude value within one pitch cycle length from the pitch peak position transmitted from the pitch peak position calculator 2702. When there exists the point which has the amplitude value larger than the amplitude value of the point in the vicinity of the pitch peak position transmitted from the pitch peak position calculator 2702, then the point having the larger amplitude value is regarded as the pitch peak position. For example, in FIG. 28(*c*), when the second peak is transmitted from the pitch peak position calculator 2702, the position which has a maximum amplitude in the adaptive code vector of one pitch cycle from the second peak (a bold-line portion in FIG. 28(*c*)) is regarded as the pitch peak.

The search position calculator 2704 determines the sound source pulse search positions on the basis of the pitch peak position transmitted from the pitch peak position corrector 2703, and transmits an output to the pulse position searcher 2705. To determine the search positions, as in the fifth, sixth or fourteenth embodiment, the sound source pulse search positions are restricted in such a manner that they become dense in the vicinity of the pitch peak position and coarse in the other portions. The restriction method is based on the statistical result that positions with a high probability of raising pulses are concentrated in the pitch pulse vicinity. When the pulse position search range is not restricted, in the voiced portion a probability that pulses are raised in the pitch pulse vicinity is higher than a probability that pulses are raised in the other portions.

The pulse position searcher 2705 uses the sound source pulse search positions transmitted from the search position calculator 2704 and the pitch cycle L separately transmitted, to determine the optimum combination of positions where sound source pulses are raised. In the pulse searching method, as described in "ITU-T Recommendation G.729: Coding of Speech at 8 kbits/s using Conjugate-Structure Algebraic-Code-Excited Linear-Prediction (CS-ACELP), March 1996", for example, when the number of pulses is four, the combination from i0 to i3 is determined in such a manner that the equation (2) shown in the sixth embodiment is maximized. Additionally, the polarity of each sound source pulse at this time is predetermined before the pulse position searching is performed in such a manner that the polarity becomes equal to the polarity in each position of the target vector of a noise code book component, i.e., a signal vector which is obtained by subtracting from an input voice with auditory importance applied thereto a zero input response signal of a synthesis filter for applying the auditory importance and a signal of an adaptive code book component. Then, the quantity of arithmetic operation for the searching can be largely reduced. Also, when the pitch cycle is shorter than the sub-frame length, as described in the fifth embodiment, by applying a pitch-cycling filter, sound source pulses are made into a string of pitch cycle pulses, not impulses. In the aforementioned pitch-cycling process, the impulse response vector of the auditory importance applying synthesis filter is passed through the pitch-cycling filter beforehand. Then, in the same manner as the case where the pitch-cycling is not performed, by maximizing the equation (2), the sound source pulse can be searched. In the respective sound source pulse positions determined in this manner, pulses are raised in accordance with each determined polarity of each sound source pulse. Subsequently, by using the pitch cycle L and applying the pitch-cycling filter, the pulse sound source vector can be prepared. The prepared pulse sound source vector is transmitted to the multiplier 2707. The pulse sound source vector transmitted from the pulse position searcher 2705 to the multiplier 2707 is multiplied by the quantized pulse sound source vector gain quantized by the outside gain quantization unit, and transmitted to the adder 2708. Additionally, as omitted from FIG. 27, in the pulse position searcher 2705 of the encoder, together with the pulse sound source vector, the polarity of each sound source pulse indicative of the pulse sound source vector and index information are separately transmitted to the outside of the sound source generating portion. The sound source pulse polarity and the index information are passed through an encoder, a multiplex unit and the like, converted to a series of data to be fed to a transmission line, and transmitted to the transmission line.

The adder 2708 performs a vector addition of an adaptive code vector component from the multiplier 2706 and a pulse sound source vector component from the multiplier 2707, and emits the activating sound source vector.

Also, in the embodiment, as in the twelfth, thirteenth or fourteenth embodiment, when the index update means, the pulse number and index update means, the fixed search position or the phase adaptive search position is for combined use, the influence of the transmission line error can be moderated. Also, by switching and operating the pulse sound source with the fixed search positions, further the propagation of the influence of the transmission line error can be inhibited.

Also, the pitch peak position corrector according to the invention can be applied to the voice encoding device according to either one of the third to eleventh embodiments.

Further, for the way to raise pulses, the predetermined number of pulses, e.g., four pulses are raised in the search range, e.g., any of 32 places. In this case, as aforementioned, besides the method of searching all the combinations (8×8×8×8 ways) in such a manner that the 32 places are divided into four and one place is determined from the eight places in which one pulse is allocated, there are a method of searching all the combinations to select four places from the 32 places and other methods. Additionally, beside the combination of impulses with an amplitude 1 , a combination of plural pulses, e.g., two or a pair of pulses, a combination of impulses with different amplitudes or another combination of pulses can be raised.

Sixteenth Embodiment

Figure 29:
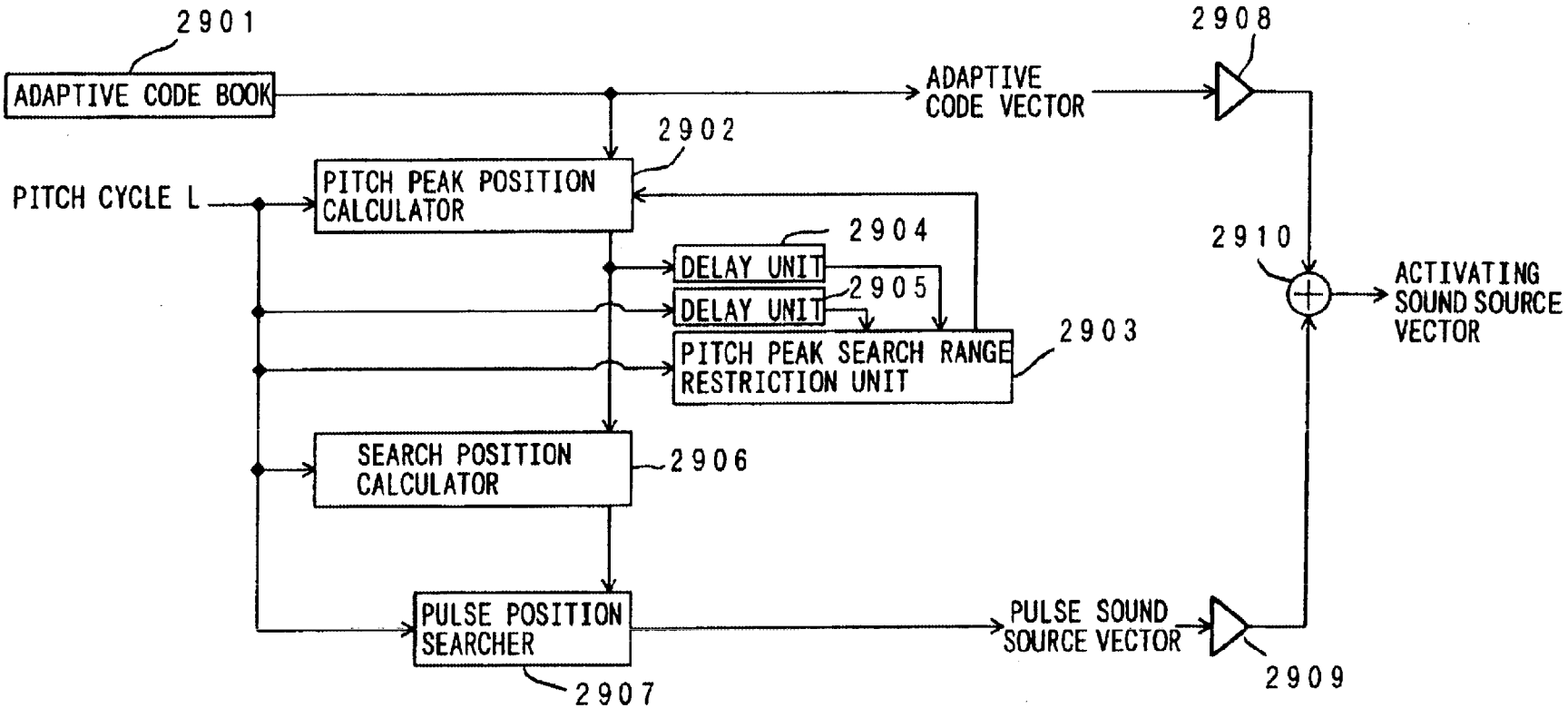
FIG. 29 is a block diagram showing a constitution of a sound source generating portion in a CELP type voice encoding device in a sixteenth embodiment of the invention.

FIG. 29 shows a sixteenth embodiment of the invention and a sound source generating portion of a CELP type voice encoding device which uses a phase continuity of a sound source signal waveform between continuous sub-frames to restrict an existence range of a pitch peak position before the pitch peak position is calculated. In FIG. 29, numeral 2901 denotes an adaptive code book which transmits an adaptive code vector to a pitch peak position calculator 2902 and a multiplier 2908; 2902 denotes the pitch peak position calculator which receives the adaptive code vector from the adaptive code book 2901, the pitch cycle L from the outside of the voice generating portion and a pitch peak search range from a pitch peak search range restriction unit 2903, calculates the pitch peak position in the adaptive code vector and transmits an output to a delay unit 2904 and a search position calculator 2906; 2903 denotes the pitch peak search range restriction unit which receives the pitch peak position in the immediately previous sub-frame transmitted from the delay unit 2904, a pitch cycle in the immediately previous sub-frame transmitted from a delay unit 2905 and the pitch cycle L in the present sub-frame transmitted from the outside of the sound source generating portion, predicts the pitch peak position in the present sub-frame, restricts a pitch peak position search range based on the predicted pitch peak position and transmits the range to the pitch peak position calculator 2902; 2904 denotes the delay unit which receives the pitch peak position from the pitch peak position calculator, delays the input by one sub-frame and transmits an output to the pitch peak search range restriction unit 2903; 2905 denotes the delay unit which receives the pitch cycle L from the outside of the sound generating portion, delays the input by one sub-frame and transmits an output to the pitch peak search range restriction unit 2903; 2906 denotes the search position calculator which receives the pitch peak position from the pitch peak position calculator 2902 and the pitch cycle L from the outside of the sound source generating portion, and transmits sound source pulse search positions to a pulse position searcher 2907; 2907 denotes the pulse position searcher which receives the sound source pulse search positions from the search position calculator 2906 and the pitch cycle L from the outside of the sound source generating portion, uses the received sound source pulse search positions and the pitch cycle L to search a sound source pulse position and transmits a pulse sound source vector to a multiplier 2909; 2908 denotes the multiplier which receives the adaptive code vector from the adaptive code book, multiplies the input by a quantized adaptive code vector gain and transmits an output to an adder 2910; 2909 denotes the multiplier which receives the pulse sound source vector from the pulse position searcher 2907, multiplies the input by a quantized pulse sound source vector gain and transmits an output to the adder 2910; and

2910 denotes the adder which receives vectors from the multipliers 2908 and 2909, respectively, performs an addition of the received vectors and emits an activating sound source vector.

Operation of the sound source generating portion of the voice encoding device constructed as aforementioned will be described with reference to FIG. 29. The adaptive code book 2901 is constituted of the past activating sound source buffer, takes out the relevant portion from the buffer of the activating sound source based on the pitch cycle or pitch lug which is obtained by outside pitch analysis or adaptive code book search means, and transmits the adaptive code vector to the pitch peak position calculator 2902 and the multiplier 2908. The adaptive code vector transmitted from the adaptive code book 2901 to the multiplier 2908 is multiplied by the quantized adaptive code vector gain quantized by an outside gain quantization unit, and transmitted to the adder 2910.

The pitch peak position calculator 2902 detects the pitch peak from the adaptive code vector, and transmits its position to the delay unit 2904 and the search position calculator 2906, respectively. The pitch peak position can be detected (calculated) by maximizing a normalized correlation function of the impulse string vector arranged in the pitch cycle L and the adaptive code vector. Also, the pitch peak position can be detected more precisely by maximizing the normalized correlation function of the vector which is obtained by convoluting the impulse response of the synthesis filter in the impulse string vector arranged in the pitch cycle L and the vector which is obtained by convoluting the impulse response of the synthesis filter in the adaptive code vector. Further, by applying a post-processing in which a position having a maximum amplitude value in one pitch cycle waveform including the detected pitch peak position is used as the pitch peak, a second peak in one pitch cycle waveform can be prevented from being detected by mistake.

The delay unit 2904 delays the pitch peak position calculated by the pitch peak position calculator 2902 by one sub-frame, and transmits an output to the pitch peak search range restriction unit 2903. Specifically, to the pitch peak search range restriction unit 2903 transmitted is the pitch peak position in the immediately previous sub-frame from the delay unit 2904. The delay unit 2905 delays the pitch cycle L transmitted from the outside of the sound source generating portion by one sub-frame and transmits an output to the pitch peak search range restriction unit 2903. Specifically, to the pitch peak search range restriction unit 2903 transmitted is the pitch cycle in the immediately previous sub-frame from the delay unit 2905.

The pitch peak search range restriction unit 2903 first compares the pitch cycle in the immediately previous sub-frame transmitted from the delay unit 2905 and the pitch cycle in the present sub-frame, and determines whether or not the present sub-frame is a voiced (stationary) portion. Specifically, when the pitch cycle in the immediately previous sub-frame has a small difference from the pitch cycle in the present sub-frame (e.g., within ±5 samples), it is determined that the present sub-frame is the voiced (stationary) portion. Additionally, by adding another delay unit and using the pitch cycle several sub-frames before, it can be determined whether or not the present sub-frame is a voiced portion. When it is determined to be the voiced (stationary) portion, the pitch peak search range restriction unit 2903 receives the pitch peak position in the immediately previous sub-frame transmitted from the delay unit 2904, the pitch cycle in the immediately previous sub-frame transmitted from the delay unit 2905 and the pitch cycle L in the present sub-frame, predicts the pitch peak position in the present sub-frame and sets portions before and after the predicted position (e.g. 10 samples) as the pitch peak position search range. Additionally, when the predicted pitch peak position exists in the vicinity of the top of the sub-frante, the vicinity one pitch cycle before is added to the search range. When the predicted pitch peak position is in the vicinity of the position one pitch cycle before the top of the sub-frame, the vicinity of the top of the sub-frame is also added to the search range. Further, when it is determined that the present sub-frame is not the voiced (stationary) portion, without restricting the pitch peak search range, the entire sub-frame is used as the pitch peak search range. In this manner, the pitch peak search range obtained by the pitch peak search range restriction unit 2903 is transmitted to the pitch peak position calculator 2902. Additionally, at the time of starting the voice encoding process (first sub-frame), the past input pitch cycle L (in the immediately previous sub-frame) does not exists. Therefore, an appropriate constant (e.g., the maximum or minimum value of the pitch cycle, zero or another improbable pitch cycle) may be transmitted to the delay unit 2905. The same applies to the delay unit 2904. Further, the predicted pitch peak position can be obtained with the equation (6) shown in the tenth embodiment (refer to FIG. 19).

The search position calculator 2906 determines the sound source pulse search positions on the basis of the pitch peak position and transmits an output to the pulse position searcher 2907. The search positions are determined, as shown in, for example, the sixth embodiment or the eighth embodiment, in such a manner that the search positions are distributed densely in the pitch peak vicinity and coarsely in the other portions. Additionally, as described in the sixth embodiment or the eighth embodiment, the pitch cycle information is used to change the number of sound source pulses or to restrict the sound source pulse search range. This is also effectively applied. Also, when the search positions are determined as described in either one of the twelfth to fourteenth embodiments, the influence of the transmission line error can be moderated.

The pulse position searcher 2907 uses the sound source pulse search positions determined by the search position calculator 2906 or the predetermined fixed search positions and the pitch cycle L separately transmitted, to determine the optimum combination of positions where sound source pulses are raised. In the pulse searching method, as described in "ITU-T Recommendation G.729: Coding of Speech at 8 kbits/s using Conjugate-Structure Algebraic-Code-Excited Linear-Prediction (CS-ACELP), March 1996", for example, when the number of pulses is four, the combination from i0 to i3 is determined in such a manner that the equation (2) shown in the sixth embodiment is maximized. Additionally, the polarity of each sound source pulse at this time is predetermined before the pulse position searching is performed in such a manner that the polarity becomes equal to the polarity in each position of the target vector of a noise code book component, i.e., a signal vector which is obtained by subtracting from an input voice with auditory importance applied thereto a zero input response signal of a synthesis filter for applying the auditory importance and a signal of an adaptive code book component. Then, the quantity of arithmetic operation for the searching can be largely reduced. Also, when the pitch cycle is shorter than the sub-frame length, as described in the fifth embodiment, by applying a pitch-cycling filter, sound source pulses are made into a string of pitch cycle pulses, not impulses. In the aforementioned pitch-cycling process, the impulse response vector of the auditory importance applying synthesis filter is passed through the pitch-cycling filter beforehand. Then, in the same manner as the case where the pitch-cycling is not performed, by maximizing the equation (2), the sound source pulse can be searched. In the respective sound source pulse positions determined in this manner, pulses are raised in accordance with each determined polarity of each sound source pulse. Subsequently, by using the pitch cycle L and applying the pitch-cycling filter, the pulse sound source vector can be prepared. The prepared pulse sound source vector is transmitted to the multiplier 2909. The pulse sound source vector transmitted from the pulse position searcher 2907 to the multiplier 2909 is multiplied by the quantized pulse sound source vector gain quantized by the outside gain quantization unit, and transmitted to the adder 2910.

The adder 2910 performs a vector addition of an adaptive code vector component from the multiplier 2908 and a pulse sound source vector component from the multiplier 2909, and emits the activating sound source vector.

Further, for the way to raise pulses, the predetermined number of pulses, e.g., four pulses are raised in the search range, e.g., any of 32 places. In this case, as aforementioned, besides the method of searching all the combinations (8×8×8×8 ways) in such a manner that the 32 places are divided into four and one place is determined from the eight places in which one pulse is allocated, there are a method of searching all the combinations to select four places from the 32 places and other methods. Additionally, beside the combination of impulses with an amplitude 1 , a combination of plural pulses, e.g., two or a pair of pulses, a combination of impulses with different amplitudes or another combination of pulses can be raised.

Seventeenth Embodiment

Figure 30:
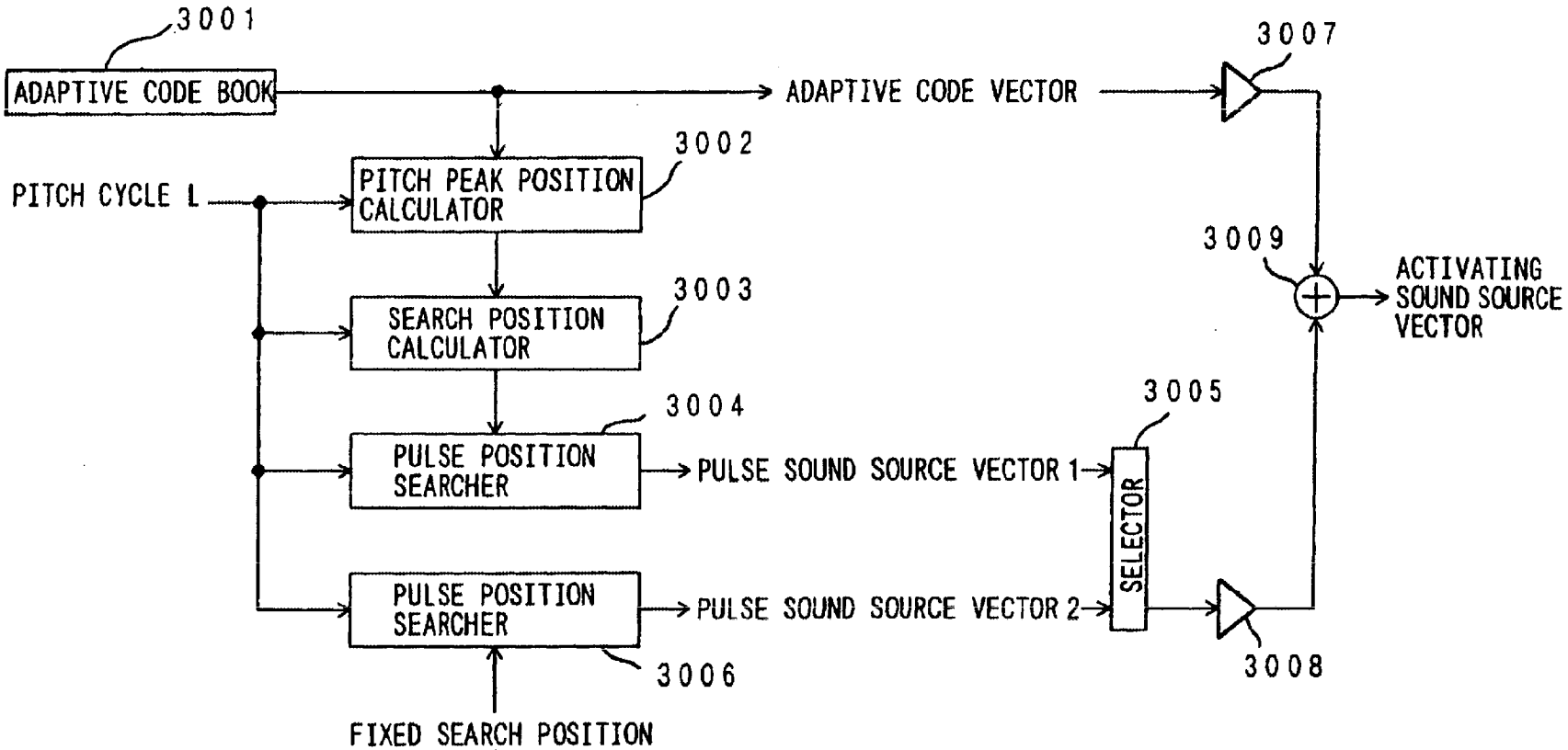
FIG. 30 is a block diagram showing a constitution of a sound source generating portion in a CELP type voice encoding device in a seventeenth embodiment of the invention.

FIG. 30 shows a seventeenth embodiment of the invention and a sound source generating portion of a CELP type voice encoding device: which is provided with a pulse searcher which uses fixed search positions having a small number of pulses and sufficient position information allocated to each pulse; a pulse searcher which uses sound source pulse search positions having a large number of pulses and not necessarily sufficient position information allocated to each pulse; and a selector which selects an optimum pulse sound source vector from pulse sound source vectors transmitted from these pulse searchers.

In FIG. 30, numeral 3001 denotes an adaptive code book which stores the past activating sound source vector and transmits a selected adaptive code vector to a pitch peak position calculator 3002 and a pitch gain multiplier 3007; 3002 denotes the pitch peak position calculator which receives the adaptive code vector from the adaptive code book 3001 and the pitch cycle L from the outside, calculates a pitch peak position and transmits an output to a search position calculator 3003; 3003 denotes the search position calculator which receives the pitch peak position from the pitch peak position calculator 3002 and the pitch cycle L from the outside and transmits sound source pulse search positions to a pulse position searcher 3004; 3004 denotes the pulse position searcher which receives the search positions transmitted from the search position calculator 3003 and the pitch cycle L separately calculated outside the sound source generating portion, searches a pulse sound source and transmits a pulse sound source vector 1 to a selector 3005; 8005 denotes the selector which receives the pulse sound source vector 1 from the pulse position searcher 3004 and a pulse sound source vector 2 from a pulse position searcher 3006, selects an optimum pulse sound source vector and transmits an output to a multiplier 3008; 3006 denotes the pulse position searcher which receives predetermined fixed search positions and the pitch cycle L transmitted from the outside of the sound source generating portion, searches the pulse sound source and transmits the pulse sound source vector 2 to the selector 3005; 3007 denotes the multiplier which multiplies the adaptive code vector from the adaptive code book 3001 by an adaptive code vector gain and transmits an output to an adder 3009; 3008 denotes the multiplier which multiplies the pulse sound source vector from the selector 3005 by a pulse sound source vector gain and transmits an output to the adder 3009; and 3009 denotes the adder which receives the output from the multiplier 3007 and the output from the multiplier 3008, performs a vector addition and emits an activating sound source vector.

Operation of the sound source generating portion constructed as aforementioned will be described with reference to FIG. 30. In FIG. 30, the adaptive code book 3001 cuts out the adaptive code vector having only the sub-frame length from a point which is taken back toward the past only by the pitch cycle L calculated beforehand outside the sound source generating portion, and emits the adaptive code vector. When the pitch cycle L is less than the sub-frame length, the cut-out vectors each having the pitch cycle L are repeatedly connected until the sub-frame length is reached. Then, the connected vector is emitted as the adaptive code vector.

The pitch peak position calculator 3002 uses the adaptive code vector transmitted from the adaptive code book 3001 to determine the pitch peak position which exists in the adaptive code vector. The pitch peak position can be determined by maximizing a normalized correlation function of the impulse string arranged in the pitch cycle and the adaptive code vector. Also, it can be obtained more precisely by minimizing an error (maximizing the normalized correlation function) of the impulse string arranged in the pitch cycle which has been passed through a synthesis filter and the adaptive code vector which has been passed through the synthesis filter. Further, by providing the pitch peak position corrector as described in the fifteenth embodiment, errors in calculation of the pitch peak position can be reduced.

The search position calculator 3003 determines the sound source pulse search positions on the basis of the pitch peak position transmitted from the pitch peak position calculator 2902 and transmits an output to the pulse position searcher 3004. To determine the search positions, as in the fifth, sixth or fourteenth embodiment, the sound source pulse search positions are restricted in such a manner that they become dense in the pitch peak position vicinity and coarse in the other portions. The restriction method is based on the statistical result that positions with a high probability of raising pulses are concentrated in the pitch pulse vicinity. When the pulse position search range is not restricted, in the voiced portion a probability that pulses are raised in the pitch pulse vicinity is higher than a probability that pulses are raised in the other portions. Additionally, by using the method of determining the sound source pulse search positions as described in either one of the twelfth to fourteenth embodiments, the influence of the transmission line error can be moderated.

The pulse position searcher 3004 uses the sound source pulse search positions transmitted from the search position calculator 3003 and the pitch cycle L separately transmitted, to determine the optimum combination of positions where sound source pulses are raised. In the pulse searching method, as described in "ITU-T Recommendation G.729:

Coding of Speech at 8 kbits/s using Conjugate-Structure Algebraic-Code-Excited Linear-Prediction (CS-ACELP), March 1996", for example, when the number of pulses is four, the combination from i0 to i3 is determined in such a manner that the equation (2) shown in the sixth embodiment is maximized. Additionally, the polarity of each sound source pulse at this time is predetermined before the pulse position searching is performed in such a manner that the polarity becomes equal to the polarity in each position of the target vector of a noise code book component, i.e., a signal vector which is obtained by subtracting from an input voice with auditory importance applied thereto a zero input response signal of a synthesis filter for applying the auditory importance and a signal of an adaptive code book component. Then, the quantity of arithmetic operation for the searching can be largely reduced. Also, when the pitch cycle is shorter than the sub-frame length, as described in the fifth embodiment, by applying a pitch-cycling filter, sound source pulses are made into a string of pitch cycle pulses, not impulses. In the aforementioned pitch-cycling process, the impulse response vector of the auditory importance applying synthesis filter is passed through the pitch-cycling filter beforehand. Then, in the same manner as the case where the pitch-cycling is not performed, by maximizing the equation (2), the sound source pulse can be searched. In the respective sound source pulse positions determined in this manner, pulses are raised in accordance with each determined polarity of each sound source pulse. Subsequently, by using the pitch cycle L and applying the pitch-cycling filter, the pulse sound source vector can be prepared. The prepared pulse sound source vector is transmitted as the pulse sound source vector 1 to the selector 3005. Additionally, the sound source pulse search positions used by the pulse position searcher 3004 have a large number of sound source pulses. Therefore, the position information allocated to each sound source pulse is not necessarily sufficient. Specifically, the mode of using the pulse position searcher 3004 has a large number of pulses, but cannot necessarily strictly represent each pulse position. In this manner, when there is a shortage of each pulse position information, the method of determining the pulse search positions as performed by the search position calculator 3003 can be effectively used.

The pulse position searcher 3006 uses the predetermined fixed search positions and the pitch cycle L separately transmitted from the outside of the sound source generating portion, to determine the optimum combination of positions where sound source pulses are raised. In the pulse searching method, as described in "ITU-T Recommendation G.729: Coding of Speech at 8 kbits/s using Conjugate-Structure Algebraic-Code-Excited Linear-Prediction (CS-ACELP), March 1996", for example, when the number of pulses is four, the combination from i0 to i3 is determined in such a manner that the equation (2) shown in the sixth embodiment is maximized. Additionally, the polarity of each sound source pulse at this time is predetermined before the pulse position searching is performed in such a manner that the polarity becomes equal to the polarity in each position of the target vector of a noise code book component, i.e., a signal vector which is obtained by subtracting from an input voice with auditory importance applied thereto a zero input response signal of a synthesis filter for applying the auditory importance and a signal of an adaptive code book component. Then, the quantity of arithmetic operation for the searching can be largely reduced. Also, when the pitch cycle is shorter than the sub-frame length, as described in the fifth embodiment, by applying a pitch-cycling filter, sound source pulses are made into a string of pitch cycle pulses, not impulses. In the aforementioned pitch-cycling process, the impulse response vector of the auditory importance applying synthesis filter is passed through the pitch-cycling filter beforehand. Then, in the same manner as the case where the pitch-cycling is not performed, by maximizing the equation (2), the sound source pulse can be searched. In the respective sound source pulse positions determined in this manner, pulses are raised in accordance with each determined polarity of each sound source pulse. Subsequently, by using the pitch cycle L and applying the pitch-cycling filter, the pulse sound source vector can be prepared. The prepared pulse sound source vector is transmitted as the pulse sound source vector 2 to the selector 3005. Here, in the fixed search positions transmitted to the pulse position searcher 3006, the number of sound source pulses has to be reduced in such a manner that sufficient position information is allocated to each sound source pulse (specifically, all the points in the sub-frame are included in the fixed search position pattern). When the number of pulses is decreased while the positions with pulses raised therein can be precisely represented, then the quality of voice synthesized in the voiced rising portion and the like can be enhanced. Also, by providing the mode in which the position information is sufficient, the deterioration which occurs when only the mode in which there is a shortage of position information is used can be avoided.

Additionally, FIG. 30 shows two types of the pulse position searchers. However, by increasing the searchers to three types or more, switching can be performed in accordance with the features of input signals. Also, instead of the sound source pulse search positions transmitted from the search position calculator 3003, the predetermined fixed search positions are transmitted to the pulse position searcher 3004. Even in the constitution, by using the mode in which the position information allocated to each pulse is sufficient and a small number of pulses are provided, the quality of voice synthesized in the voiced rising portion and the like can be effectively enhanced. Also, the deterioration of the synthesized voice quality which occurs when only the mode in which there is a shortage of position information is used can be avoided. However, when the pulse position searcher 3004 uses the sound source pulse search positions determined by the search position calculator 3003 to perform the pulse position searching, in the voiced portion which has the feature that sound source pulses are easily raised in the pitch peak vicinity, the mode with a large number of pulses can be used with an enhanced efficiency.

The selector 3005 compares the pulse sound source vector 1 transmitted from pulse position searcher 3004 and the pulse sound source vector 2 transmitted from the pulse position searcher 3006, selects the vector which has a smaller distortion in synthesized voice and transmits the optimum pulse sound source vector to the multiplier 3008. The pulse sound source vector transmitted from the selector 3005 to the multiplier 3008 is multiplied by the quantized pulse sound source vector gain quantized by the outside gain quantization unit, and transmitted to the adder 3009. Additionally, as omitted from FIG. 30, in the pulse position searchers 3004 and 3006 of the encoder, together with the pulse sound source vectors 1 and 2, the polarity of each sound source pulse indicative of each pulse sound source vector and index information are separately transmitted to the selector 3005. Further from the selector 3005, the information as to which of the pulse sound source vectors 1 and 2 has been selected, and each pulse polarity and index indicative of the selected pulse sound source vector are transmitted to the outside of the sound source generating portion. The selection information and the sound source pulse polarity and index information are passed through an encoder, a multiplex unit and the like, converted to a series of data to be fed to a transmission line, and transmitted to the transmission line.

The adder 3009 performs a vector addition of an adaptive code vector component from the multiplier 3007 and a pulse sound source vector component from the multiplier 3008, and emits the activating sound source vector.

Also, in the embodiment, as in the twelfth, thirteenth or fourteenth embodiment, when the index update means, the pulse number and index update means, the fixed search position or the phase adaptive search position is for combined use in the former stage of the pulse position searcher 3004, the property that the influence of transmission line error is easily exerted because of the use of search position calculator 3003 can be diminished.

Further, for the way to raise pulses, the predetermined number of pulses, e.g., four pulses are raised in the search range, e.g., any of 32 places. In this case, as aforementioned, besides the method of searching all the combinations (8×8×8×8 ways) in such a manner that the 32 places are divided into four and one place is determined from the eight places in which one pulse is allocated, there are a method of searching all the combinations to select four places from the 32 places and other methods. Additionally, beside the combination of impulses with an amplitude 1 , a combination of plural pulses, e.g., two or a pair of pulses, a combination of impulses with different amplitudes or another combination of pulses can be raised.

Further, in the mode in which there is a small number of pulses and sufficient pulse position information, within a range in which there is no shortage of pulse position information, a part of the pulse position information is allocated to the index indicative of the noise code vector. Then, the performance in a voiced rising portion, an unvoiced consonant portion and a noise input signal can be enhanced.

Also, the sound source generating function in the voice encoding device and the voice decoding device described in the above first to seventeenth embodiments can be recorded as program in a magnetic disc, an optical magnetic disc, a CD, DVD or another optical disc, an IC card, a ROM, RAM or another recording medium or a storage device. Therefore, by reading the recorded data from the recording medium or the storage device by a computer, the function of the voice encoding device can be realized.

In the above the sound source generating portion in the voice encoding device and the voice decoding device has been described. When the sound source generating portion is used in a CELP type voice encoding device and a CELP type voice decoding device which will be described below, it fulfills its effect.

Figure 31:
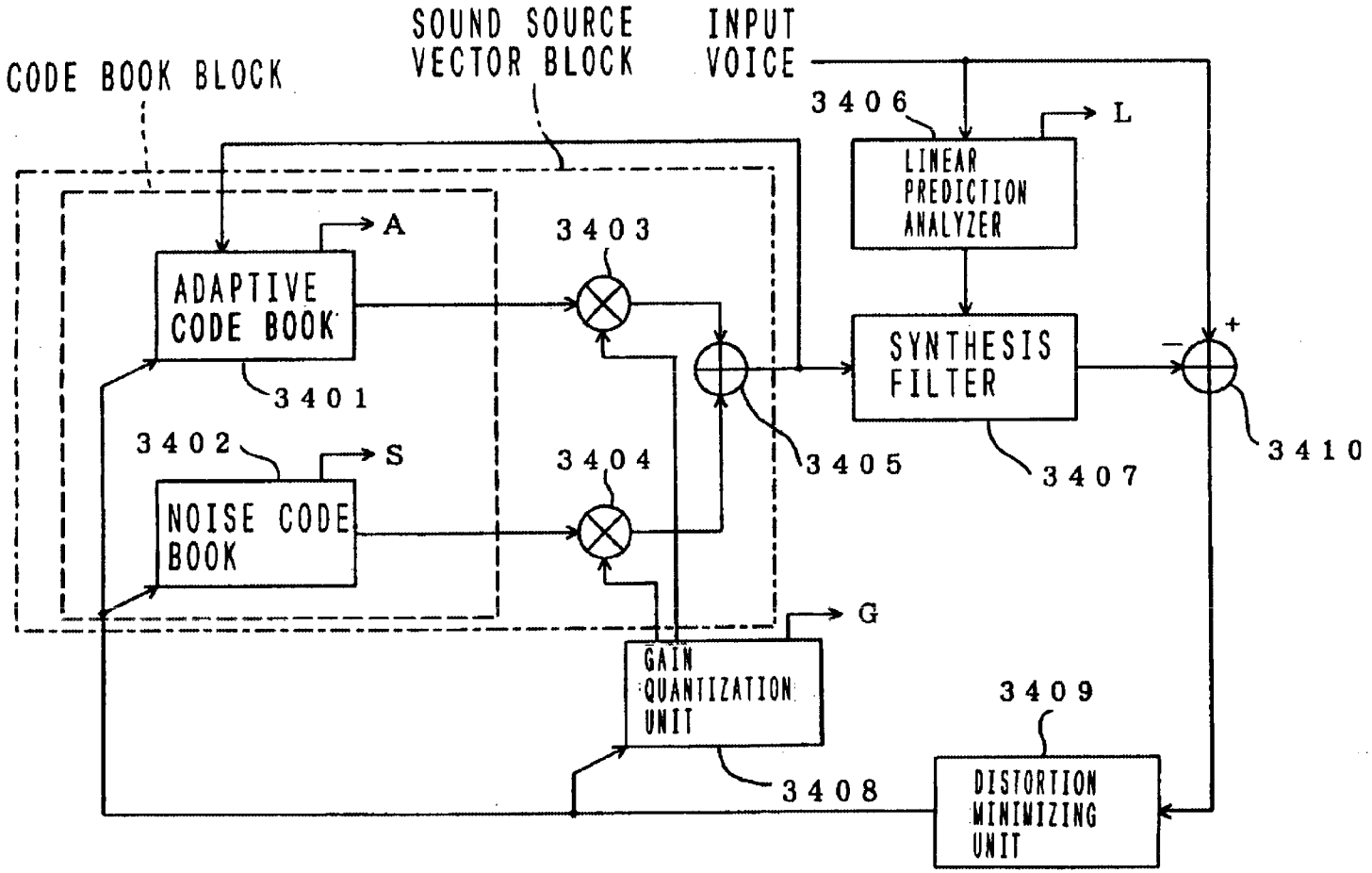
FIG. 31 is a block diagram showing an entire constitution of a preferred embodiment of a CELP type voice encoding device according to the invention together with a conventional sound source generating portion.

FIG. 31 is a block diagram showing an entire constitution of a preferred embodiment of the CELP type voice encoding device according to the invention. In the block diagram, in a code book block enclosed with a dotted line and a sound source vector block enclosed with an alternate long and short dash line, the aforementioned embodiment constitutions are used. Specifically, as shown in FIGS. 1, 3 or the like, the embodiment which is constituted to prepare the adaptive code vector and the noise code vector is used as the code book block in FIG. 31. On the other hand, as shown in FIGS. 8, 12, 14, 15, 17, 18, 20, 21, 23, 25, 27, 29, 30 or the like, the embodiment which is constituted to prepare the activating sound source vector is used as the sound source vector block in FIG. 31. Additionally, in FIG. 31, the sound source vector block and the code book block constituting a part of the sound source vector block themselves show a conventional constitution.

In FIG. 31, a time series code is transmitted as output data of an adaptive code book 3401 to a vector multiplier 3403, and multiplied by a gain code G0. On the other hand, a time series code is transmitted as output data of an adaptive code book 3402 to a vector multiplier 3404, and multiplied by a gain code G1. Outputs of the vector multipliers 3403 and 3404 are mutually added in an adder 3405. Its result is transmitted via a synthesis filter 3407 to a minus input of an adder 3410. An input voice signal is transmitted to a linear prediction analyzer 3406 and further to a plus input of the adder 3410. In the linear prediction analyzer 3406, the input voice is linearly predicted and analyzed, and further quantized. Then, a prediction coefficient L is transmitted as a part of encoding output, and set as a coefficient of the synthesis filter 3407. Output data of the adder 3410 is given to a distortion minimizing unit 3409. To minimize a distortion of synthesized waveform in the synthesis filter 3407, a signal is generated for controlling a vector cutting-out in the adaptive code books 3401 and 3402. Specifically, to minimize the distortion, the distortion minimizing unit 3409 generates control signals for controlling the adaptive code book 3401, the adaptive code book 3402 and a gain quantization unit 3408, respectively, and transmits the signals to these circuits.

Codes A, S, G and L indicative of data in FIG. 31 and FIG. 32 described later are as follows:

A: index information (transferred from the encoding device to the decoding device) indicative of the adaptive code vector finally selected by the distortion minimizing unit 3409;

S: index information (transferred from the encoding device to the decoding device) indicative of the noise code vector finally selected by the distortion minimizing unit 3409;

G: quantization information (transferred from the encoding device to the decoding device) representing the quantization gain finally determined by the distortion minimizing unit 3409;

L: information (transferred from the encoding device to the decoding device) representing the linear prediction coefficient quantized by the linear prediction analyzer 3406.

In the aforementioned respective embodiments, the realization of the voice encoding device according to the invention has been described. In the invention, however, the method of preparing the sound source vector is provided with the feature. The feature can be applied as it is to the voice decoding device. Therefore, the aforementioned respective embodiments can be used as they are in the sound source vector generating portion of the CELP type voice decoding device. To clarify this respect, the CELP type voice decoding device according to the invention will be described below.

Figure 32:
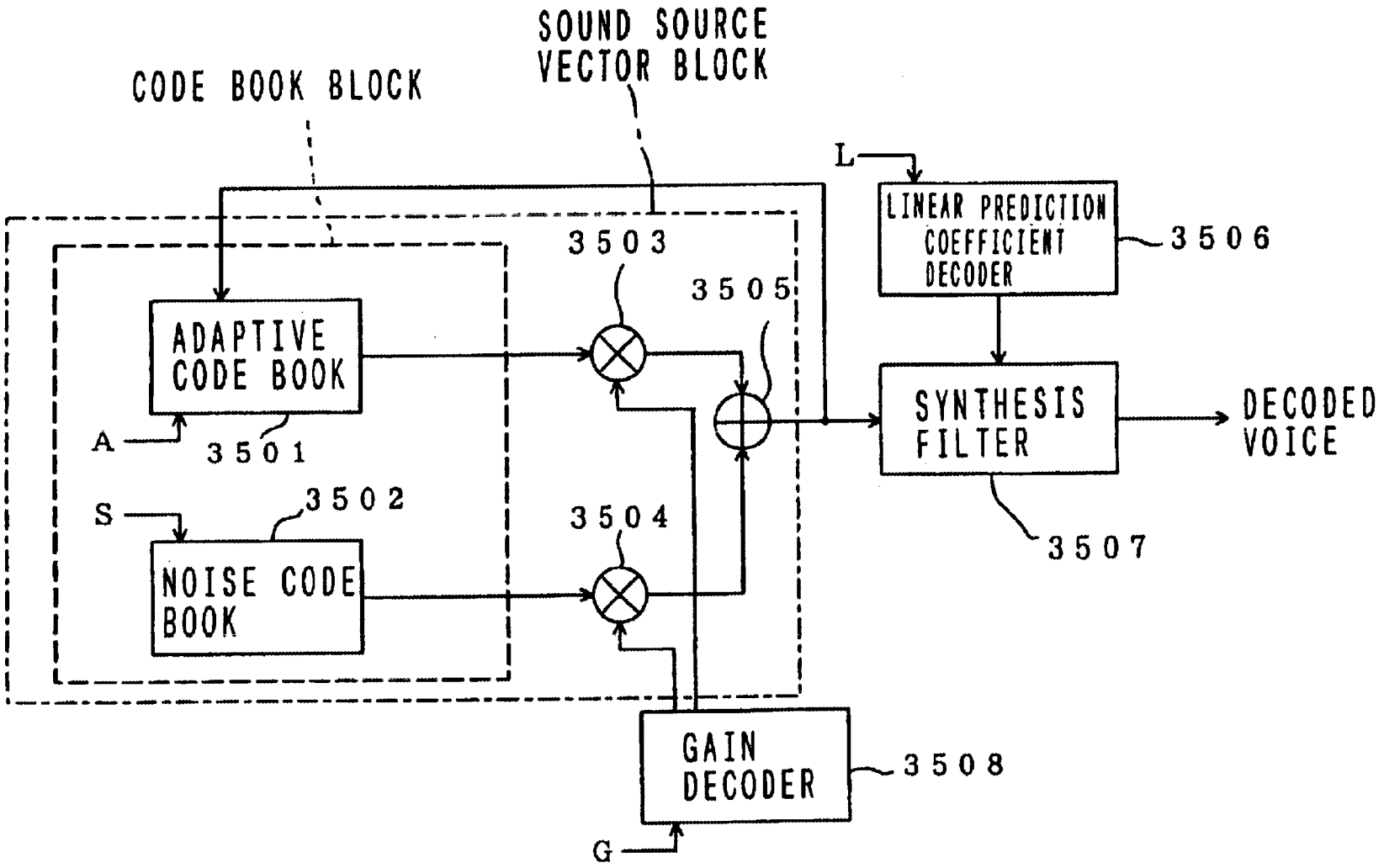
FIG. 32 is a block diagram showing an entire constitution of a preferred embodiment of a CELP type voice decoding device according to the invention together with the conventional sound source generating portion.

FIG. 32 is a block diagram showing an entire constitution of a preferred embodiment of the CELP type voice decoding device according to the invention. In the block diagram, in a code book block enclosed with a dotted line and a sound source vector block enclosed with an alternate long and short dash line, the aforementioned embodiment constitutions are used. Specifically, as shown in FIGS. 1, 3 or the like, the embodiment which is constituted to prepare the adaptive code vector and the noise code vector is used as the code book block in FIG. 32. On the other hand, as shown in FIGS. 8, 12, 14, 15, 17, 18, 20, 21, 23, 25, 27, 29, 30 or the like, the embodiment which is constituted to prepare the activating sound source vector is used as the sound source vector block in FIG. 32. Additionally, in FIG. 32, the sound source vector block and the code book block constituting a part thereof themselves show a conventional constitution.

In FIG. 32, a time series code is transmitted as output data of an adaptive code book 3501 to a vector multiplier 3503, and multiplied by a gain code G0. On the other hand, a time series code is transmitted as output data of an adaptive code book 3502 to a vector multiplier 3504, and multiplied by a gain code G1. Outputs of the vector multipliers 3503 and 3504 are mutually added in an adder 3505. Its result is transmitted via a synthesis filter 3507 as a decoded voice. A filter coefficient of the synthesis filter 3507 is prepared by a linear prediction coefficient decoder 3506 for decoding a linear prediction coefficient. Gain codes G1 and G0 are prepared by a gain decoder 3508.

As aforementioned, in the CELP type voice encoding device and/or CELP type voice decoding device according to the invention, emphasized is the amplitude of the noise code vector which corresponds to the pitch peak position of the adaptive code vector at the time of encoding and/or decoding a voice. Then, by using phase information which exists in one pitch waveform, sound quality can be enhanced. Therefore, the invention can be preferably applied as, e.g., a digital signal in a voice communication device which performs radio communication or optical radio communication.

Figure 33:
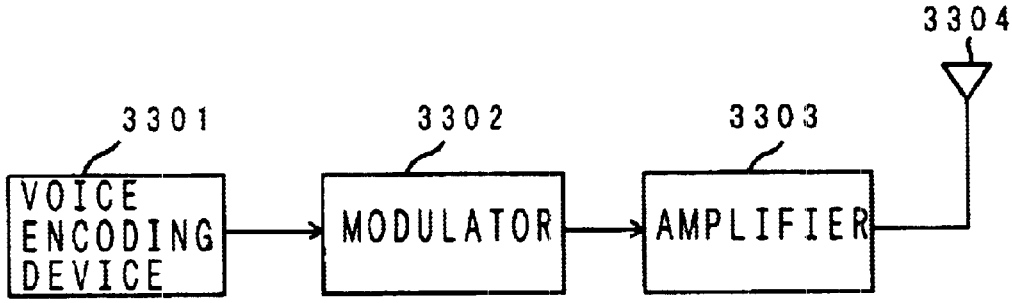
FIG. 33 is a block diagram showing a preferred embodiment of a mobile communication device in which the CELP type voice encoding device of the invention is used.
Figure 34:
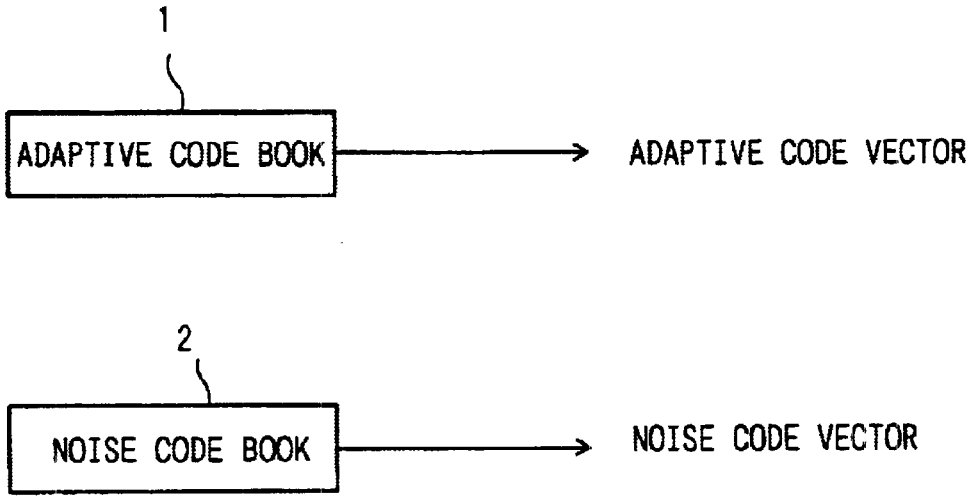
FIG. 34 is a block diagram showing a constitution of a sound source generating portion in a conventional general CELP type voice encoding device.
Figure 35:
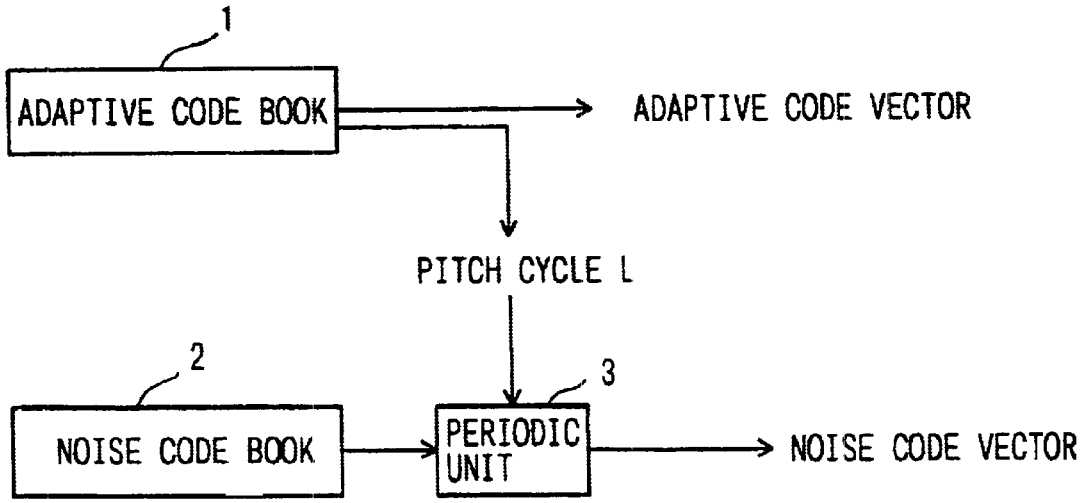
FIG. 35 is a block diagram showing a constitution of a sound source generating portion in a CELP type voice encoding device which has a pitch periodic portion in a conventional noise sound source.

FIG. 33 is a block diagram showing a diagrammatic constitution of a mobile radio terminal which uses a CELP type voice encoding device 3301 of the present invention. An output signal of the voice encoding device 3301 is digital-modulated by, e.g., QPSK (Quadrature Differential Phase Shift Keying) in a modulator 3302. Additionally, the signal is modulated into a signal format which is adapted to, e.g., a CDMA (Code Division Multiple Access) method, a TDMA (Time Division Multiple Access) method and another predetermined access method, amplified by an amplifier 3303 and radiated from an antenna 3304. Further, as not shown, the voice decoding device of the invention can be applied similarly in the mobile radio terminal.

Industrial Adaptability

In the invention, as apparent from the aforementioned embodiments, in order to emphasize the amplitude of the noise code vector which corresponds to the pitch peak position of the adaptive code vector, the amplitude emphasizing window is multiplied by the noise code vector. Therefore, by using the phase information which exists in one pitch waveform, sound quality can be enhanced.

Also in the invention, used is the noise code vector which is restricted only in the pitch peak vicinity of the adaptive code vector. Therefore, even when a small number of bits are allocated to the noise code vector, the deterioration of sound quality can be minimized. Also, the voice quality can be enhanced in the voiced portion in which power is concentrated in the pitch peak vicinity.

Further in the invention, the search range of the pulse position is determined based on the pitch peak position and pitch cycle of the adaptive code vector. Therefore, the pulse position can be searched in accordance with the pitch cycle in one pitch waveform. Even when a small number of bits are allocated to the pulse position, the deterioration of voice quality can be minimized.

Also in the invention, by restricting the pulse search range to the length which is a little longer than one pitch cycle, the sound source signal having a pitch periodicity can be efficiently represented. Also, two pitch peaks are included in the search range, but the case in which a first pitch peak is different in configuration from a second pitch peak or the case in which the position of the first pitch peak is detected by mistake can be handled.

Also, the invention has a constitution in which the number of pulses is adapted and changed in accordance with the pitch cycle of an input voice signal. Therefore, without requiring new information for switching the number of pulses, voice quality can be enhanced.

Further in the invention, before searching the pulse position, the pulse amplitude in the pitch peak vicinity and the other portions is determined. Therefore, the configuration of one pitch waveform can be efficiently represented.

Also in the invention, by using the continuity of the pitch cycle to switch the pulse search positions, the pulse sound source can be searched suitably for each of the voiced rising portion/unvoiced portion and the voiced stationary portion/voiced portion. Therefore, voice quality can be enhanced.

Also in the invention, the pitch gain in the present sub-frame (the adaptive code vector gain) is quantized in a first stage by using a pitch gain which is obtained immediately after the adaptive code is searched. A difference between the optimum pitch gain obtained in the last of the sound source searching and the first-stage quantized pitch gain is quantized in a second stage. Therefore, in the CELP type voice encoding device which prepares a drive sound source vector from the sum of the adaptive code book and the fixed code book (noise code book), the information which is obtained before searching the fixed code book (noise code book) is quantized and transmitted. Therefore, without applying an independent mode information, the switching of the fixed code book (noise code book) or the like can be performed. Voice information can be efficiently encoded.

Also in the invention, based on the continuity of the pitch cycle encoded in the past or the size (or the continuity) of the pitch gain encoded in the past, the pitch periodicity of the voice signal in the present sub-frame is determined. Then, the pulse sound source search positions are switched. Therefore, without applying a new information to determine portions with a high or low pitch periodicity, the pulse sound source searching can be performed suitably for each portion. Therefore, with the same quantity of information, voice quality can be enhanced.

Also in the invention, the pitch peak position in the immediately previous sub-frame, the pitch cycle in the immediately previous sub-frame and the pitch cycle in the present sub-frame are used to backward predict the pitch peak position in the present sub-frame. By using the predicted pitch peak position, it is switched whether or not to perform the phase adaptation process. Therefore, without newly transmitting the switching information, the phase adaptation process can be switched. With the same quantity of information, voice quality can be enhanced. Additionally, in the mode in which the phase adaptation process is not performed, the fixed code book may be used. When the condition that the fixed code book continues to be used in the unvoiced portion or the like, the propagation of an error to the phase adaptive sound source can be effectively reset.

Also in the invention, by using the concentration of signal power in the pitch peak vicinity of the adaptive code vector, it is switched whether or not to perform a phase adaptation. Therefore, without newly transmitting the switching information, the phase adaptation process can be switched.

With the same quantity of information, voice quality can be enhanced. Additionally, in the mode in which no phase adaptation process is performed, the fixed code book may be used. When the condition that the fixed code book continues to be used in the unvoiced portion or the like, the propagation of an error to the phase adaptive sound source can be effectively reset.

Also according to the invention, in the CELP type voice encoding device in which the sound source pulse positions are represented by the relative positions with the pitch peak position being zero, the indexes indicative of respective sound source pulse positions are arranged in order from the top of the sub-frame. Therefore, when the pitch peak position is mistaken because of the influence of transmission line error or the like, a deviation in the sound source pulse positions can be minimized.

Also according to the invention, in the CELP type voice encoding device in which the sound source pulse positions are represented by the relative positions with the pitch peak position being zero, the indexes indicative of respective sound source pulse positions are arranged in order from the top of the sub-frame. Additionally, different pulses which are represented by the same index number are numbered in such a manner that they are arranged in order from the top of the sub-frame. Therefore, when the pitch peak position is mistaken because of the influence of transmission line error or the like, a deviation in the sound source pulse positions can be minimized.

Also according to the invention, in the CELP type voice encoding device in which the sound source pulse positions are represented by the relative positions with the pitch peak position being zero, instead of representing all the sound source pulse search positions by the relative positions, a part thereof is represented by the relative positions, while the remaining search positions are placed in the predetermined fixed positions. Therefore, when the pitch peak position is mistaken because of the influence of transmission line error or the like, by decreasing the probability that the sound source pulse position is deviated, the influence of transmission line error can be prevented from being propagated long.

Also in the invention, the peak position in one pitch waveform is searched as the pitch peak position. Therefore, even when the sub-frame length does not coincide with the pitch cycle, the second peak can be prevented from being wrongly detected as the pitch peak.

Also according to the invention, in the continuous voiced stationary portion, the pitch peak position in the immediately previous sub-frame, the pitch cycle in the immediately previous sub-frame and the pitch cycle in the present sub-frame are used as information to restrict the existence range of the present pitch peak position. Within the range, the pitch peak position is searched. In the constitution, even when by using only the present sub-frame signal the pitch peak position is searched, the second peak in one pitch waveform can be prevented from being wrongly detected as the pitch peak.

Also according to the invention, in the CELP type voice encoding device in which the pulse sound source is applied to the noise code book, the noise code book is constituted to have both the mode of having a small number of sound source pulses but sufficient position information of each sound source pulse and the mode of having a coarse position information of each sound source pulse but a large number of sound source pulses. Therefore, both the enhancement of voice quality in the voiced rising portion and the effective use of the mode with a large number of sound source pulses can be realized.

According to the invention, by the aforementioned constitutions or methods, the sound source is prepared. Therefore, not only in the CELP type voice encoding device but also in the CELP type voice decoding device, the same effect can be provided. Also, the CELP type voice encoding device and the CELP type voice decoding device according to the invention can be applied broadly to a mobile communication device or another communication device in which a voice is encoded and transmitted or the encoded and transmitted voice is decoded to reproduce an original voice, a voice recording device and the like.

What is claimed is:

1. A CELP type voice encoding device comprising:

a noise codebook which can be searched in two modes;

means for selecting one of said two modes in accordance with linear predictive analysis results, a pitch gain and a pitch cycle all of which are obtained as analysis results of an input voice wherein the number of pulses forming a noise code vector is switched between a first case where a variation in pitch cycle is small throughout continuous sub-frames and in a second case where the variation is not small throughout continuous sub-frames; and a sound source generating portion for quantizing a pitch gain using a multi-stage quantizer wherein a first stage quantizer quantizes a calculated pitch gain which is obtained immediately after an adaptive codebook is searched, while a second or higher stage quantizer quantizes a difference between the pitch gain which is determined through a closed loop searching after a sound source searching is completed and a quantized pitch gain which is obtained by said first stage quantizer, and said quantized pitch gain which is quantized by said first stage quantizer is used to select one of said two modes.

2. A CELP type voice encoding device comprising:

a noise codebook which can be searched in two modes; and means for selecting one of said two modes in accordance with linear predictive analysis results, a pitch gain and a pitch cycle all of which are obtained as analysis results of an input voice wherein the number of pulses forming a noise code vector is switched between a first case where a variation in pitch cycle is small throughout continuous sub-frames and in a second case where the variation is not small throughout continuous sub-frames;

wherein each of said two modes is arranged to search a purse codebook with a fixed search position and a search position determined by using pitch parameters.

3. A CELP type voice encoding method, comprising the steps of:

obtaining a linear predictive analysis results, a pitch gain and a pitch cycle by analyzing an input voice;

selecting one of two modes in accordance with said linear predictive analysis results, said pitch gain and said pitch cycle, wherein the number of pulses forming a noise code vector is switched between a first case where a variation in pitch cycle is small throughout continuous sub-frames and in a second case where the variation is not small throughout continuous sub-frames, thereby a noise code book operates according to a selected mode; and using a sound source generating portion for quantizing a pitch gain using a multi-stage quantizer and such that a first stage quantizer quantizes a calculated pitch gain which is obtained immediately after an adaptive codebook is searched, while a second or higher stage quantizer quantizes a difference between the pitch gain which is determined through a closed loop searching after a sound source searching is completed and a quantized pitch gain which is obtained by said first stage quantizer, and said quantized pitch gain which is quantized by said first stage quantizer is used to select one of said two modes.

4. A CELP type voice encoding method, comprising the steps of:

obtaining a linear predictive analysis results, a pitch gain and a pitch cycle by analyzing an input voice; and selecting one of two modes in accordance with said linear predictive analysis results, said pitch gain and said pitch cycle, wherein the number of pulses forming a noise code vector is switched between a first case where a variation in pitch cycle is small throughout continuous sub-frames and in a second case where the variation is not small throughout continuous sub-frames, thereby a noise code book operates according to a selected mode;

said selecting step being performed to select one of said two modes in which a pulse code book is searched with a fixed search position and a search position determined by using pitch parameters.

5. A CELP type voice decoding device, comprising:

a noise codebook which can be searched in two modes;

means for selecting one of said two modes in accordance with linear predictive analysis results, a pitch gain and a pitch cycle all of which are obtained as analysis results of an input voice wherein the number of pulses forming a noise code vector is switched between a first case where a variation in pitch cycle is small throughout continuous sub-frames and in a second case where the variation is not small throughout continuous sub-frames; and a sound source generating portion for quantizing a pitch gain using a multi-stage quantizer wherein a first stage quantizer quantizes a calculated pitch gain which is obtained immediately after an adaptive codebook is searched, while a second or higher stage quantizer quantizes a difference between the pitch gain which is determined through a closed loop searching after a sound source searching is completed and a quantized pitch gain which is obtained by said first stage quantizer, and said quantized pitch gain which is quantized by said first stage quantizer is used to select one of said two modes.

6. A CELP type voice decoding device, comprising:

a noise codebook which can be searched in two modes; and means for selecting one of said two modes in accordance with linear predictive analysis results, a pitch gain and a pitch cycle all of which are obtained as analysis results of an input voice wherein the number of pulses forming a noise code vector is switched between a first case where a variation in pitch cycle is small throughout continuous sub-frames and in a second case where the variation is not small throughout continuous sub-frames;

wherein each of said two modes is arranged to search a pulse codebook with a fixed search position and a search position determined by using pitch parameters.

7. A CELP type voice decoding method, comprising the steps of:

obtaining a linear predictive analysis results, a pitch gain and a pitch cycle by analyzing an input voice;

selecting one of two modes in accordance with said linear predictive analysis results, said pitch gain and said pitch cycle, wherein the number of pulses forming a noise code vector is switched between a first case where a variation in pitch cycle is small throughout continuous sub-frames and in a second case where the variation is not small throughout continuous sub-frames, thereby a noise code book operates according to a selected mode; and using a sound source generating portion for quantizing a pitch gain using a multi-stage quantizer and such that a first stage quantizer quantizes a calculated pitch gain which is obtained immediately after an adaptive codebook is searched, while a second or higher stage quantizer quantizes a difference between the pitch gain which is determined through a closed loop searching after a sound source searching is completed and a quantized pitch gain which is obtained by said first stage quantizer, and said quantized pitch gain which is quantized by said first stage quantizer is used to select one of said two modes.

8. A CELP type voice decoding method, comprising the steps of:

obtaining a linear predictive analysis results, a pitch gain and a pitch cycle by analyzing an input voice; and selecting one of two modes in accordance with said linear predictive analysis results, said pitch gain and said pitch cycle, wherein the number of pulses forming a noise code vector is switched between a first case where a variation in pitch cycle is small throughout continuous sub-frames and in a second case where the variation is not small throughout continuous sub-frames, thereby a noise code book operates according to a selected mode;

said selecting step being performed to select one of said two modes in which a pulse code book is searched with a fixed search position and a search position determined by using pitch parameters.

* * * * *